US012383840B2

(12) United States Patent
Martin et al.

(10) Patent No.: US 12,383,840 B2
(45) Date of Patent: Aug. 12, 2025

(54) TOY SYSTEM

(71) Applicant: Moose Creative Management Pty Limited, Cheltenham (AU)

(72) Inventors: Alex Martin, Mentone (AU); James Austin-Smith, Perranwell Station (GB); Brandon Cole Sopinsky, Los Angeles, CA (US); Miguel Rusch, Kilsyth (AU); Heng Shen Yeap, Reservoir (AU)

(73) Assignee: Moose Creative Management Pty Limited, Cheltenham (AU)

( * ) Notice: Subject to any disclaimer, the term of this patent is extended or adjusted under 35 U.S.C. 154(b) by 218 days.

(21) Appl. No.: 18/449,302

(22) Filed: Aug. 14, 2023

(65) Prior Publication Data

US 2024/0058713 A1 Feb. 22, 2024

Related U.S. Application Data

(60) Provisional application No. 63/371,586, filed on Aug. 16, 2022.

(51) Int. Cl.

| | |
|---|---|
| ***A63H 3/00*** | (2006.01) |
| ***A63H 3/28*** | (2006.01) |
| ***A63H 3/36*** | (2006.01) |
| ***A63H 33/28*** | (2006.01) |

(52) U.S. Cl.

CPC ..... *A63H 3/005* (2013.01); *A63H 3/36* (2013.01); *A63H 33/28* (2013.01); *A63H 3/006* (2013.01); *A63H 3/28* (2013.01)

(58) Field of Classification Search

CPC . A63H 3/50; A63H 3/005; A63H 3/52; A63H 3/22; A63H 3/36; A63H 3/28

See application file for complete search history.

(56) References Cited

U.S. PATENT DOCUMENTS 3,534,496 A * 10/1970 Gardel ..... A63H 3/52 446/134
3,842,531 A * 10/1974 Sloan ..... A63H 3/52 40/406

(Continued)

OTHER PUBLICATIONS

PCT International Search Report and Written Opinion for International Application No. PCT/US2023/072156 dated Nov. 16, 2023.

*Primary Examiner* — Alexander K Garlen

(74) *Attorney, Agent, or Firm* — Knobbe, Martens, Olson & Bear, LLP

(57) ABSTRACT

An interactive toy system is shown and described. The toy system includes a double walled flask adapted to be connected to a base forming an internal space capable of holding an object or a figurine. When an empty space between the double walls is filled with an opaque fluid, it gives the player the impression that the whole flask is filled with such fluid. The toy system includes a smoke generating system, light emitting LEDs and a speaker. During the controlled play process, ingredients are added to an isolated fluid chamber on top of the flask. The operation and the special effects from the smoke, the sound, the light, and the phenomenon in the fluid chamber gives the impression that the creature is being created inside the opaque flask. When the process is concluded and the fluid in the flask is drained, the figurine inside the flask is revealed.

29 Claims, 50 Drawing Sheets

(56) References Cited

U.S. PATENT DOCUMENTS

| | | | | |
|---|---|---|---|---|
| 5,176,561 | A * | 1/1993 | Greenberg | A63H 33/3022 215/11.4 |
| 5,261,848 | A | 11/1993 | Kaplan et al. | |
| 5,442,869 | A | 8/1995 | McDarren et al. | |
| 5,779,552 | A * | 7/1998 | Gelfond | A63J 21/00 472/67 |
| 8,992,281 | B2 | 3/2015 | Lui et al. | |
| 2020/0108326 | A1* | 4/2020 | Pyo | A63H 33/003 |
| 2021/0228994 | A1 | 7/2021 | O'Brien et al. | |

* cited by examiner

TOY SYSTEM

CROSS-REFERENCE TO RELATED APPLICATION

This application claims benefit under 35 U.S.C. 119(e) to U.S. Provisional Patent App. No. 63/371,586, filed Aug. 16, 2022, the entire disclosure of which is hereby incorporated by reference herein in its entirety. Any and all priority claims identified in the Application Data Sheet, or any corrections thereto, are hereby incorporated by reference under 37 CFR 1.57.

BACKGROUND

Field

A toy system is described. More specifically, embodiments of the toy system provide an interactive experience for a user along with a controlled process and figurine reveal experience.

SUMMARY

The present invention is directed to a toy system. In some embodiments, the toy system comprises a double walled flask adapted to be connected to a base to define an internal space capable of holding an object or a figurine.

An aspect of the disclosure is directed to a toy system that comprises a container having an inner wall, an outer wall, and an internal space, the internal space being defined at least in part by the inner wall and being sized and shaped to receive a figurine, the inner wall and the outer wall being spaced apart to define a space therebetween, the space being configured to hold a fluid. The toy system further comprises a base configured to be coupled to the container and in flow communication with the space and a valve configured to allow the fluid to drain from the space and into the base.

Additional aspects further comprise the figurine disposed in the internal space, the figurine being accessible when the container is separated from the base.

Additional aspects further comprise wherein at last a portion of the figurine is disposed in a cavity formed in the base.

Additional aspects further comprise wherein the base comprises an umbilical cord configured to couple to the figurine.

Additional aspects further comprise wherein the container is sized and shaped as a flask, and the base is removable coupled to the container.

Additional aspects further comprise wherein the base comprises a tank, the tank being configured to hold the fluid when the fluid is drained from the space.

Additional aspects further comprise a release handle configured to actuate the valve.

Additional aspects further comprise a control knob configured to be rotated by a user.

Additional aspects further comprise wherein the release handle is prevented from actuating the valve if the control knob is not rotated.

Additional aspects further comprise a fingerprint reader configured to sense contact from the user.

Additional aspects further comprise a smoke generator configured to generate smoke in the internal space.

Additional aspects further comprise a smoke tube in flow communication with the internal space, the smoke tube being configured to allow smoke from the internal space to exit the toy system.

An aspect of the disclosure is directed to a toy system that comprises a container having a double wall forming a gap therebetween, the gap being configured to hold a fluid, a base having a top surface configured to support the container, and a valve configured to allow the fluid to selectively drain from the gap and into the base. Wherein the container and the top surface of the base define an internal space sized and shaped to receive a toy.

Additional aspects further comprise wherein the valve is configured to be manually opened by a user.

Additional aspects further comprise wherein the valve is biased to a closed position.

Additional aspects further comprise wherein a first level of the fluid in the gap obfuscates viewing of the toy through the double wall and a second level of the fluid in the gap allows viewing of the toy through the double wall, the first level being higher than the second level.

Additional aspects further comprise wherein the fluid drains from the gap to the base due to gravity.

Additional aspects further comprise wherein the fluid is opaque.

Additional aspects further comprise wherein the container comprises a chamber disposed above the internal space, the chamber being configured to receive a second fluid and one or more ingredients.

Additional aspects further comprise a smoke generator configured to generate smoke in the internal space.

An aspect of the disclosure is directed to a method of revealing a figurine disposed inside a container to a user. The container has a double wall forming a space therebetween, the space being configured to receive an opaque fluid, the container and a support base form an internal space sized and shaped to receive the figurine. The method comprises draining the opaque fluid from the space in the double wall and into the support base, the support base being configured to hold the fluid and decoupling the container from the support base to access the figurine.

Additional aspects further comprise actuating a fingerprint scanner and rotating a control knob to one or more positions.

Additional aspects further comprise adding one or more ingredients to a chamber disposed above the internal space.

Additional aspects further comprise wherein the one or more ingredients comprise at least one a shark tooth, paper, a fluid, crystal, and a powder.

Additional aspects further comprise creating smoke in the internal space.

Additional aspects further comprise emitting sounds and/or blinking lights.

Additional aspects further comprise pulling a release handle to begin draining the opaque fluid from the space in the double wall and into the support base.

Additional aspects further comprise wherein pulling the release handle actuates a valve to an open position.

Additional aspects further comprise turning the container and the support base upside down to cause the opaque fluid to flow back into the space in the double wall.

Additional aspects further comprise closing a valve to prevent flow of the opaque liquid back into the support base when the container and the support base are turned right side up.

An aspect of the disclosure is directed to a toy system comprising a container having an inner wall, an outer wall, and an internal space, the inner wall and the outer wall being spaced apart to define a space therebetween. The internal space is configured to receive a toy (e.g., figurine or creature). The space between the inner and outer walls is configured to hold a fluid. A base is coupled to the container and in fluid communication with the space. A valve is configured to selectively open the space so as to allow the liquid to pass from the space to the base.

Additional aspects further comprise wherein the toy is disposed in the internal space. The toy is accessible when the container is separated from the base.

Additional aspects further comprise wherein the container is sized and shaped as a flask, and wherein the base is removable from the container.

Additional aspects further comprise wherein the base comprises a tank. The tank is configured to hold the liquid.

Additional aspects further comprise wherein a first level of the liquid in the space obfuscates viewing of the toy through the inner and outer walls and a second level of the liquid in the space allows viewing of the toy through the inner and outer walls. The first level is higher than the second level.

Additional aspects further comprise wherein transfer of the liquid from the space to the base is due to gravity.

Additional aspects further comprise wherein the liquid is opaque.

Additional aspects further comprise wherein the valve is configured to be manually opened by the user.

Additional aspects further comprise wherein the valve is biased to move to a closed position.

Additional aspects further comprise wherein the valve comprises a spring configured to bias the valve to the closed position.

In one aspect, the empty space between the double walls of the flask is filled with an opaque fluid giving the game player an impression that the whole flask is filled with such a fluid.

In another aspect of the invention, the toy system includes a smoke generating system, light emitting diodes (LEDs) and a speaker to enhance the effect that creature making is going on inside the opaque fluid filled flask.

In yet another aspect of the invention, ingredients are added to an isolated fluid chamber on top of the flask to cause visual and sound phenomena that signifies the effect that creature making is going inside the opaque fluid filled flask.

In yet another aspect of the invention, when the process is concluded and the fluid inside the space between the double walls of the flask is drained, the figurine inside the flask is revealed for the player's satisfaction.

BRIEF DESCRIPTION OF THE DRAWINGS

Various embodiments are depicted in the accompanying drawings for illustrative purposes and should in no way be interpreted as limiting the scope of the embodiments. In addition, various features of different disclosed embodiments can be combined to form additional embodiments, which are part of this disclosure.

DETAILED DESCRIPTION

The present description will be directed in particular to elements forming part of, or cooperating more directly with, apparatus and methods in accordance with the present invention. It is to be understood that elements not specifically shown or described may take various forms well known to those skilled in the art.

Figure 40:
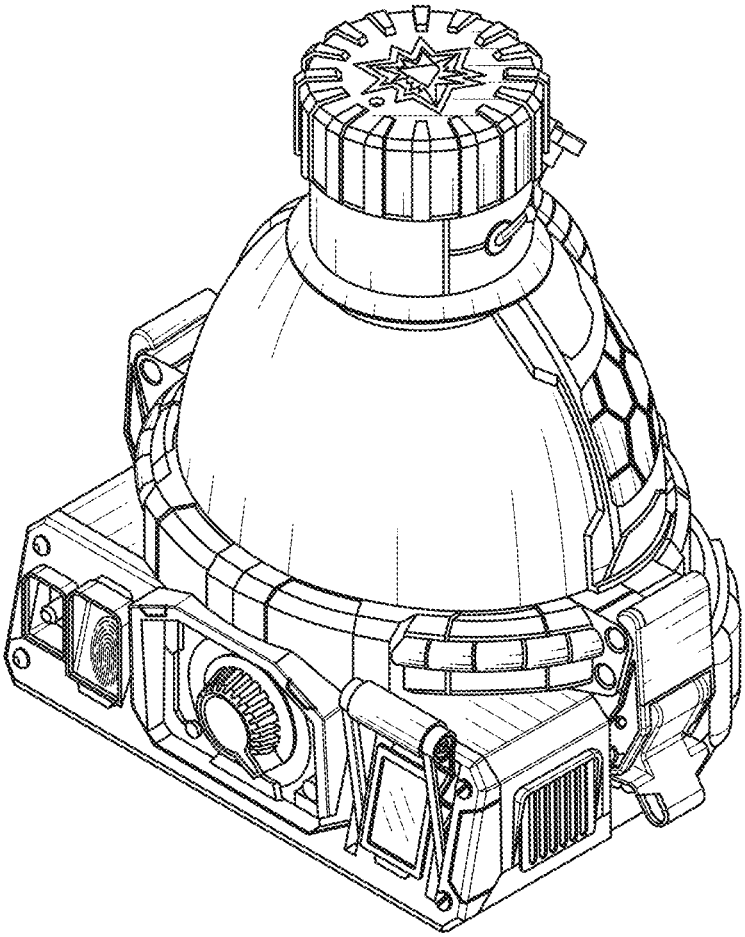
FIG. 40 is a perspective view that illustrates another embodiment of the toy system of FIG. 1.

Embodiments of a toy system disclosed herein, provides a user or a group of users a realistic impression of creating an object, e.g., a figurine. After a series of actions of playing with the toy system, including starting, adding materials and controlling the processes, and ending, the user or player opens the toy system to find an object supposedly created by his/her playing actions. The realistic impression can be further enhanced by special visual and audio effects during the play, such as steady or blinking lighting, smoke emitted from the system, vivid chemical reaction like phenomenon in a chamber, special smell, and/or different sounds. An example of supposedly links between the ingredients and the elements of the figurine are illustrated in FIG. 40.

Figure 1:
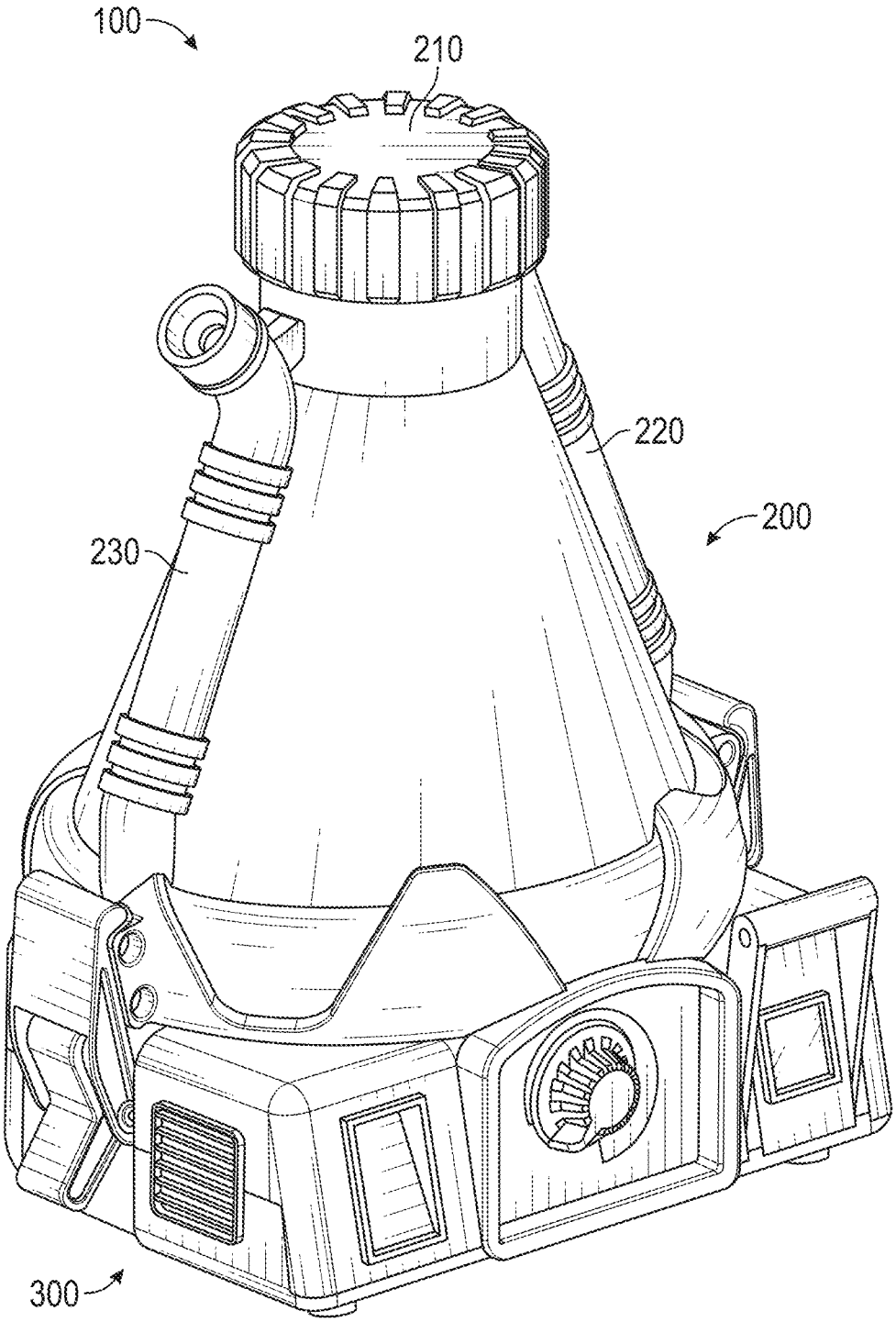
FIG. 1 is a perspective view of a toy system according to an embodiment of the disclosure.

Referring to FIG. 1, an embodiment of a toy system 100 is illustrated. FIG. 1 is a perspective view illustrating a container or flask 200 disposed on a base 300. The body of the flask 200 in FIG. 1 is made of a truncated cone shaped lower portion and a cylindrical upper portion which is capped by a lid 210. On the truncated cone shaped lower portion of the flask 200 is attached an internal connection tube 220 and a smoke tube 230. The body of the flask 200 can have a different shape, as long as it forms an internal space to house an object or a figurine. Another factor for consideration is its visual appeal to the user. For example, the flask 200 can take the shape of a truncated dome. In some embodiments, the flask 200 can be multifaceted with color shapes.

Figure 2:
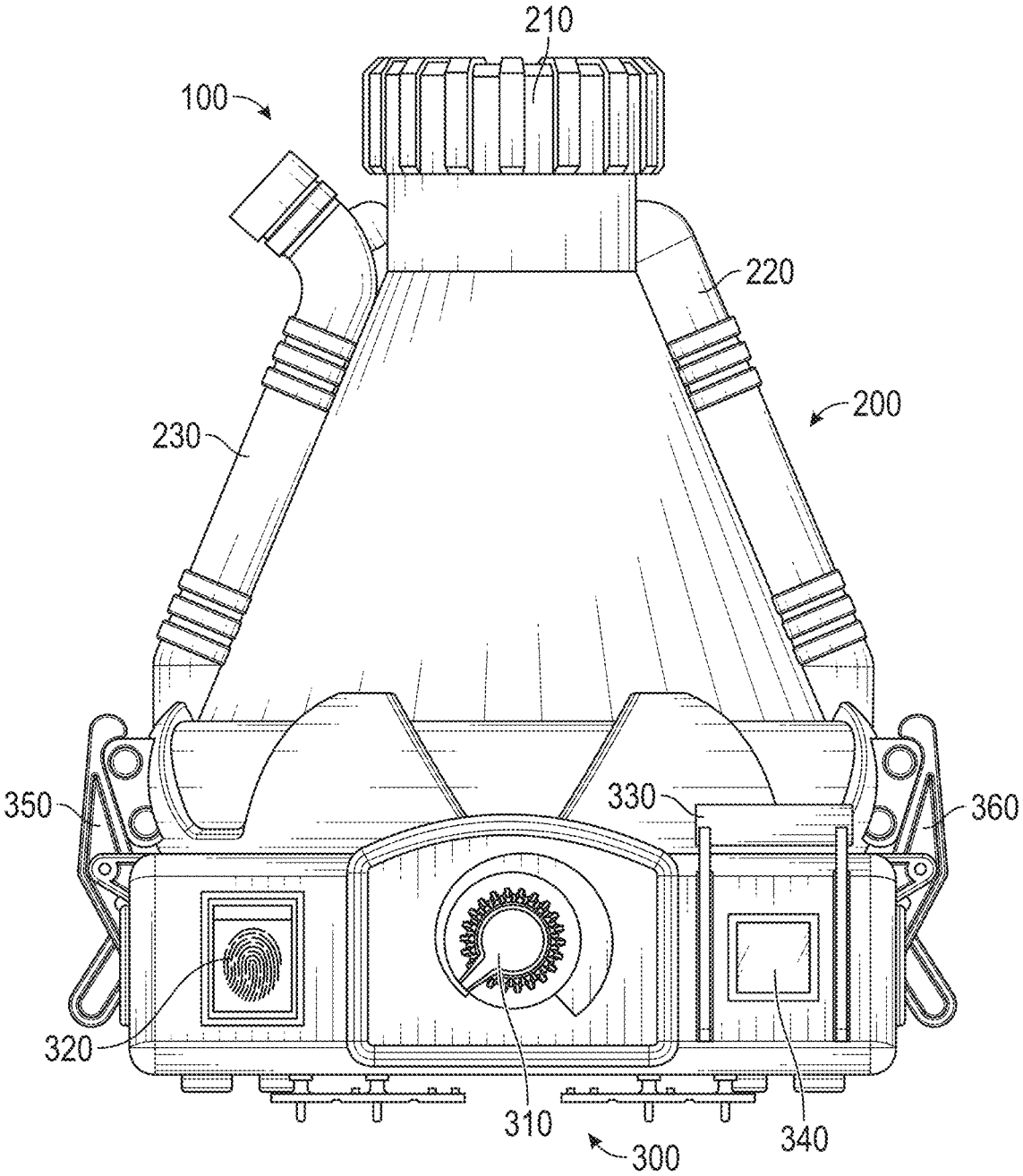
FIG. 2 is a front view of the toy system of FIG. 1.
Figure 3:
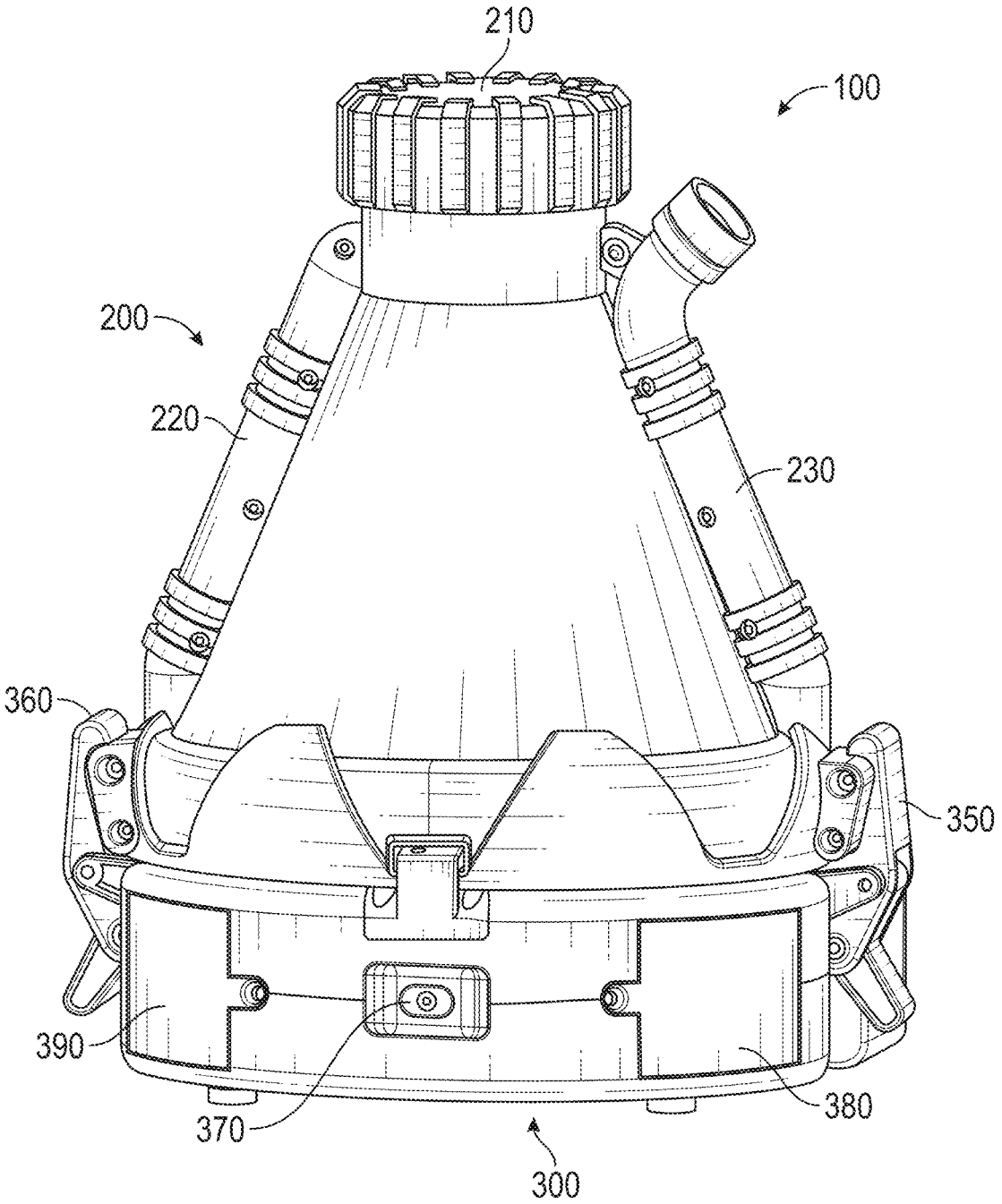
FIG. 3 is a back view of the toy system of FIG. 1.

FIGS. 2 and 3 show front and back views of the toy system 100, including features of the base 300. As can be seen from FIG. 2, the front view of an embodiment of the toy system 100 of FIG. 1, the base 300 can comprise a control knob 310, a fingerprint reader 320, a release handle 330, and/or a warning light 340. In FIG. 3, a rear view of an embodiment of the toy system 100, the base 300 can comprise an on/off switch 370, a first battery chamber 380 and/or a second battery chamber 390.

In some embodiments, the toy system 100 comprises a first latch 350 and a second latch 360 each attached to a side of the base 300. When engaged, the latches 350, 360 clamp the flask 200 tightly onto the base 300. The features in the front side of the base 300, including the control knob 310, the fingerprint reader 320, and the release handle 330 can be manipulated by the user when playing with the toy system 100. These features are further described below. In alternative embodiments, features on the base 300 can take different arrangements. For example, one embodiment may not include the fingerprint reader 320. Another embodiment may have a push button in place of the release handle 330 but perform the same function.

Figure 4:
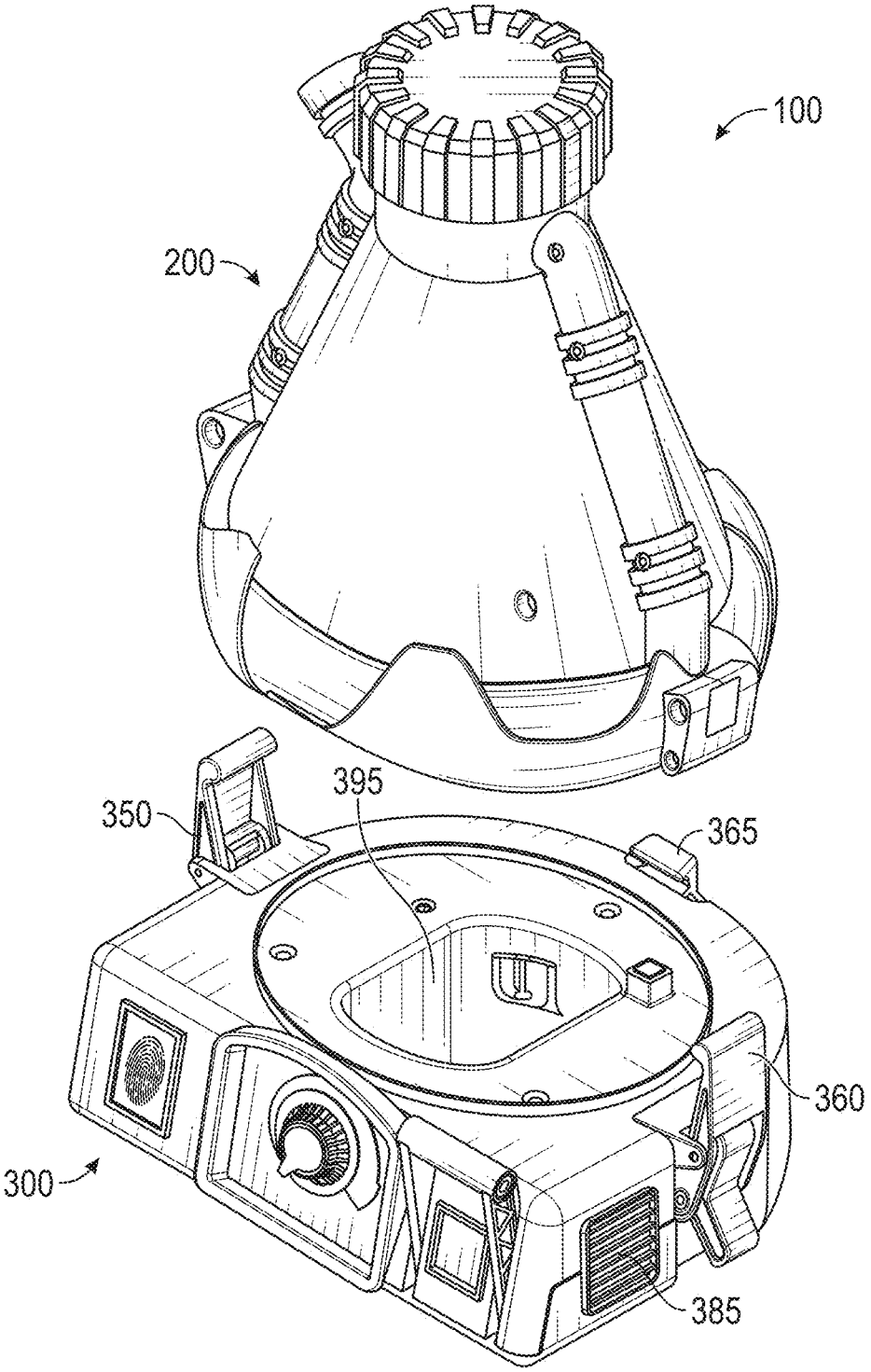
FIG. 4 is a perspective view of the toy system with a flask and a base separated.

Referring to FIG. 4, the flask 200 and the base 300 are shown separated. The separation is accomplished by releasing the first latch 350 and the second latch 360. To assembly the flask 200 to the base 300, the user first engages the rear edge of the flask 200 with a hook 365 on the base 300, and then pulls down the latches 350, 360 which create clamping forces to bring the flask 200 and the base 300 closely together. As shown in FIG. 4, in a top surface of the base 300 there is a concave cavity 395. This cavity 395 is formed to house the object or figurine mentioned previously. FIG. 4 further illustrates a speaker grill 345, which will be further described below.

Figure 5:
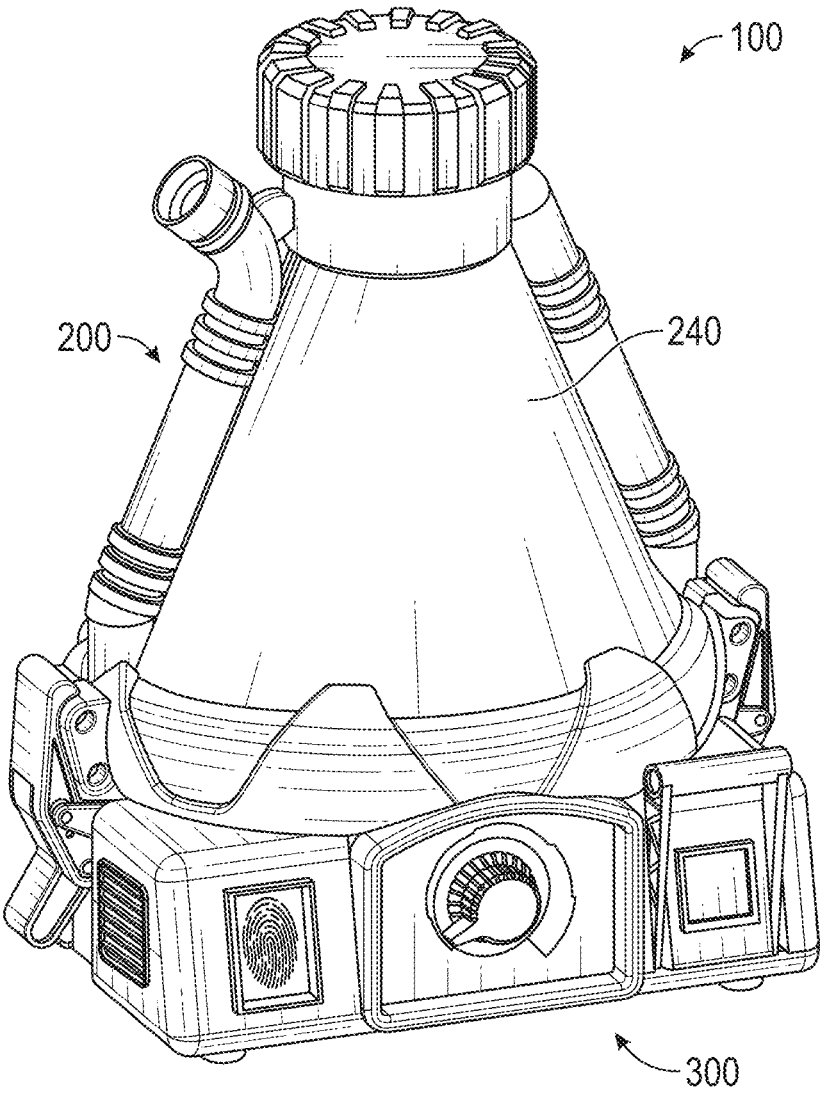
FIG. 5 is a perspective view of the toy system of FIG. 1 showing its factory state when the flask is filled with an opaque fluid.

FIG. 5 depicts the toy system 100 at the factory state or open box state. This state gives the user an impression that the flask 200 is filled with an opaque fluid 240. As such the user cannot see the contents inside the flask 200.

Figure 6:
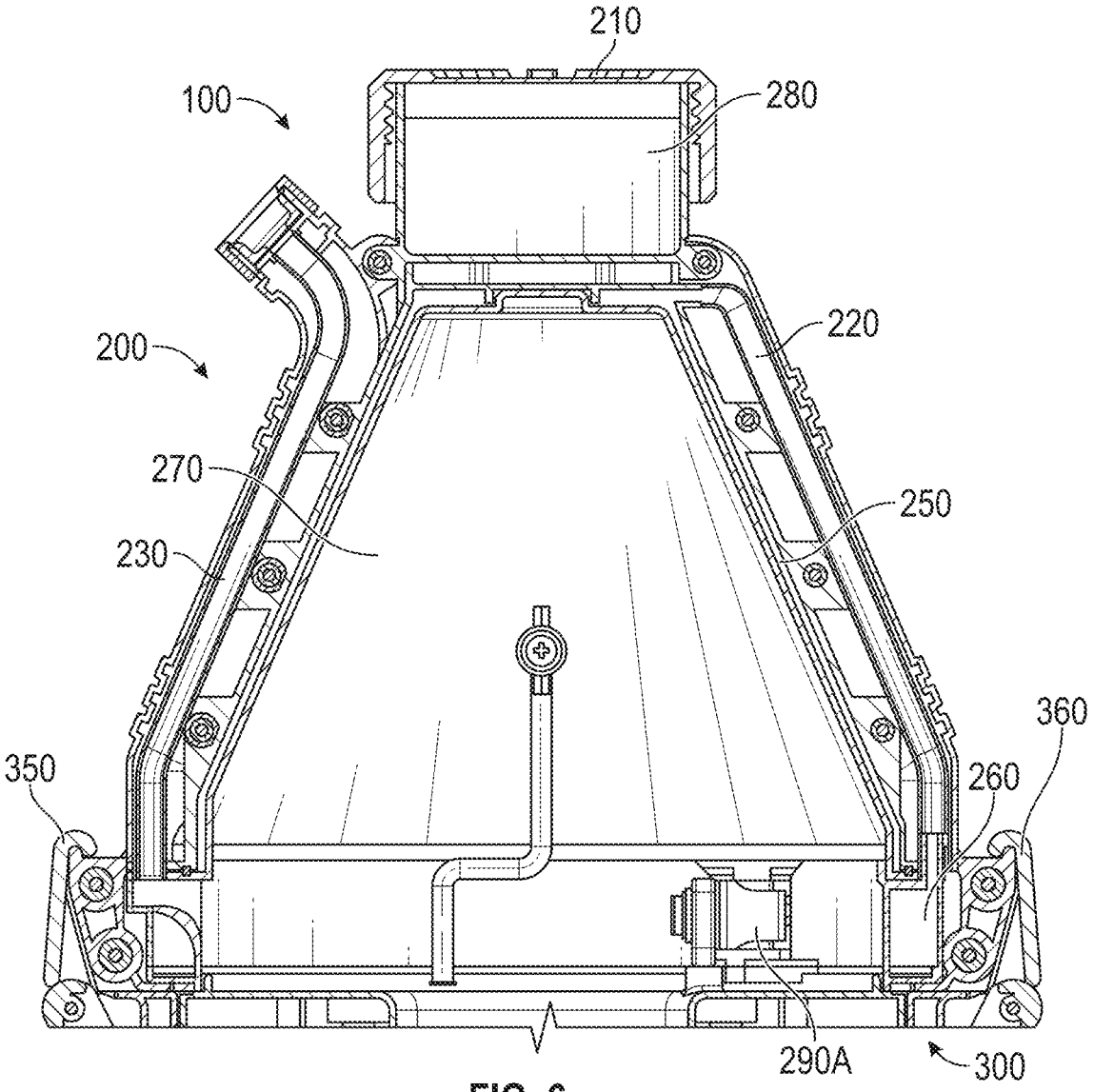
FIG. 6 is a cross-sectional view of the toy system of FIG. 1 with part of the bottom of the base cut off.

The wall structure of the flask 200 is shown in FIG. 6, a cross-sectional view of the toy system 100 with the bottom portion of the base 300 truncated. As shown in FIG. 6, the truncated cone portion of the flask 200 can comprise a double wall structure, creating an internal space 250 between the double walls. When the toy system 100 is assembled, the space 250 is filled with the opaque fluid 240 for the purpose of blocking or obfuscating the user's view inside the flask 200 of the toy system 100.

In certain embodiments, visual and/or acoustic sound effects are provided by the toy system 100 in combination with the blocking or obfuscating of the view inside the flask 200 to further stimulate the user's imagination as to what is occurring inside the flask 200 during play.

As shown in FIG. 6, below the space 250 is a lower tank 260, which forms part of the lower portion of the flask 200. In certain embodiments, the lower tank 260 is fluidically connected to the space 250 by a valve 290A and the internal tube 220. In certain embodiments, the internal tube 220 connects the lower tank 260 to the top of the space 250, so when in a normal upright position air can flow from the lower tank 260 up to the space 250. This arrangement prevents fluid in the space 250 from flowing in the internal tube 220 down to the lower tank 260 due to air staying on top of the fluid. At the factory state, the valve 290A is closed to keep the opaque fluid 240 inside the space 250.

In some embodiments, the double wall structure of the flask 200 as shown in FIG. 6 is relatively thin and is substantially uniform. An internal space 270 is thus formed inside the flask 200. For embodiments of the flask 200 that have a dome shape or pillar shape lower portion, the internal space 270 can be larger than what is illustrated in FIG. 6. In either embodiments, a figurine 400 can be removably placed in the internal space 270 and reside at least partially in the cavity 395 in the base 300 shown in FIG. 4.

Referring to FIG. 6, in some embodiments, above the truncated cone shaped portion of the flask 200 is a chamber 280. In some embodiments, the chamber 280 is fluidically separated from the space 250 and the internal space 270 below. At the factory state, the chamber 280 is filled with a second opaque fluid that looks similar to the opaque fluid 240 filled in the space 250. The mouth of the chamber 280 is sealed, e.g., by an aluminum foil, at the factory for shipping, and the seal may need to be peeled off before the first play. When looking into the second opaque fluid in the chamber and the same opaque color of the fluid filled in the space 250 between the double walls of the flask 200, the user is given an impression that the entire flask 200 is filled with the opaque fluid, even though the fluid in the chamber 280 and the liquid in the space 250 may not be fluidically connected. Subsequently after each play, the chamber 280 can be filled with the same opaque fluid or simply with water.

Figure 7:
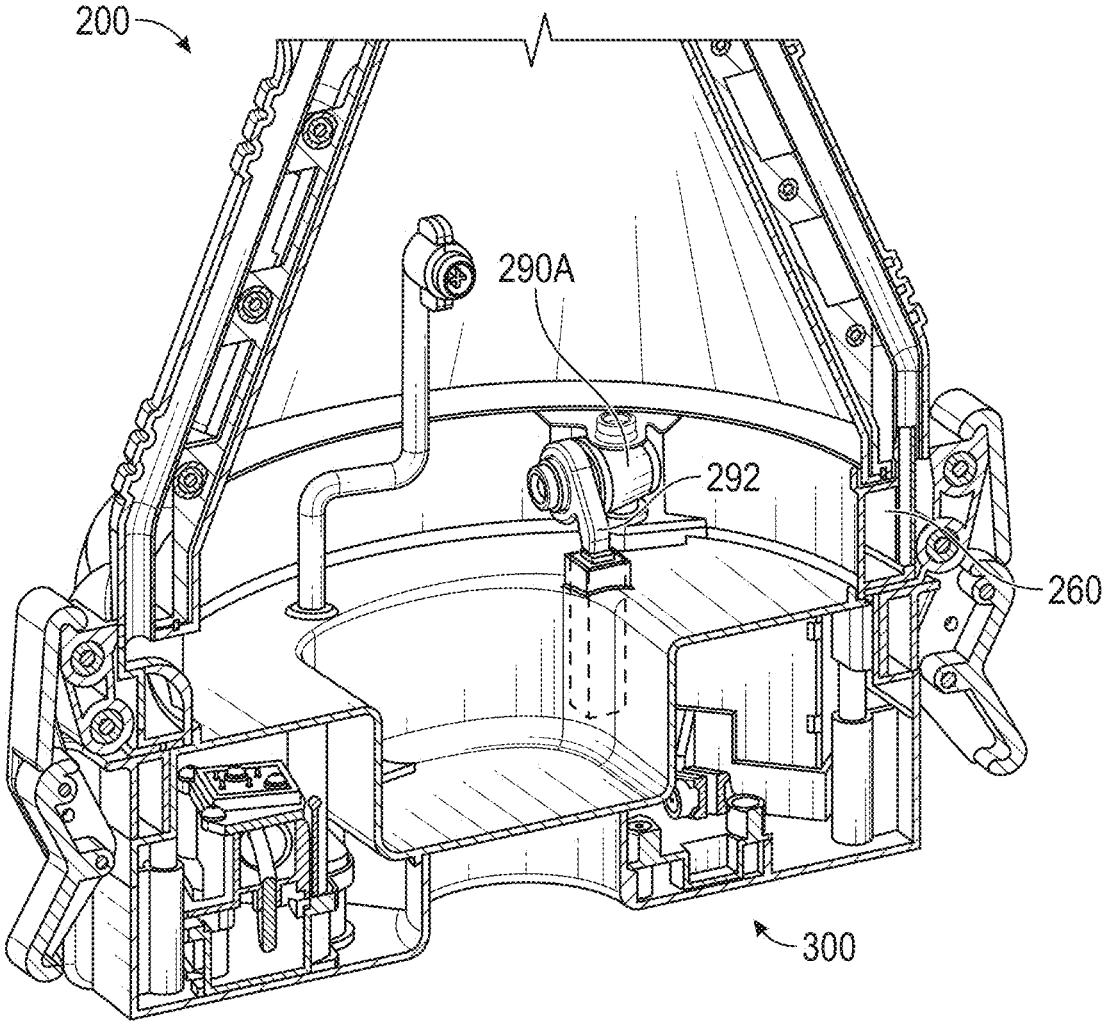
FIG. 7 is a partial cross-sectional view of the toy system of FIG. 1 showing internal structures.
Figure 8:
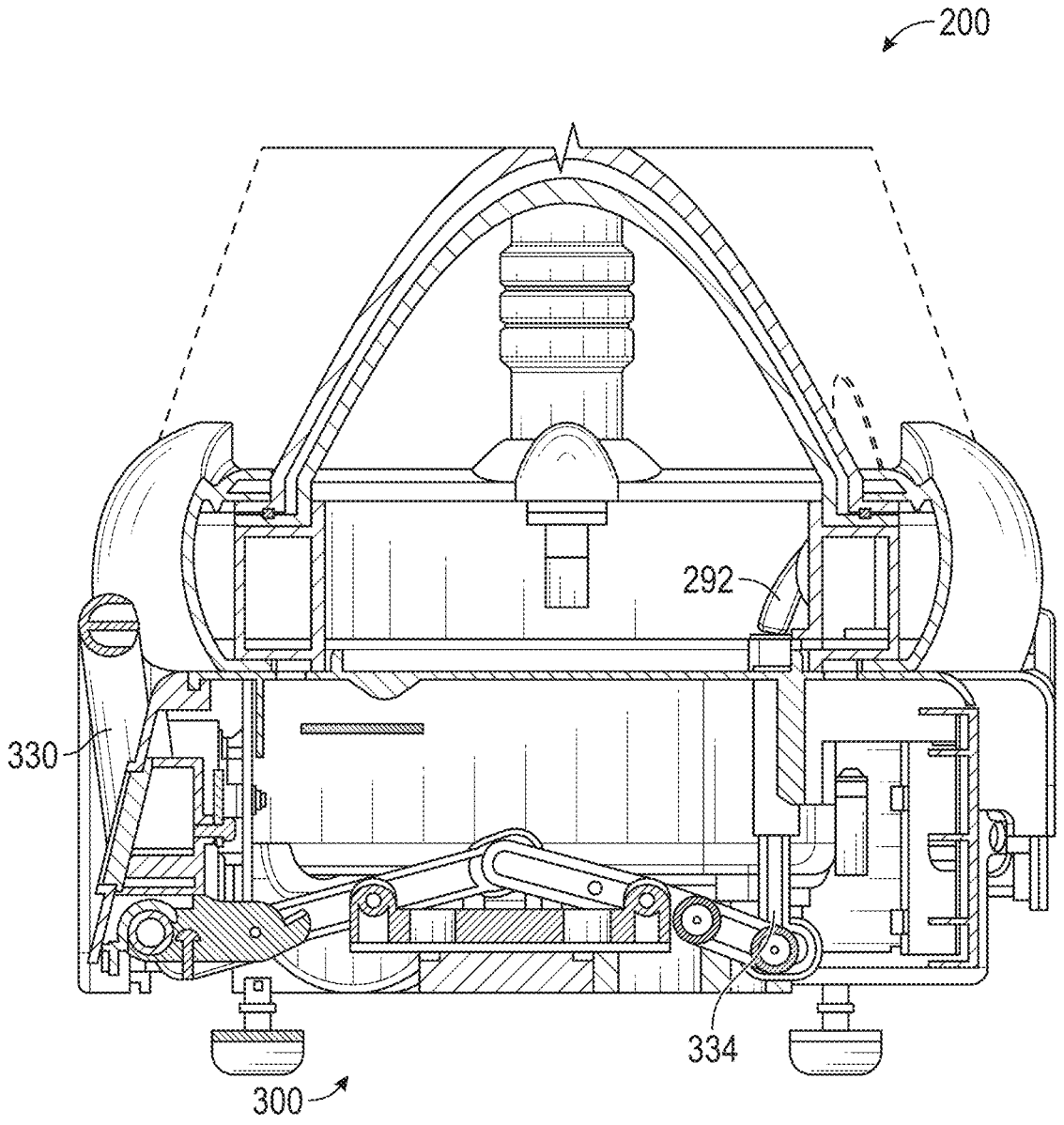
FIG. 8 is another partial cross-sectional view of the toy system of FIG. 1 showing internal structures.
Figure 9:
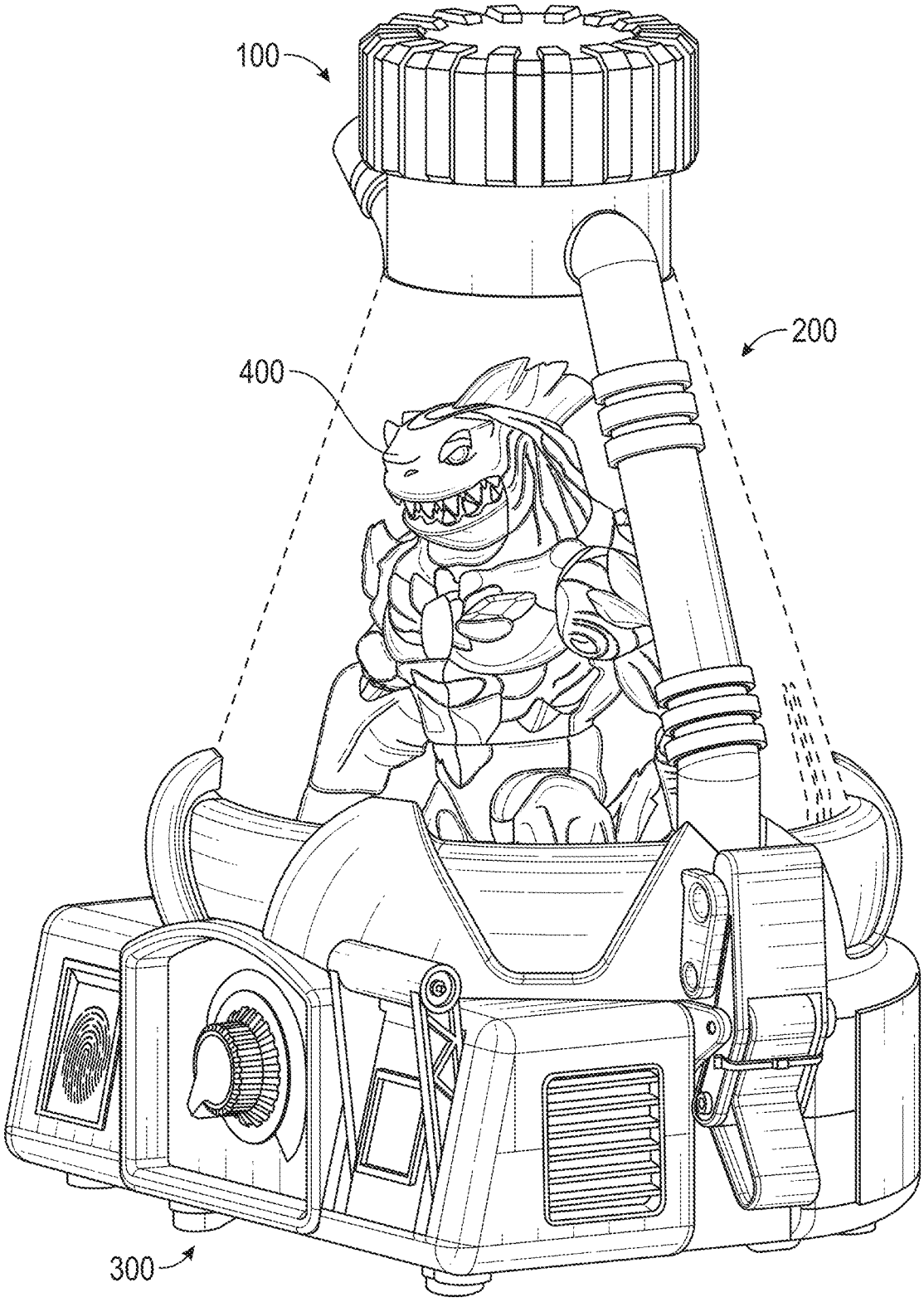
FIG. 9 is a perspective view of the toy system of FIG. 1 after the fluid in the flask is drained to reveal a figurine inside the flask.

FIG. 7 is a partial cross-sectional view of the toy system 100 showing certain internal structures. FIG. 8 is another partial cross-sectional view of the toy system 100 showing certain other internal structures. The operation to open the valve 290A is shown in FIG. 8. In certain embodiments, the release handle 330 attached on the base 300 is connected to a series of rocker arms and pivots to a vertical slider 334, which is in contact with a valve arm 292 that operates the valve 290A. In certain embodiments, toward the end of play when the release handle 330 is pulled down, the action causes the intermittent rocker arm and pivot structure to swing, pushing the vertical slider 334 to move upward. This movement exerts a force on the valve arm 292, causing the valve 290A to open. As such the opaque fluid 240 in the space 250 drains down by gravity into the lower tank 260. Since the lower tank 260 is substantially wider than the space 250, its volume is adequate to hold all of the opaque fluid 240 originally filling the space 250, although the height of the lower tank 260 may be much shorter than the height of the space 250. Meanwhile, the internal tube 220 allows air to flow up from the lower tank 260 and into the emptied portion of the space 250. In certain embodiments, the double wall structure of the flask 200 is made of a transparent material, e.g., transparent plastic. Therefore, when all of the opaque fluid 240 is drained to the lower tank 260, the space 250 is emptied and the figurine 400 in the internal space 270 is revealed to the user, as shown in FIG. 9.

Figure 10A:
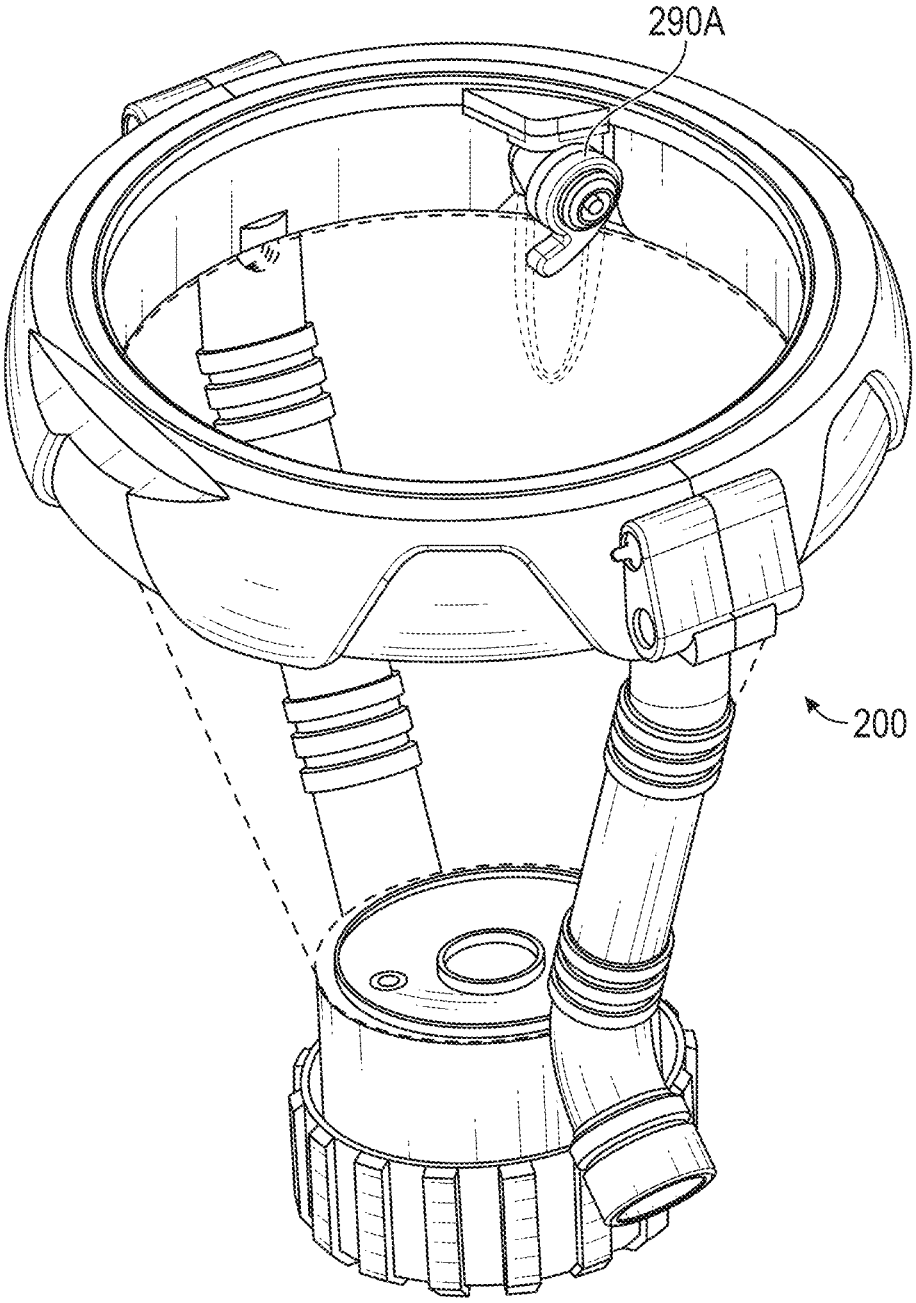
FIG. 10A is a perspective view of the flask shown in FIG. 4 when it is turned upside down to flow the internal fluid back into a space formed between the double walls.
Figure 10B:
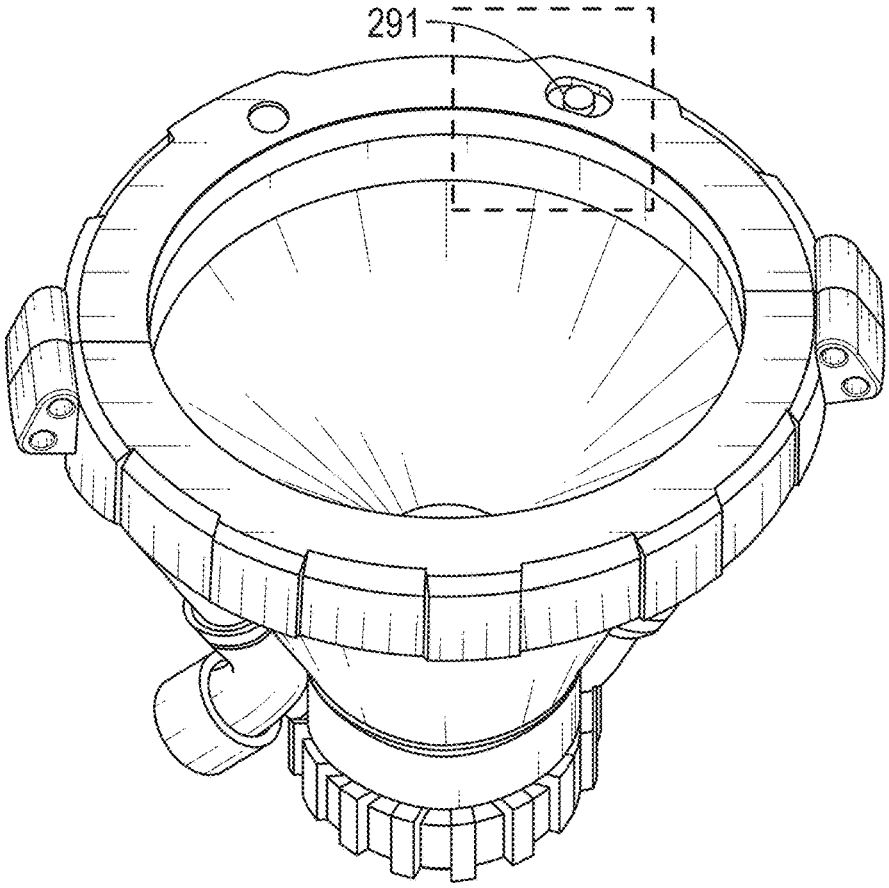
FIG. 10B a perspective views of another embodiment of a flask when turned upside down to flow the internal fluid back into a space formed between the double walls.
Figure 10C:
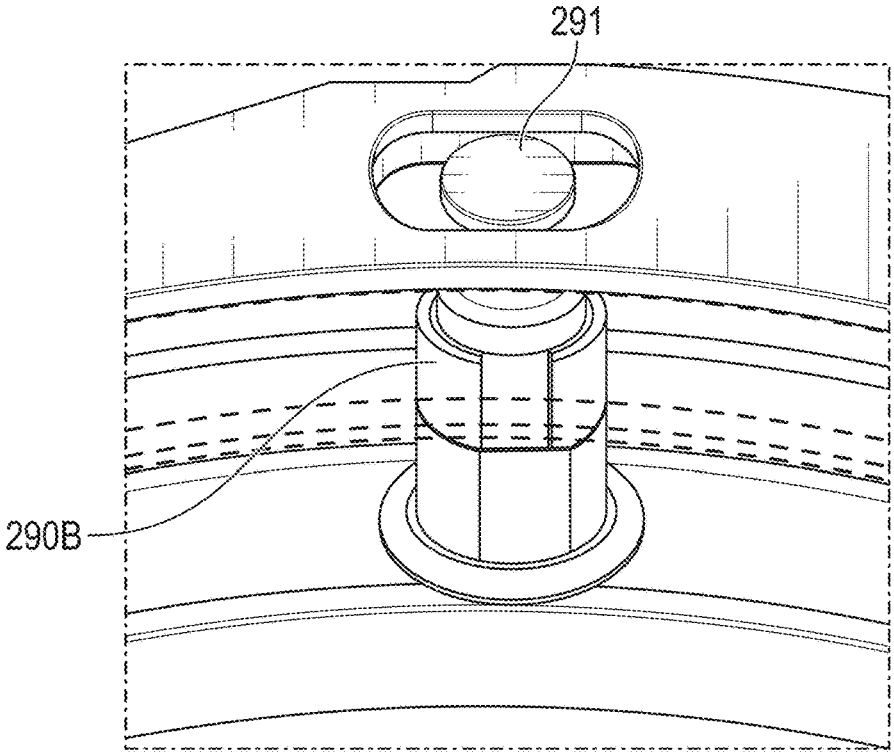
FIG. 10C is a partial perspective and transparent view of the flask of FIG. 10B showing details of a fluid valve.

When a play is finished, there is need to reset the toy system 100 to return it to the pre-play state that is similar to the factory state. As such, the toy system 100 can be played over and over. This can be accomplished by flowing the opaque fluid 240 in the lower tank 260 back from the lower tank 260 and into the space 250. Embodiments of the reset process are shown in FIGS. 10A-10C and can include turning the flask 200 upside down. In some embodiments, a valve 290B includes a push button actuator 291, as shown in FIGS. 10B-10C, comparing to the swing arm actuator of the valve 290A shown in FIGS. 6-7. In some embodiments, the valve 290A, 290B may be biased (e.g., by a spring) to a closed position. For example, the user can push and hold down the button of the valve 290B in FIG. 10B to maintain the valve 290B in the open position to allow the fluid to flow to the space 250. In some embodiments, the valve 290A, 290B may be not biased and stays in the open position once opened by the user, for example, the valve 290A in FIG. 10A. Gravity causes the opaque liquid 240 in the lower tank 260 to flow down through the internal tube 220 shown in FIG. 6 and fill up the space 250. During the process, air above the liquid vents through the valve 290A, 290B to the lower tank 260. In some embodiments, at the end of the reset process the valve 290A, 290 needs to be manually turned to the closed position to stop the fluid communication between the space 250 and the tank 260 when the flask 200 is turned upright again, if the valve 290A, 290B is not normally biased to the closed position. In other embodiments, manual turning of valve 290A, 290B may not be required. For example, at the end of the reset process, the valve 290B automatically springs back to the closed position once the user releases the button which stops the fluid communication between the space 250 and the tank 260 when the flask 200 is turned upright again. In another embodiment, gravity closes the valve when the flask 200 is turned upside down.

Figure 11:
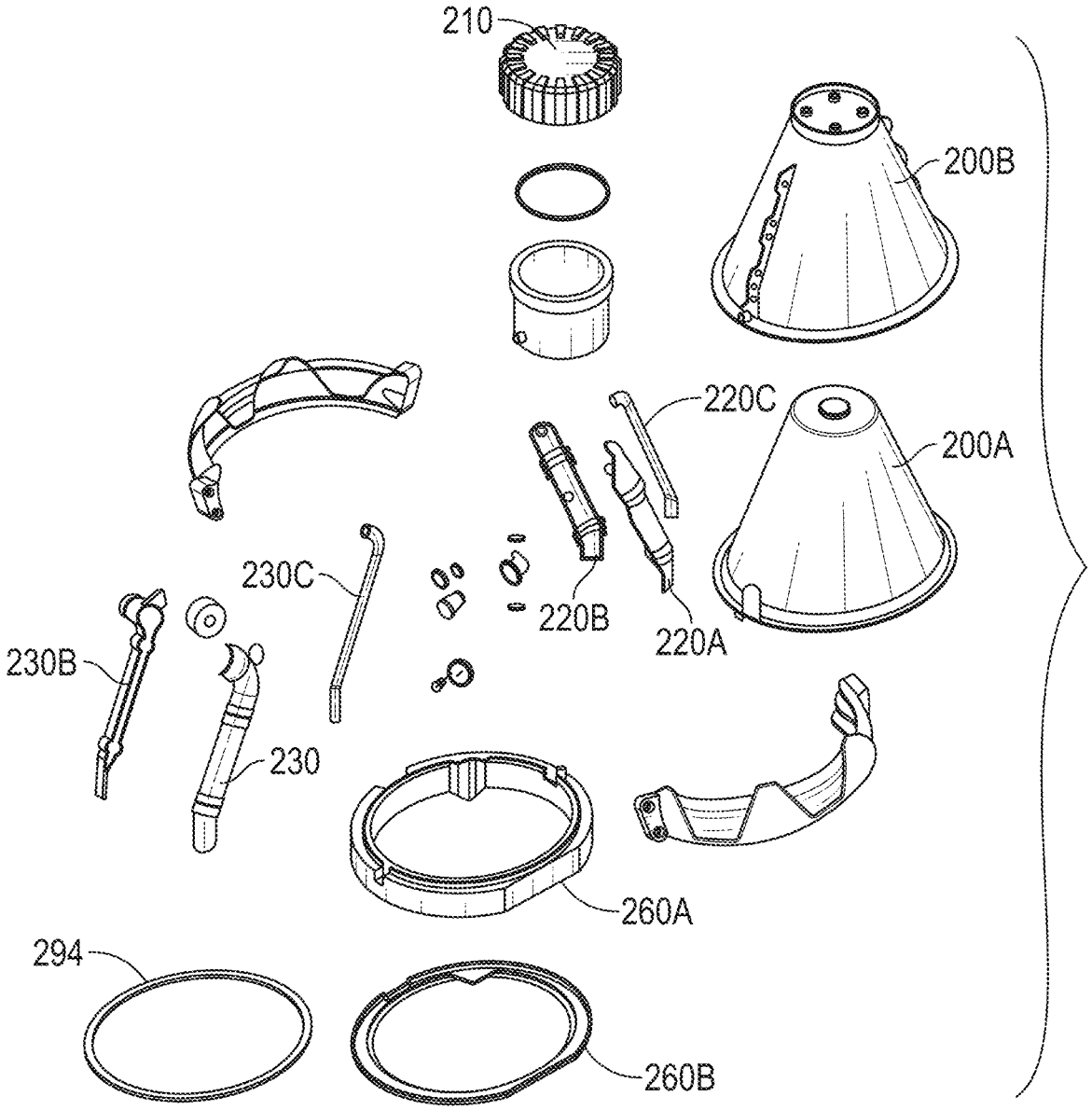
FIG. 11 is an exploded view of the flask of FIG. 10A revealing components.

FIG. 11 is an exploded view of the base 300 showing certain parts of the flask 200. In some embodiments, the double walled flask body 200 is made of a flask inner 200A, and a flask outer 200B. In some embodiments, the internal tube 220 comprises an air tube front 220A, an air tube rear 220B, and an air hose 220C. In some embodiments, the smoke tube 230 comprises a smoke tube front 230A, a smoke tube rear 230B, and a smoke hose 230C. In some embodiments, the lower tank 260 comprises a tank upper, and a tank lower. In some embodiments, parts for the assemblies mentioned above may be made of injection molded plastics or protruded plastics. These assemblies, including the flask body 200, the internal tube 220, the smoke tube 230, and the lower tank 260, are configured to hold liquid or air without leaking. Therefore, special processing, such as ultrasonic welding, vibration welding, or adhesion by adhesive, is performed in certain embodiments to assemble the parts. In some embodiments, a foam seal 294 as shown in FIG. 11 creates a tight seal (e.g., hermetic seal) between the flask 200 and the base 300 when the two are engaged by the latches 350, 360.

Figure 12A:
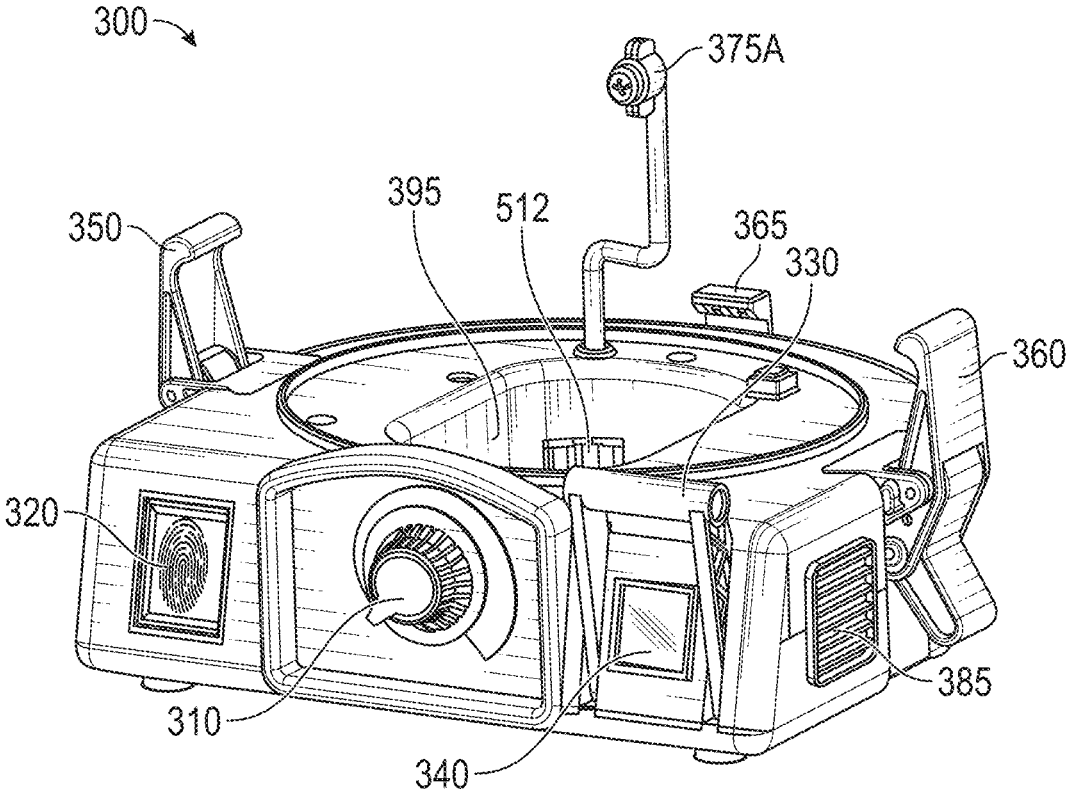
FIGS. 12A-12C are perspective views of embodiments of the base shown in FIG. 4 revealing features, including an umbilical cord.
Figure 12B:
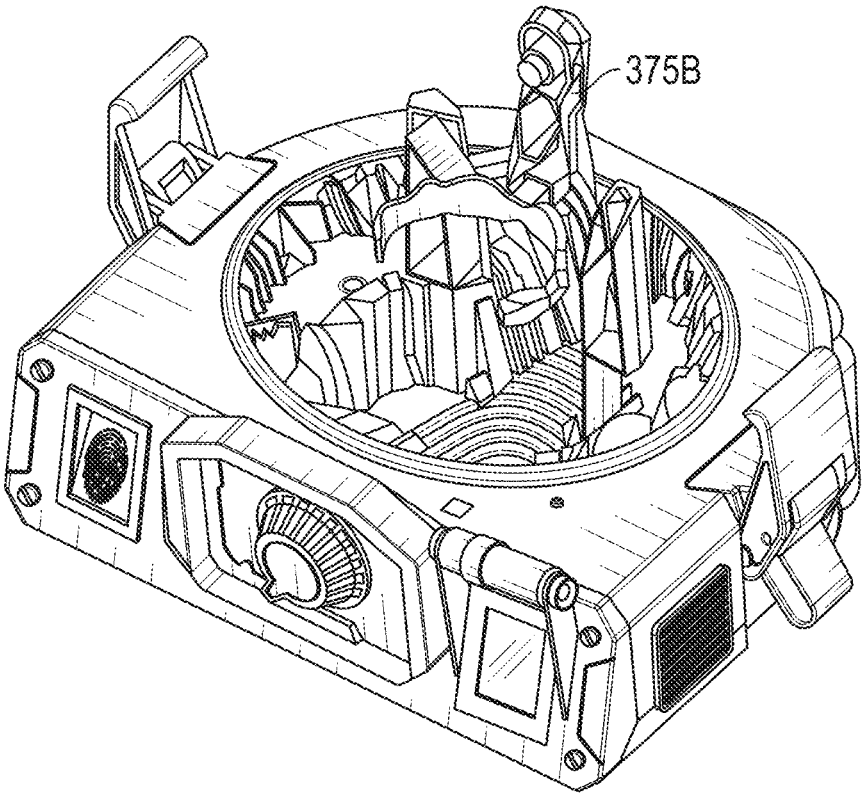
Figure 12C:
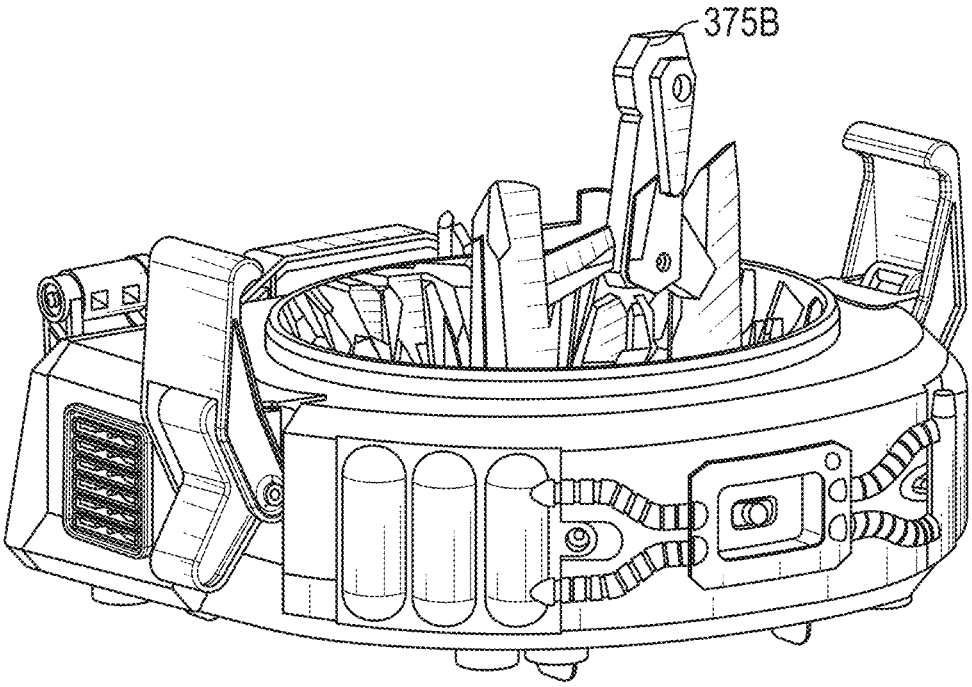

A perspective view of the base 300 is presented in FIG. 12A. An umbilical cord 375A is shown rising from the edge of the cavity 395. A smoke generator 510 is embedded in the cavity 395. Both of these features will be discussed below. In the embodiment illustrated in FIG. 12A, a tip of the umbilical cord 375A is mounted to a soft hose. FIGS. 12B and 12C show another embodiment of an umbilical cord 375B, where a tip of the umbilical cord 375B is mounted on a rigid frame that helps to mount the figurine 400.

Figure 13:
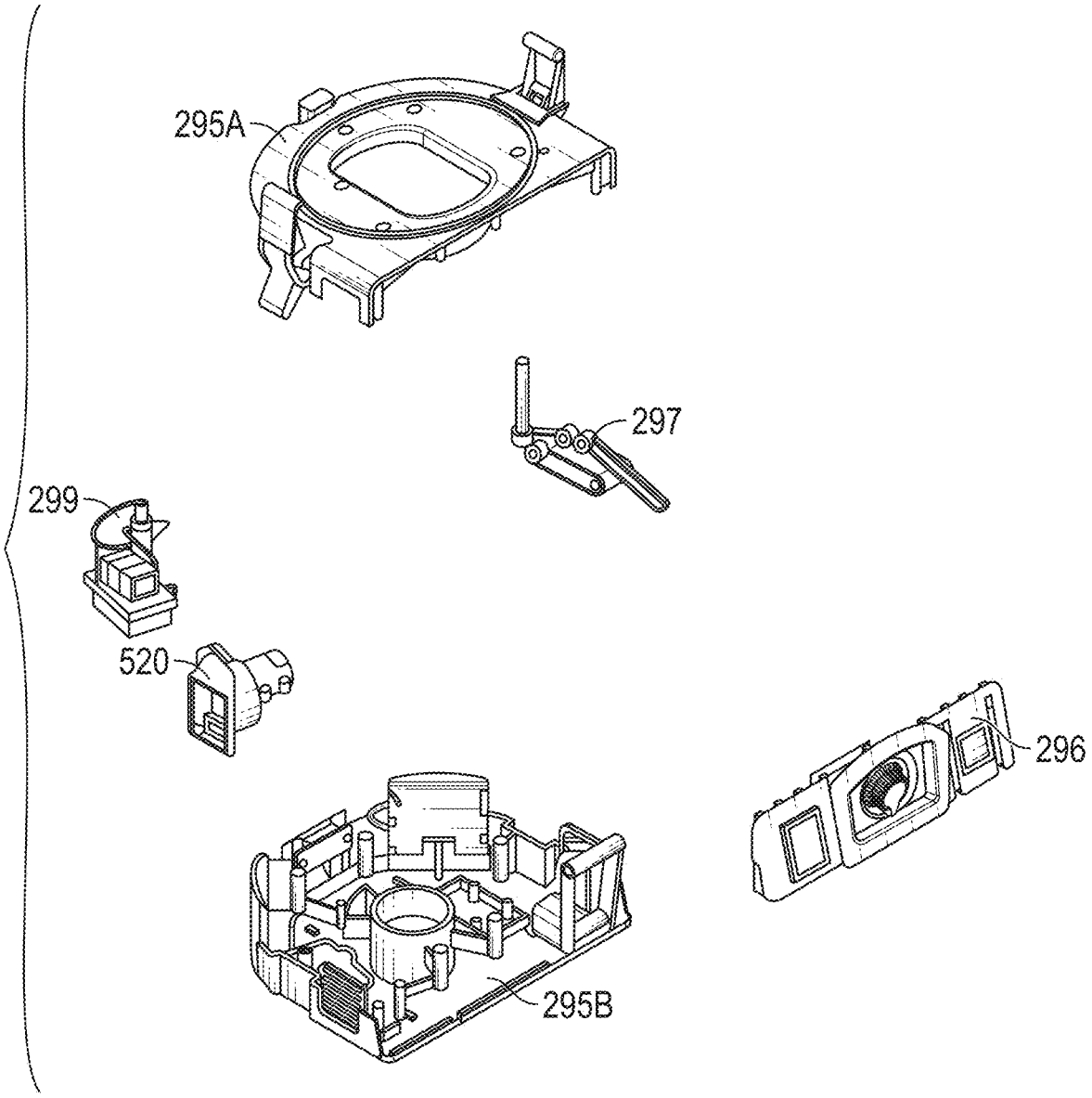
FIG. 13 is an exploded view of the base shown in FIG. 4 showing the subassemblies.

FIG. 13 is an exploded view of the base 300 showing subassemblies, including an upper base assembly 295A, a lower base assembly 295B, a base front assembly 296, a valve lift assembly 297, a fan assembly 520, and a smoke generator assembly 299. The valve lift assembly 297 was previously described in connection with FIG. 8. The smoke generator assembly 299 and the fan assembly 520 are part of the smoke generation subsystem and are further described below.

Figure 14A:
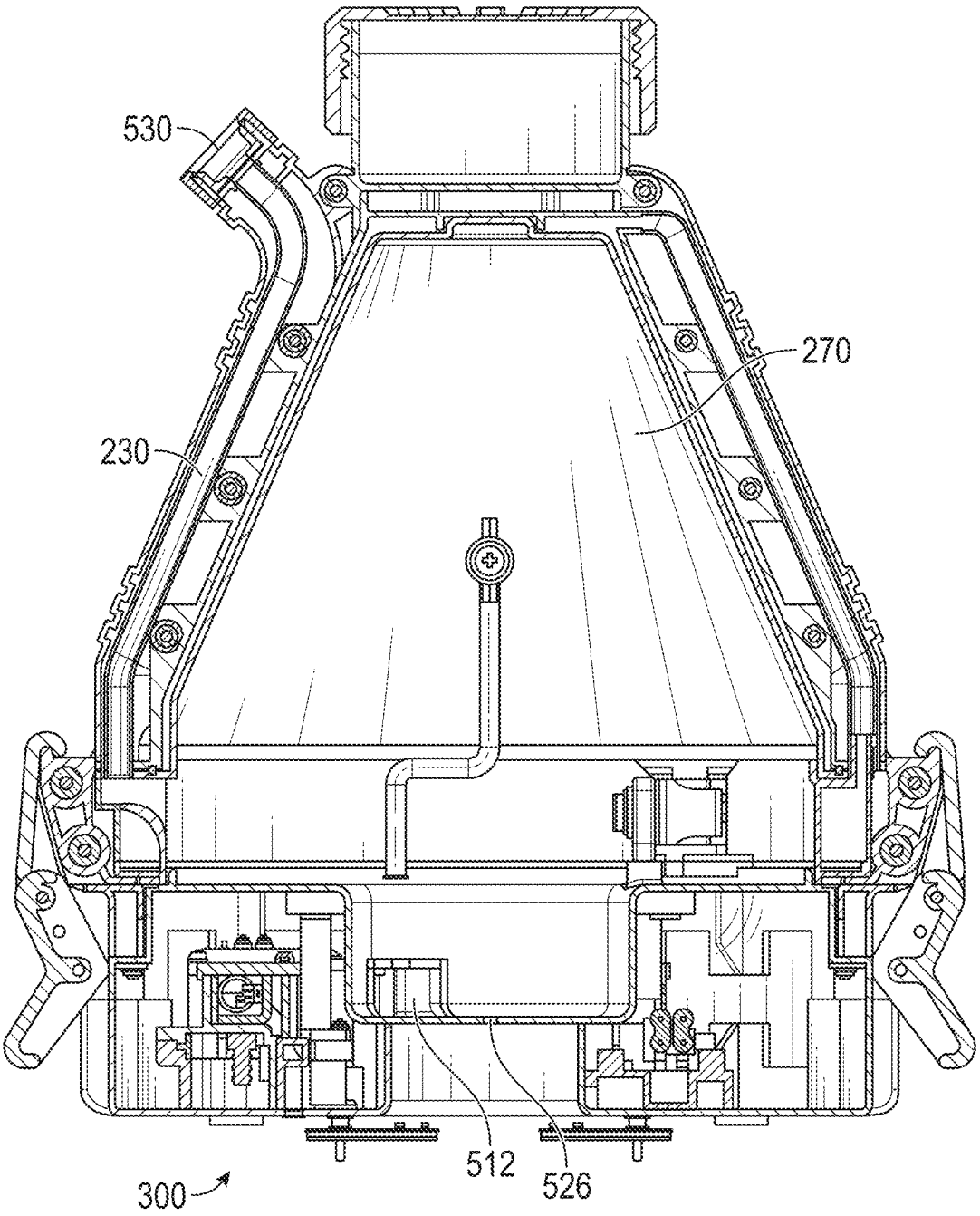
FIGS. 14A-14C illustrate views of a smoke generation system.
Figure 14B:
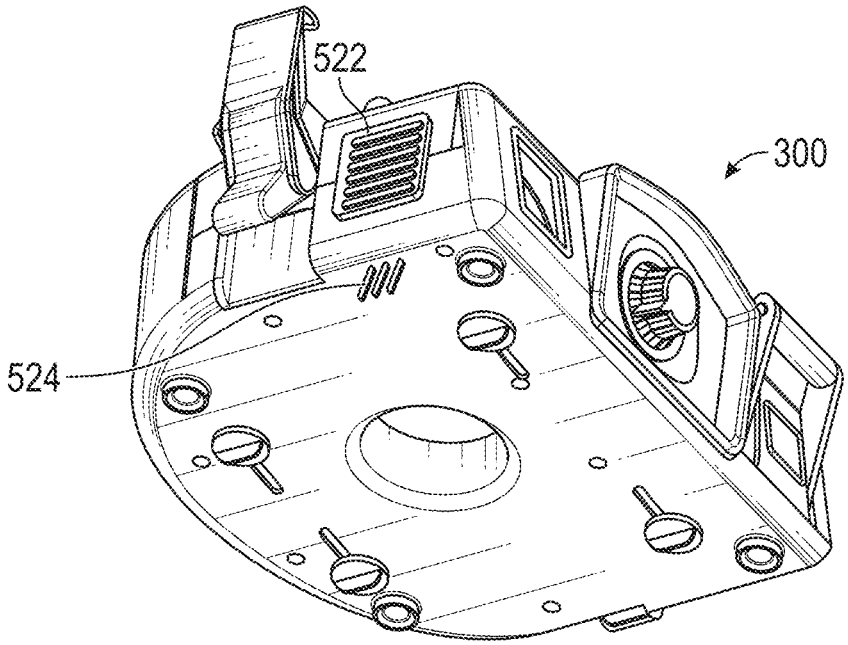
Figure 14C:
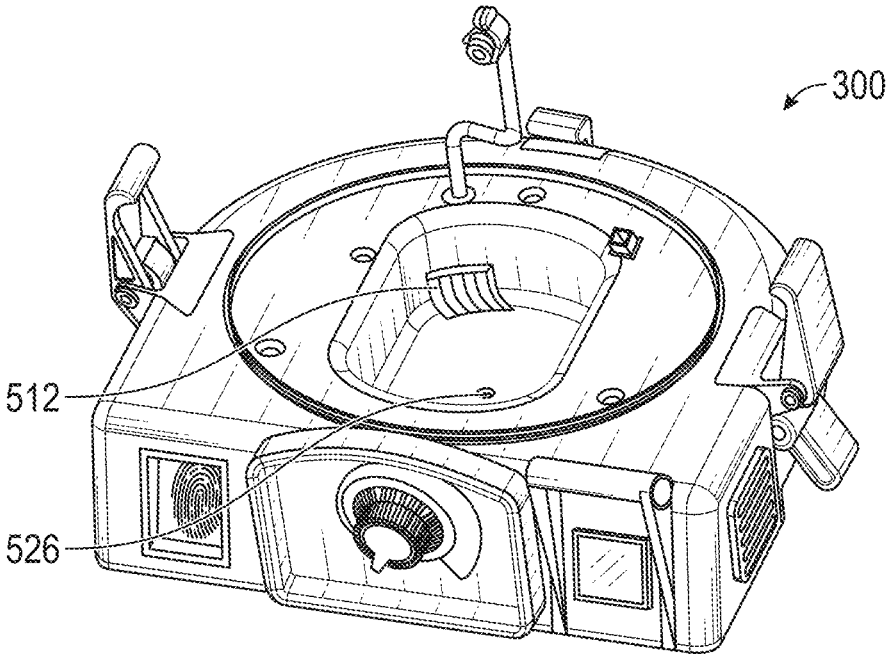

FIGS. 14A-14C illustrate the smoke generation subsystem. FIG. 14A is a cross-sectional view of the toy system 100 viewed from the front side revealing the internal structures of the apparatus. FIGS. 14B-14C are two perspective views of the base 300 viewed from different angles. During a play in certain embodiments, smoke is generated by a smoke generator 510 (FIGS. 15A-15B) located inside the base 300 and is emitted through a smoke generator outlet 512 into the internal space 270 formed between the flask 200 and the base 300. Meanwhile, in certain embodiments, the fan assembly 520 (FIG. 15B) residing inside the base 300 draws air from a fan inlet 522 and/or a secondary fan inlet 524 and blows the air into the internal space 270. The smoke from the smoke generator 510 and the air from the fan assembly 520 are mixed in the internal space 270. In some embodiments, the pressure from the fan forces the smoke and air mixture to enter the smoke tube 230 and come out of the toy system 100 from a smoke outlet 530 on the top portion of the flask 200. The secondary fan inlet 524 provides an additional flow path in case the main fan inlet 522 is blocked by the user or by an object. In certain embodiments, if a smoke outlet 530 is blocked for any reason, the smoke air mixture may exit the escape hole 526 located at the center of the cavity 395.

Figure 15A:
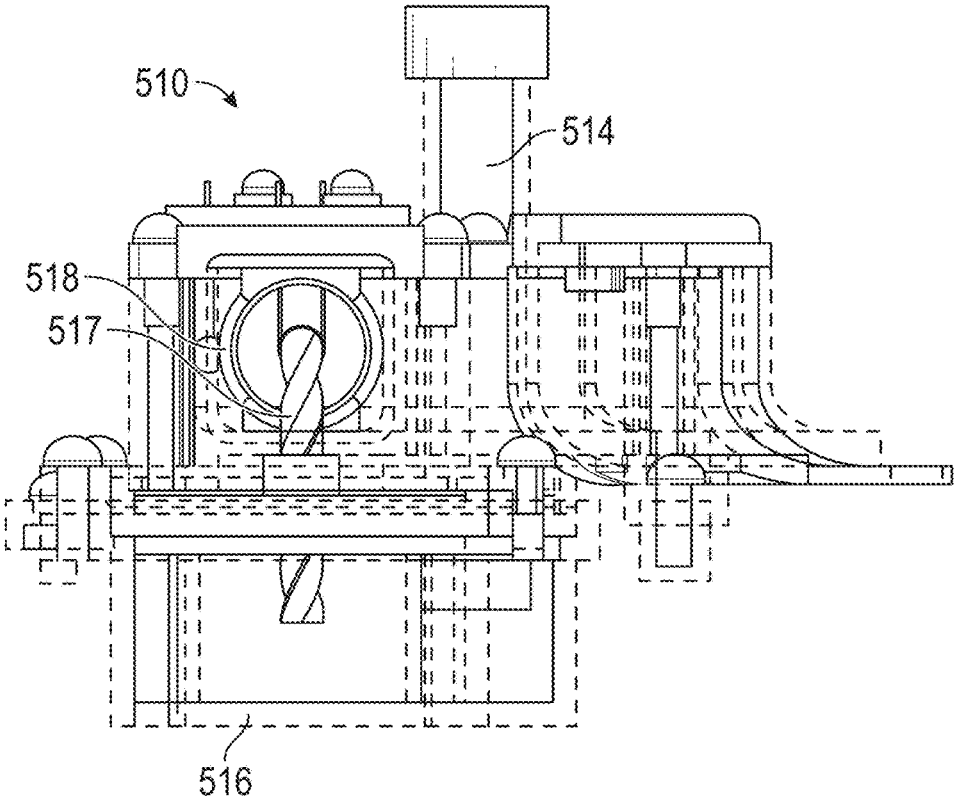
FIGS. 15A-15B illustrate a smoke generator and fan assembly of the smoke generation system shown in FIGS. 14A-14C.
Figure 15B:
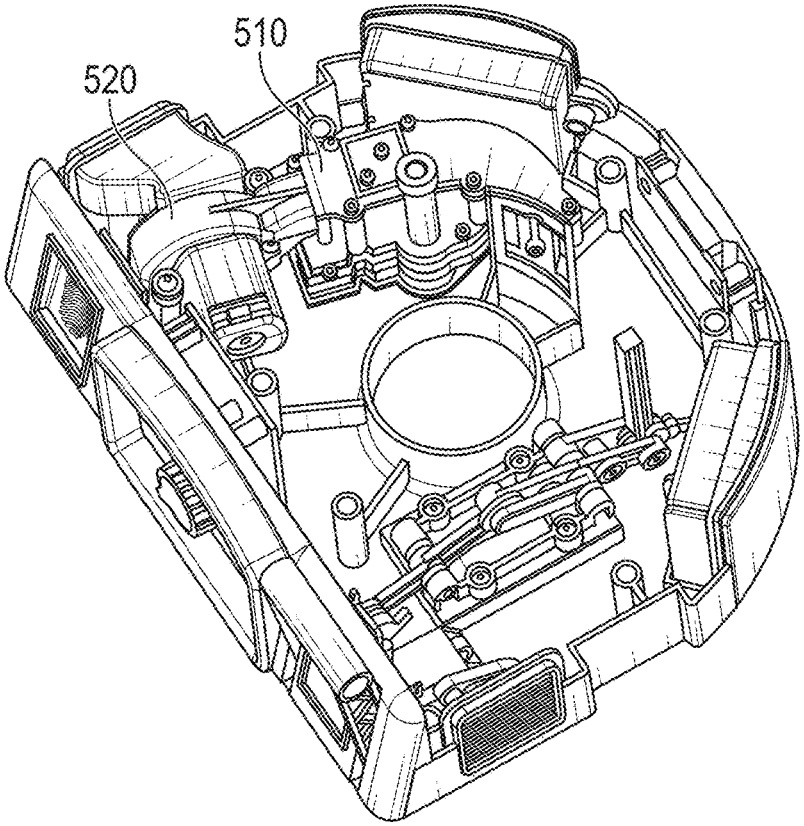

FIGS. 15A-15B illustrate the smoke generator 510 and the fan assembly 520 of the smoke generation subsystem of FIGS. 14A-14C. FIG. 15B is a view of a partially disassembled base 300 revealing the smoke generator 510 and the fan assembly 520. FIG. 15A is a partially transparent view of the smoke generator 510, illustrating certain components. In some embodiments, the smoke generator 510 comprises a tank 516 which holds a smoke generating fluid, e.g., liquid state vegetable glycerin, a heater coil 518 positioned above the tank 516, and a wick 517 that has one end immersed in the vegetable glycerin. The other end of the wick 517 can be disposed within or near the heating coil 518. A refill port 514 is fluidically connected to the tank 516 to allow the tank 516 to be filled in the factory and subsequently by the user. The smoke generating fluid can be vegetable glycerin, but other types of smoke generating fluid can be used, for example, propylene glycol. Both vegetable glycerin and propylene glycol are safe for user's playing with the toy system 100. The wick 517 is preferably made of fiber, including cellulose fiber or synthetic fiber. In some embodiments, the wick 517 is made of open pore absorptive foam, or other types of materials, as long as the material can cause adequate capillary action to draw the smoke generating fluid up a certain distance. In FIG. 15A, the vertical distance from the immersed end of the wick 517 to the other end above the tank 516 needs to be small enough to allow the capillary action to draw the smoke generating fluid to wet the whole wick 517. During a play, the coil 518 is charged to heat up the wick 517 inside or in close vicinity of the coil 518, to cause the smoke generating fluid, e.g., vegetable glycerin, to evaporate into smoke.

Figure 16:
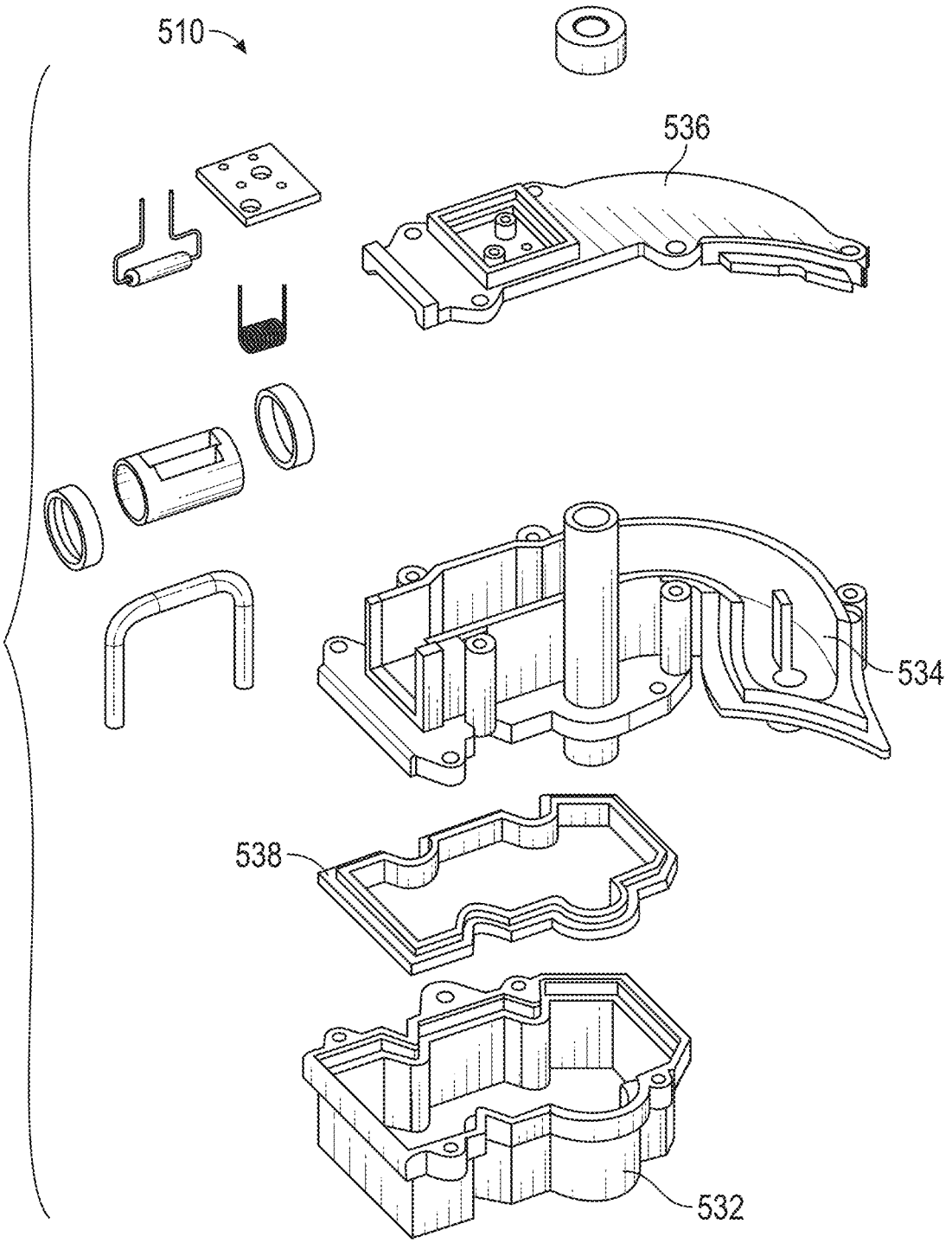
FIG. 16 is an exploded view of the smoke generator of FIG. 15A.

The components of the smoke generator 510 are shown in FIG. 16. In some embodiments, a vegetable glycerin (VG) tank 532, a smoke chamber lower 534, and a smoke chamber upper 536 of the smoke generator 510 may be made of injection molded plastics. In some embodiments, they may be formed by thin metal parts. A gasket 538, which may be made of injection molded rubber, serves to form a hermetic seal between the VG tank 532 and the smoke chamber lower 534 when they are assembled. In certain embodiments, the VG tank 532 and the smoke chamber lower 534 my be assembled by fasteners or adhesive.

Figure 17:
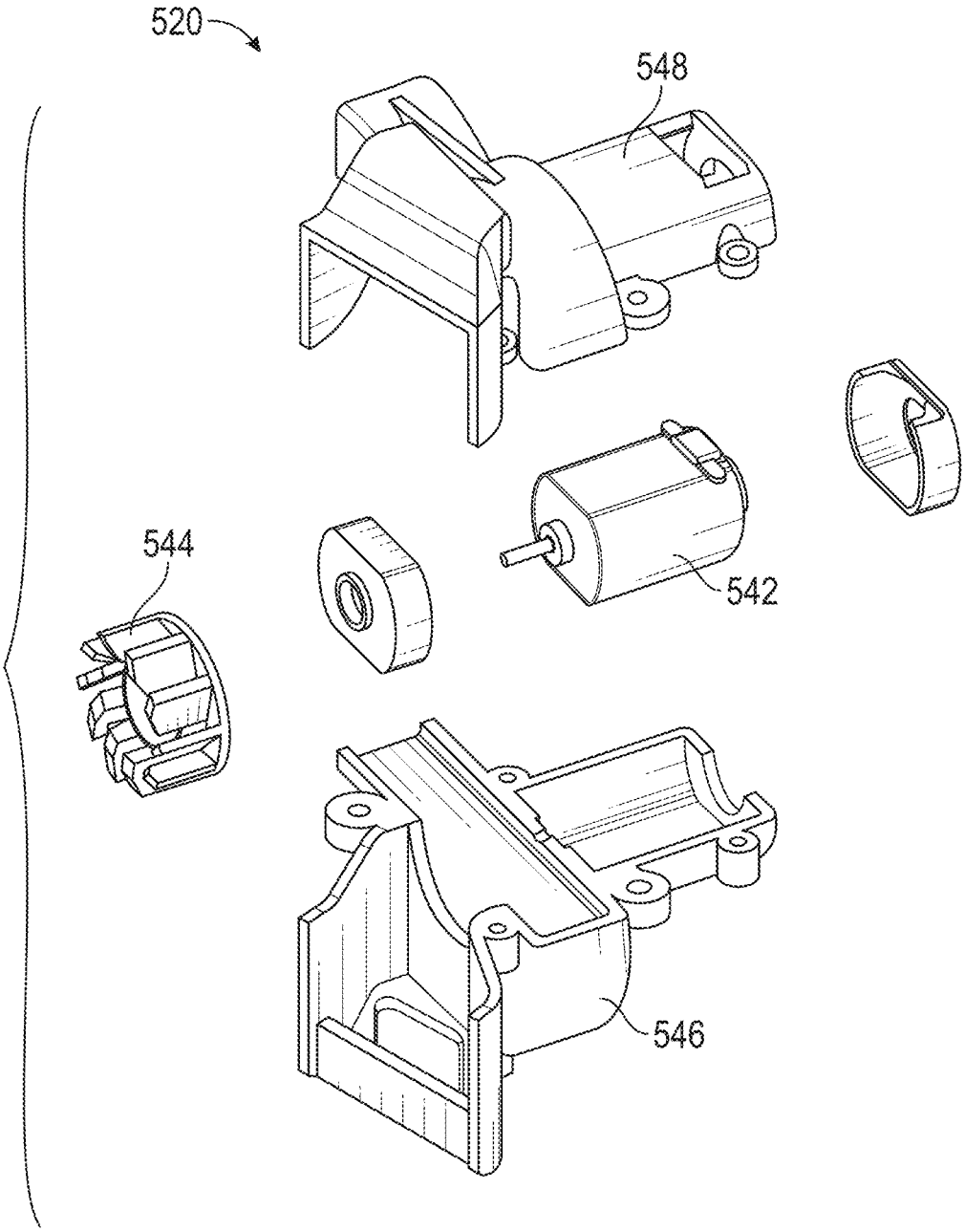
FIG. 17 is an exploded view of the fan assembly shown in FIG. 15B.

FIG. 17 is an exploded view of the fan assembly 520 to reveal certain components including a motor 542 and a fan blade 544. In some embodiments, a lower fan housing 546 and an upper fan housing 548 that are configured to encase the motor 542 can be injection molded plastics. In some embodiments, the lower fan housing 546 and the upper fan housing 548 can be aluminum or zinc made by casting or metal forming. In some embodiments, the upper fan housing 548 and the lower fan housing 546 may be assembled by fasteners, adhesive, or welding.

Figure 18:
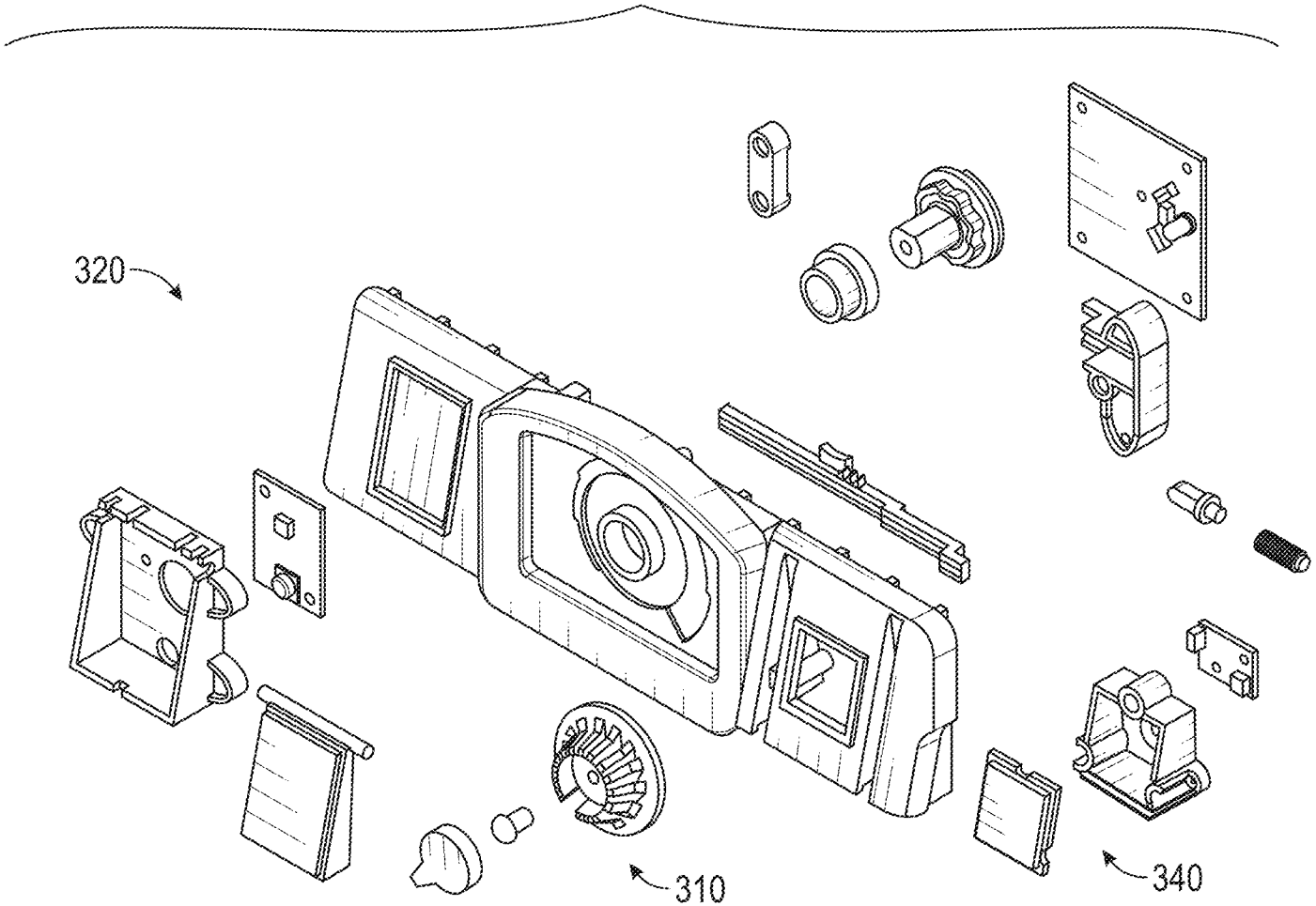
FIG. 18 is an exploded view of a front control panel of the base shown in FIG. 12A.

FIG. 18 is an exploded view of the front control panel of the base 300. The front panel features on the base 300, as shown in FIG. 2, and their functional components are shown in FIG. 18. These features, including the control knob 310, the fingerprint reader 320, the release handle 330 and the warning light 340, are described in detail below.

Figure 19A:
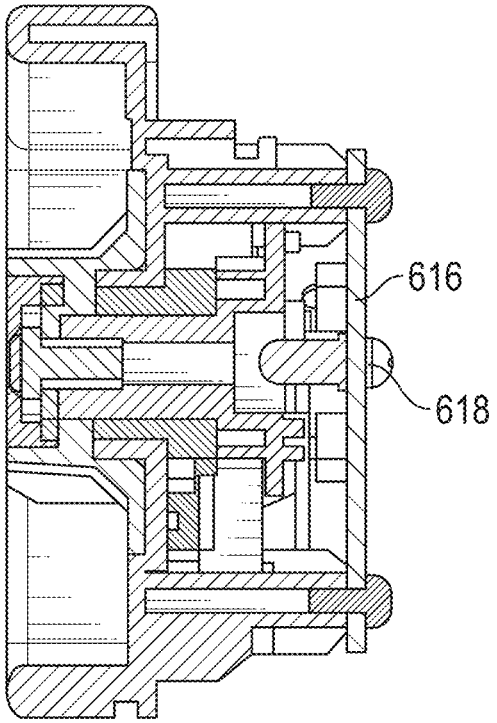
FIGS. 19A-19C illustrate views of a control knob assembly.
Figure 19B:
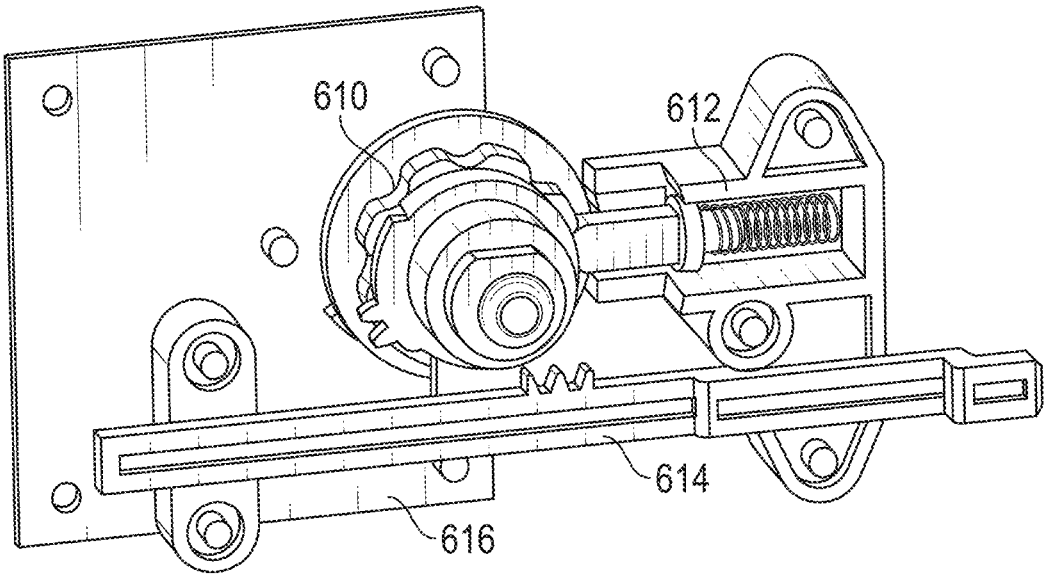
Figure 19C:
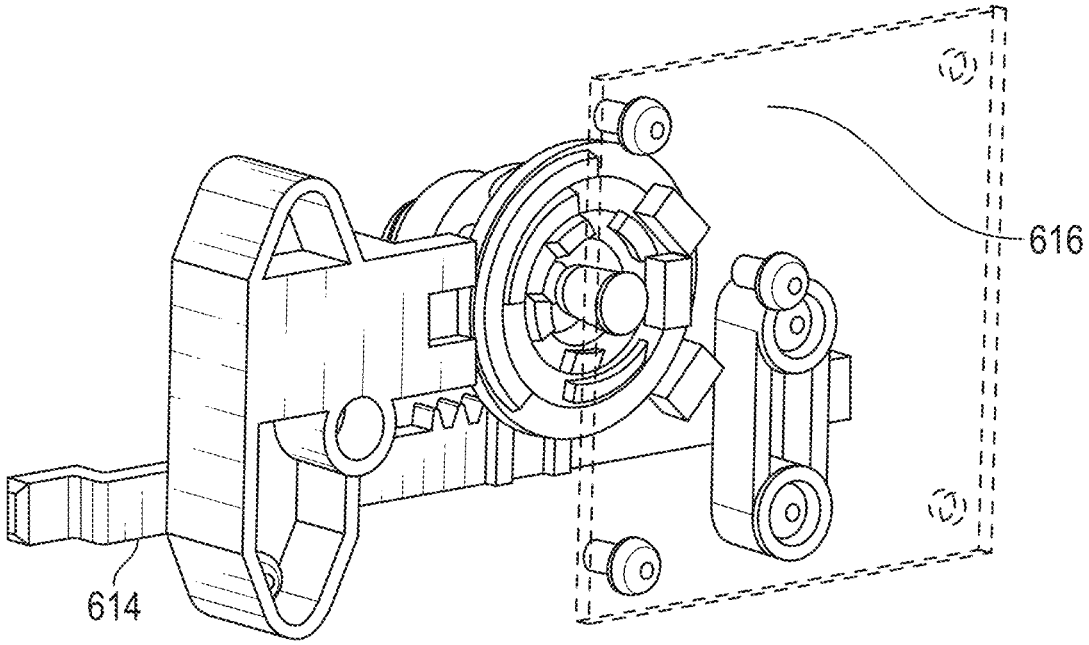

In some embodiments, the functional components connected to the control knob 310 are illustrated in FIGS. 19A-19C. FIG. 19A is a cross sectional view of the functional parts behind the control knob 310, including a red, green, blue (RGB) LED 618. FIGS. 19B-19C are two perspective views of the internal components viewed from the frontside and the backside, respectively. In some embodiments, the toy system 100 comprises a cam wheel 610, a knob detent frame 612, a lock rack 614, and/or a main printed circuit board (PCB) 616 that are connected to the control knob 310, as shown in FIGS. 19B-19C.

As is illustrated in FIGS. 19A-19C, one of ordinary skill in the art can understand that the control knob 310 is the main control feature to control the processes during a play. In some embodiments, when the control knob 310 is turned clockwise, a spring-loaded stent pin loaded on the knob detent frame 612 slides on cam bumps on the cam wheel 610. In some embodiments, when the stent pin touches a dent between two adjacent cam bumps, the user feels that the control knob 310 arrives at a stop position. In some embodiments, the number of dents on the cam wheel 610 defines the number of potential stop positions for the control knob 310. At each stop position, the user may realize or may be supposed to add materials to the chamber 280 on top of the flask 200 shown in FIG. 6. In some embodiments, turning the control knob 310 to each additional stop position triggers the main PCB 616 to send commands to cause different visual and/or audio effects, that are supposed to show to the user the increased temperature and the advancement of the figurine creation process.

In some embodiments, the body of the control knob 310 is translucent and is illuminated by the RGB LED 618 on the main PCB 616. In some embodiments, when the control knob 310 is turned to the last stop position, it actuates the lock rack 614. In some embodiments, only when the lock rack 614 is actuated at the last stop the release handle 330 shown in FIG. 2 can be pulled down to drain the opaque fluid 240 from the space 250 in the flask 200 to reveal the figurine 400 inside, as shown in FIG. 9. In some embodiments, at the stop positions before the last stop position, the lock rack 614 prevents the release handle 330 being pulled down. In some embodiments, the stop positions of the control knob 310 are detected via microswitches mounted to the main PCB 616. In some embodiments, the microswitches are depressed in a binary sequence by the cam wheel 610. In an alternative embodiment these switches can be replaced with swipe switches.

Figure 20:
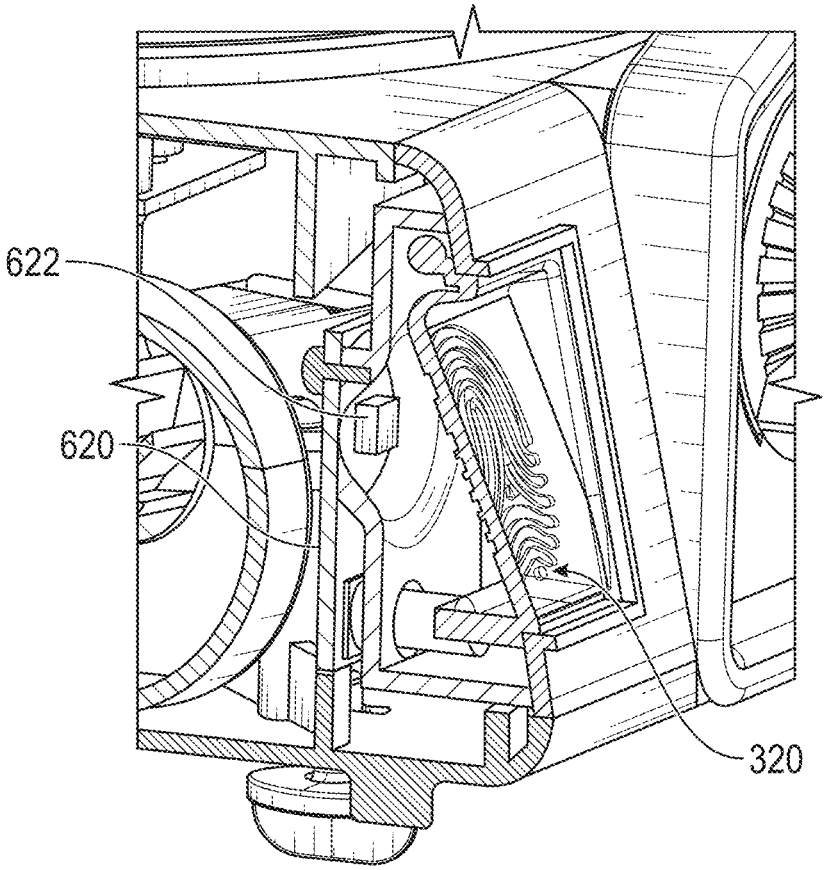
FIG. 20 is a perspective cross-sectional view that illustrates internal structures of the fingerprint reader shown in FIG. 2.

Referring to FIG. 20, a perspective partial cross-sectional view of the fingerprint reader 320 shown previously in FIG. 2 and FIG. 18 is depicted. In some embodiments, the fingerprint reader 320 is a translucent button with fingerprint like marking formed (e.g., molded) on the rear surface. In some embodiments, when illuminated from the backside by a RGB LED 622 mounted on a PCB 620, the fingerprint image on the fingerprint reader 320 gives the user an impression that his/her fingerprint is scanned. In some embodiments, when the user presses on the fingerprint reader button 320 the color of the LED will cycle and then land on a particular color, which has a particular meaning in the creature creation process. In some embodiments, the random nature of the color is related to the length of time that the user holds on the reader.

Figure 21:
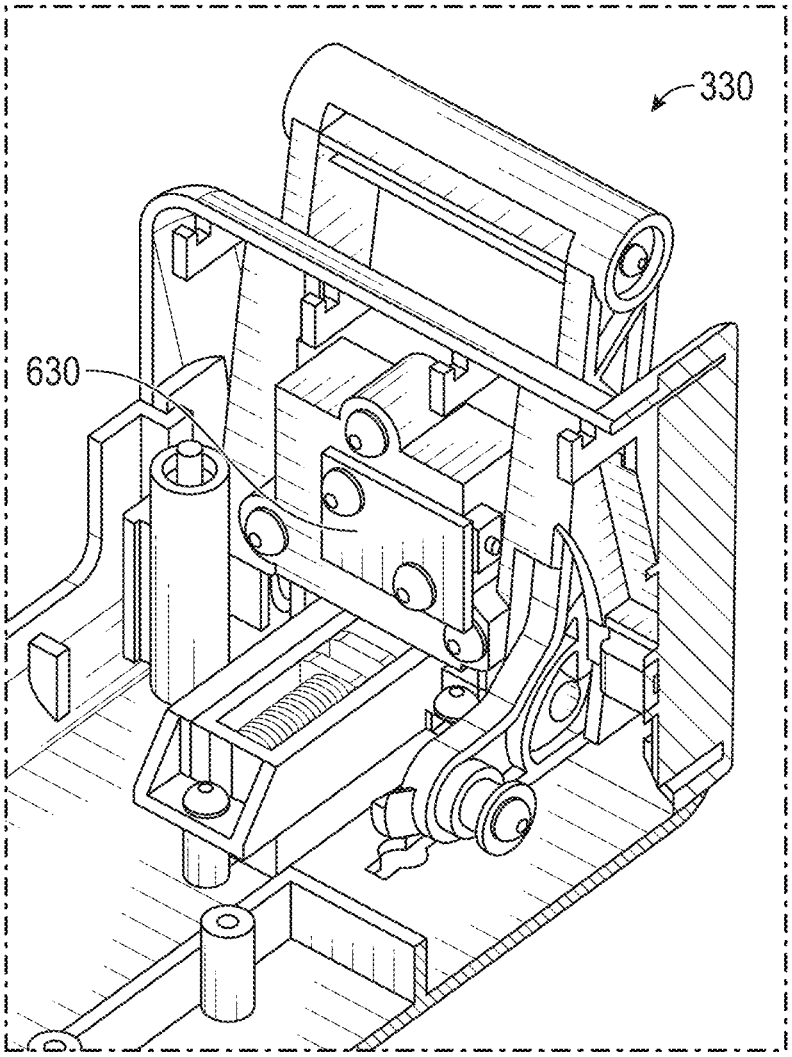
FIG. 21 illustrates the release handle and internal mechanism shown in FIG. 2.

FIG. 21 is a perspective cross sectional view showing the internal structure connected to the release handle 330, which was presented above in FIG. 2. In some embodiments, after the control knob 310 is turned to the last stop position and when the release handle 330 is pulled down the opaque fluid 140 drains from the space 250. In some embodiments, the warning light 340 shown in FIG. 2 is illuminated by a red LED (not shown) mounted on a warning light PCB 630. In some embodiments, the release handle 330 is held positively in both the up and down positions by a spring detent. In some embodiments, a microswitch detects when the handle is in the down position.

Figure 22:
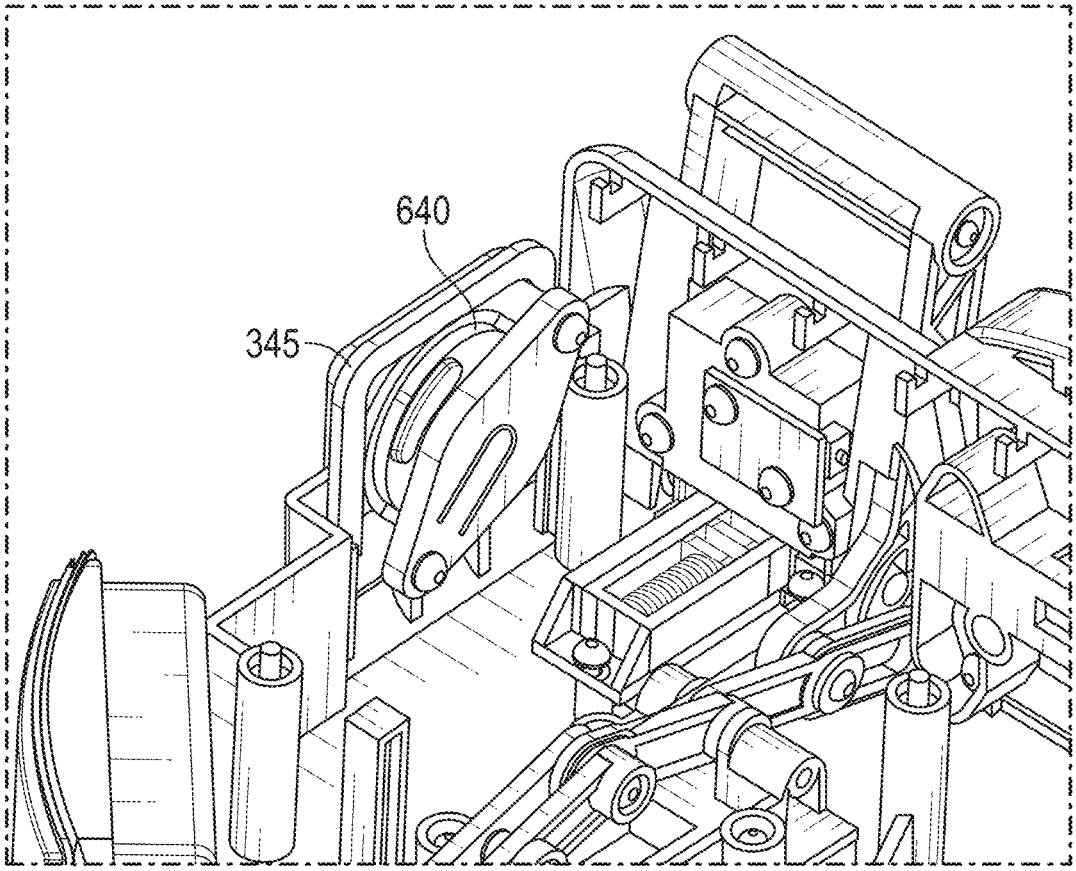
FIG. 22 illustrates a speaker and mechanism.

FIG. 22 shows a speaker 640 integrated with the speaker grill 345, which was previously shown in FIG. 4. In some embodiments, the speaker 640 and speaker grill 345 are attached to a side (e.g., the right side) of the base 300. In some embodiments, at different stop positions of the control knob 310, different sounds can be generated based on instructions from the main PCB 616 to signal the progress and the atmosphere of the figurine creation process.

Figure 23:
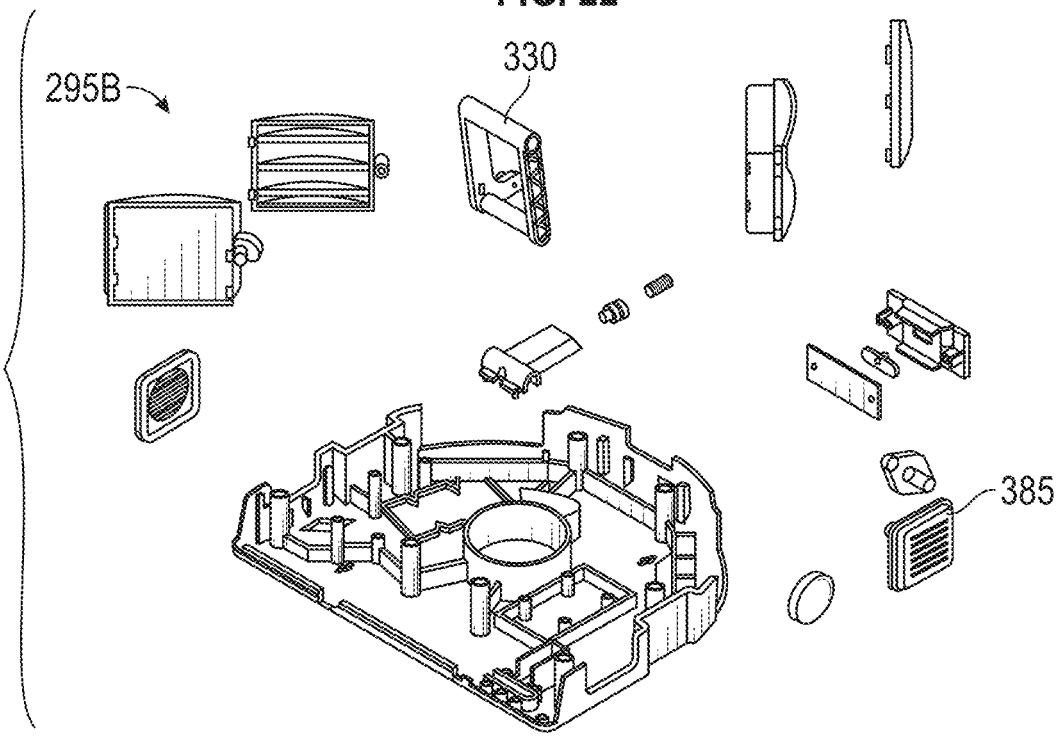
FIG. 23 is an exploded view of the lower base assembly shown in FIG. 13.
Figure 24:
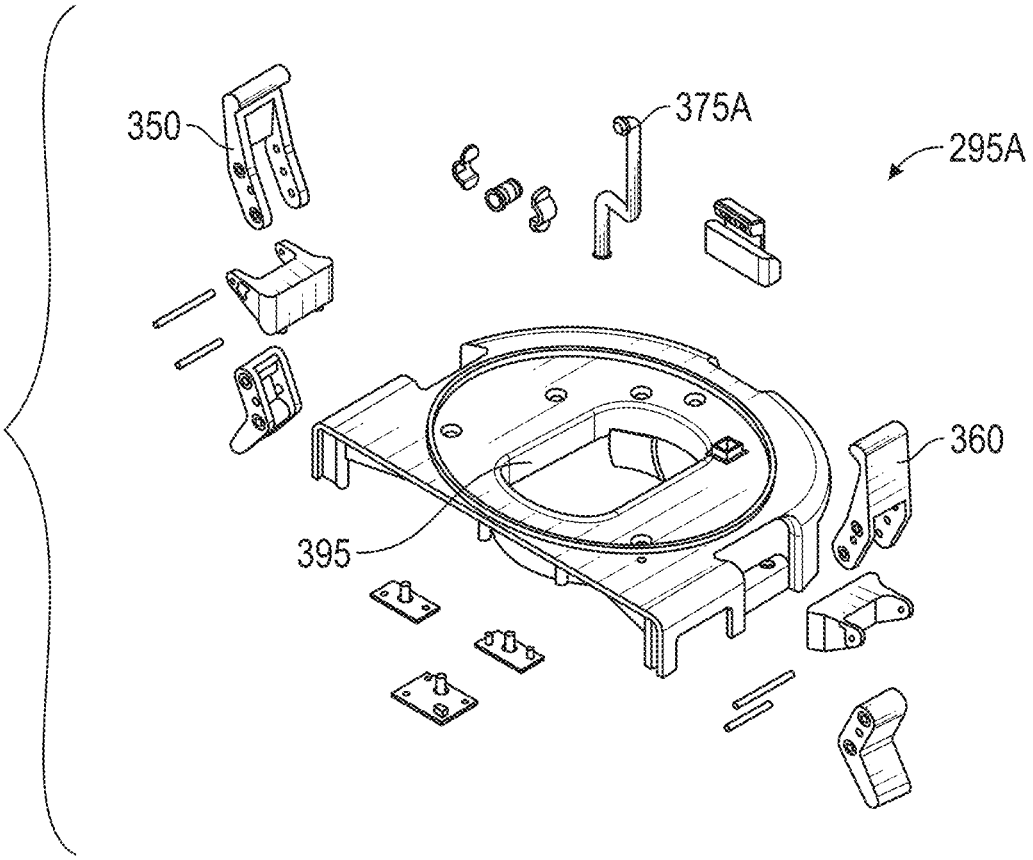
FIG. 24 is an exploded view of the upper base assembly shown in FIG. 13.

FIGS. 23 and 24 are exploded views of the lower base assembly 295B and the upper base assembly 295A of the base 300 as illustrated in FIG. 13, including certain features and components discussed above with respect to FIGS. 14A-22. Other features of the base 300 are further described below.

Figure 25A:
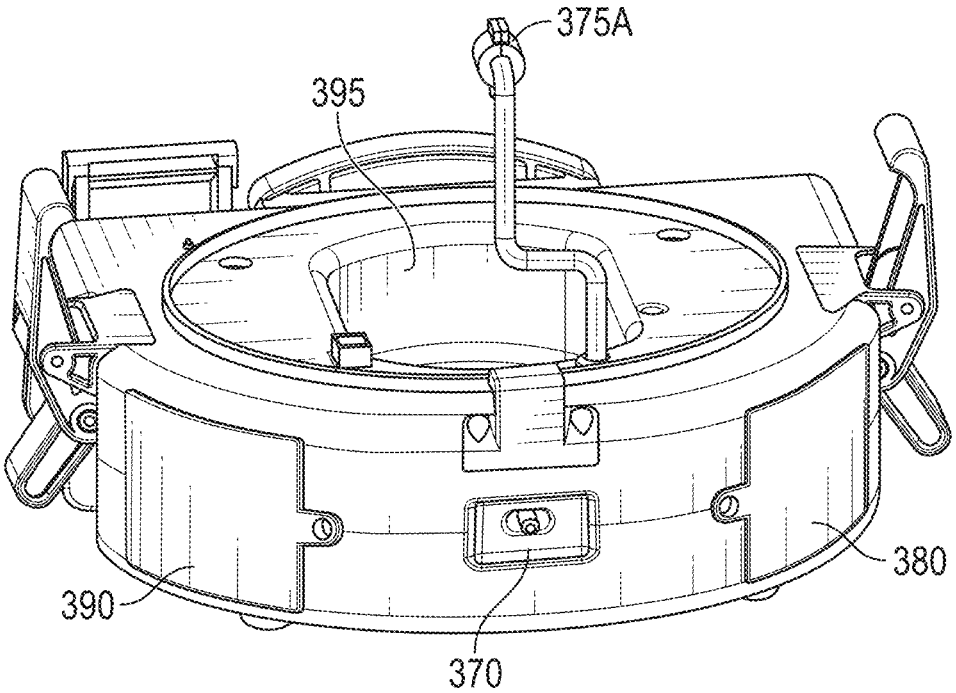
FIGS. 25A and 25B illustrate views of the base of FIG. 12A showing features including the battery chambers.
Figure 25B:
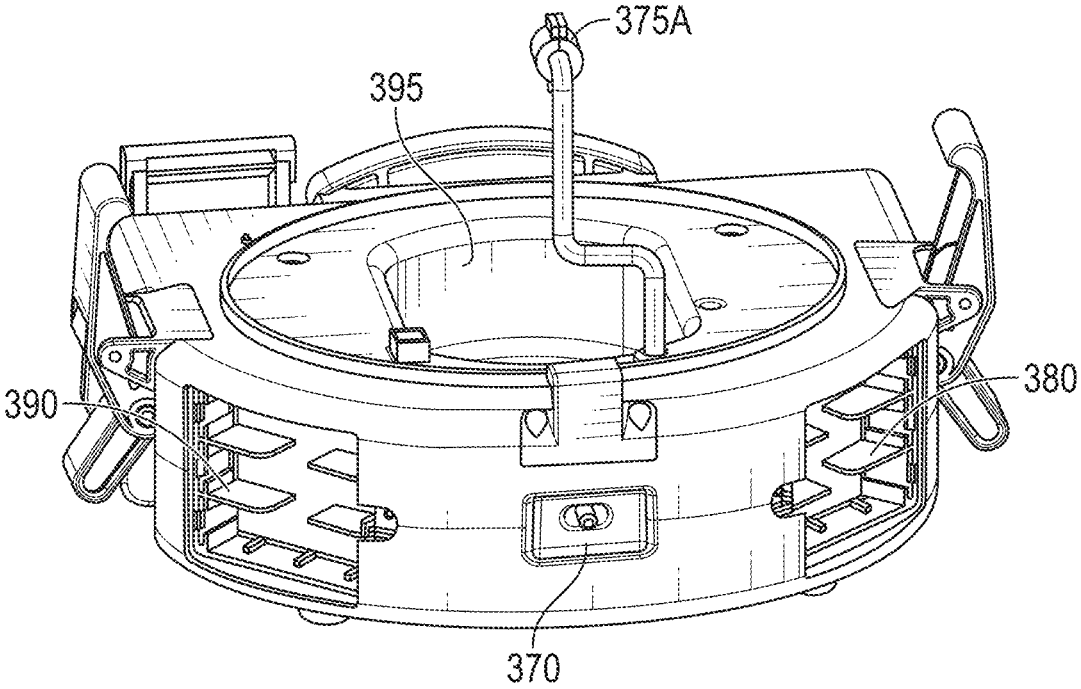

The rear perspective views of the base 300 is shown in FIGS. 25A and 25B, with battery chambers 380 and 390 covered and opened, respectively. In some embodiments, the toy system 100 is powered by a plurality of AA batteries, e.g., 6 AA batteries. In some embodiments, the battery chambers 380, 390 can be designed to fit other sizes, for example, AAA batteries. In some embodiments, one or more battery chambers can be implemented. In some embodiments, an on/off switch 370 is located at the center of the rear face between the battery chambers, as shown in FIG. 3. The switch 370 may be used to turn the toy system 100 on or off. In some embodiments, and as shown in FIGS. 25A and 25B, the umbilical cord 375A is attached to the upper surface of the base 300 close to the cavity 395.

Figure 26:
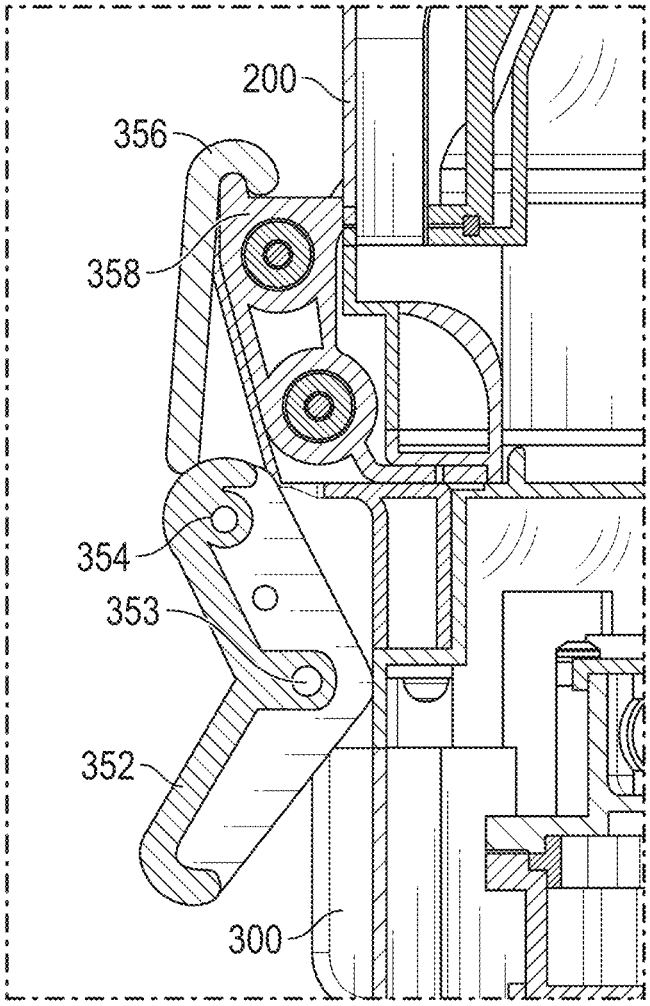
FIG. 26 is a partial cross-sectional view of one of the side latches shown in FIG. 12A.

The detail structure of the latch 350 (or latch 360) is shown in FIG. 26. Actuating a latch handle 352 around a pivot 353 formed on the base 300 can move a latch hook 356 up and down. In some embodiments, the latch handle 352 is pivotally connected to the latch hook 356 at a pivot point 354. As can be seen, pulling the latch handle 352 downward causes the latch hook 356 to engage a lip 358 of the flask 200. As such the flask 200 of the toy system 100 can be held tightly on to the base 300. On the other hand, pulling up the latch handle 352 allows the latch hook 356 to disengage from the lip 358. This action can cause the flask 200 to separate from the base 300. In some embodiments, only after both latches 350, 360 are released can the flask 200 be removed from the base 300. In some embodiments, the presence of the flask 200 is detected by a microswitch (not shown) on the base 300.

Figure 27B:
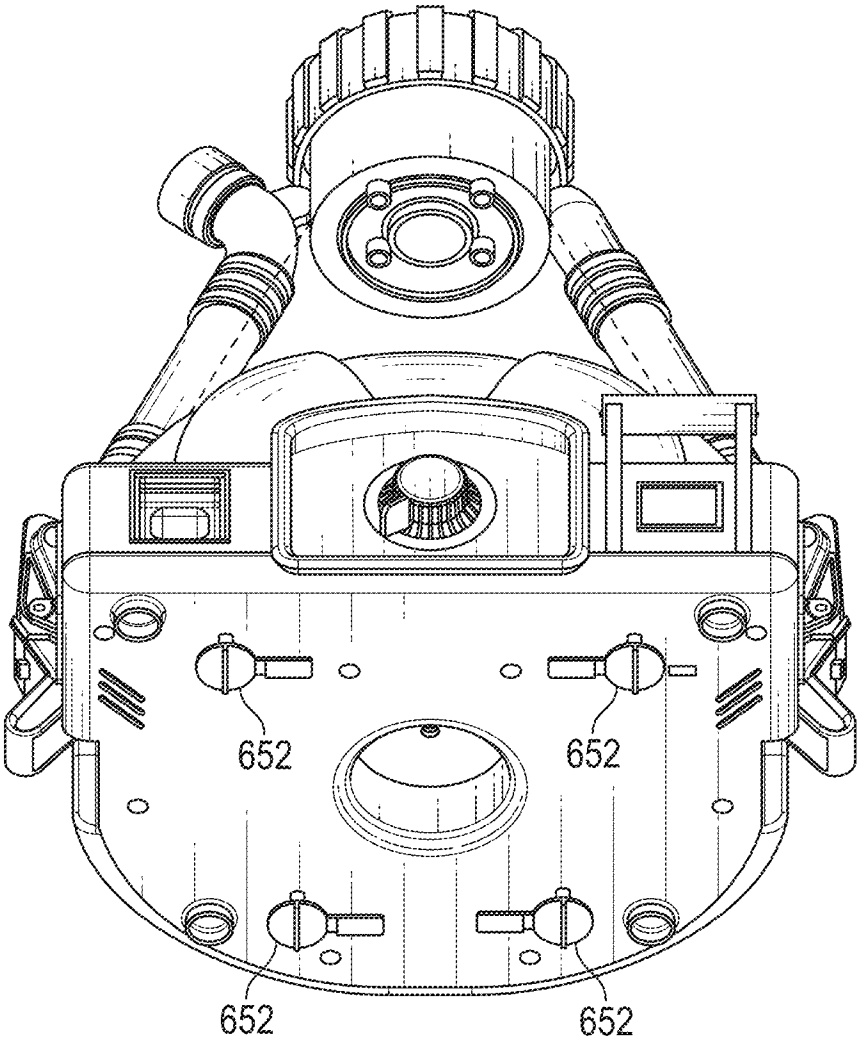
FIGS. 27A and 27B illustrate views showing packaging features of the toy system of FIG. 1.
Figure 27A:
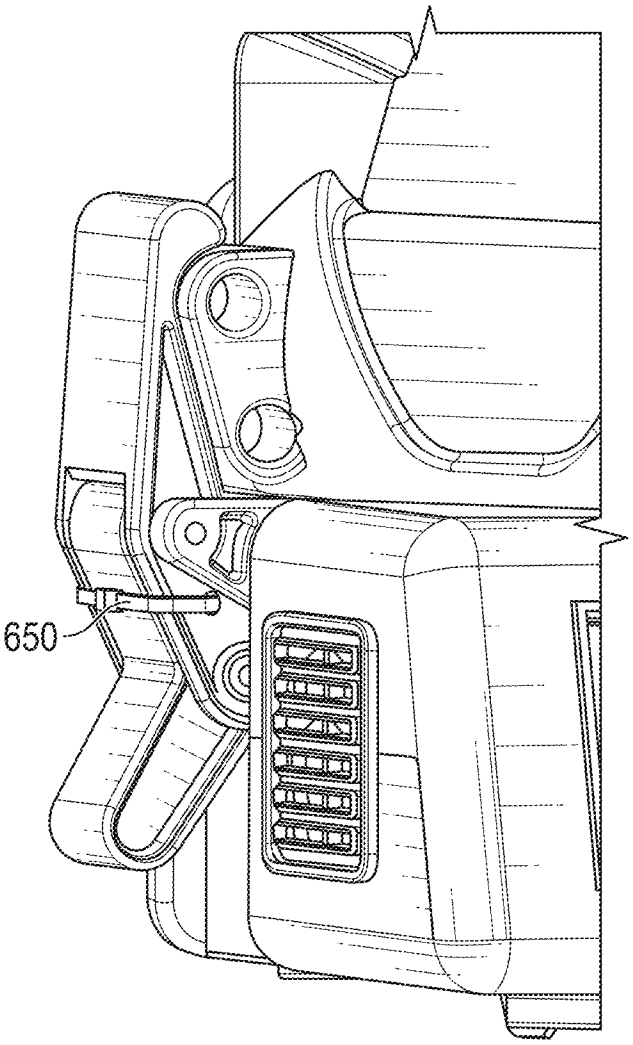

FIGS. 27A and 27B show packaging features, which include cable ties 650 to prevent the flask 200 being accidentally released from the based 300 and packaging locks 652 to attach to a base card. The cable ties 650 need to be removed before the toy system 100 can be played.

Figure 28:
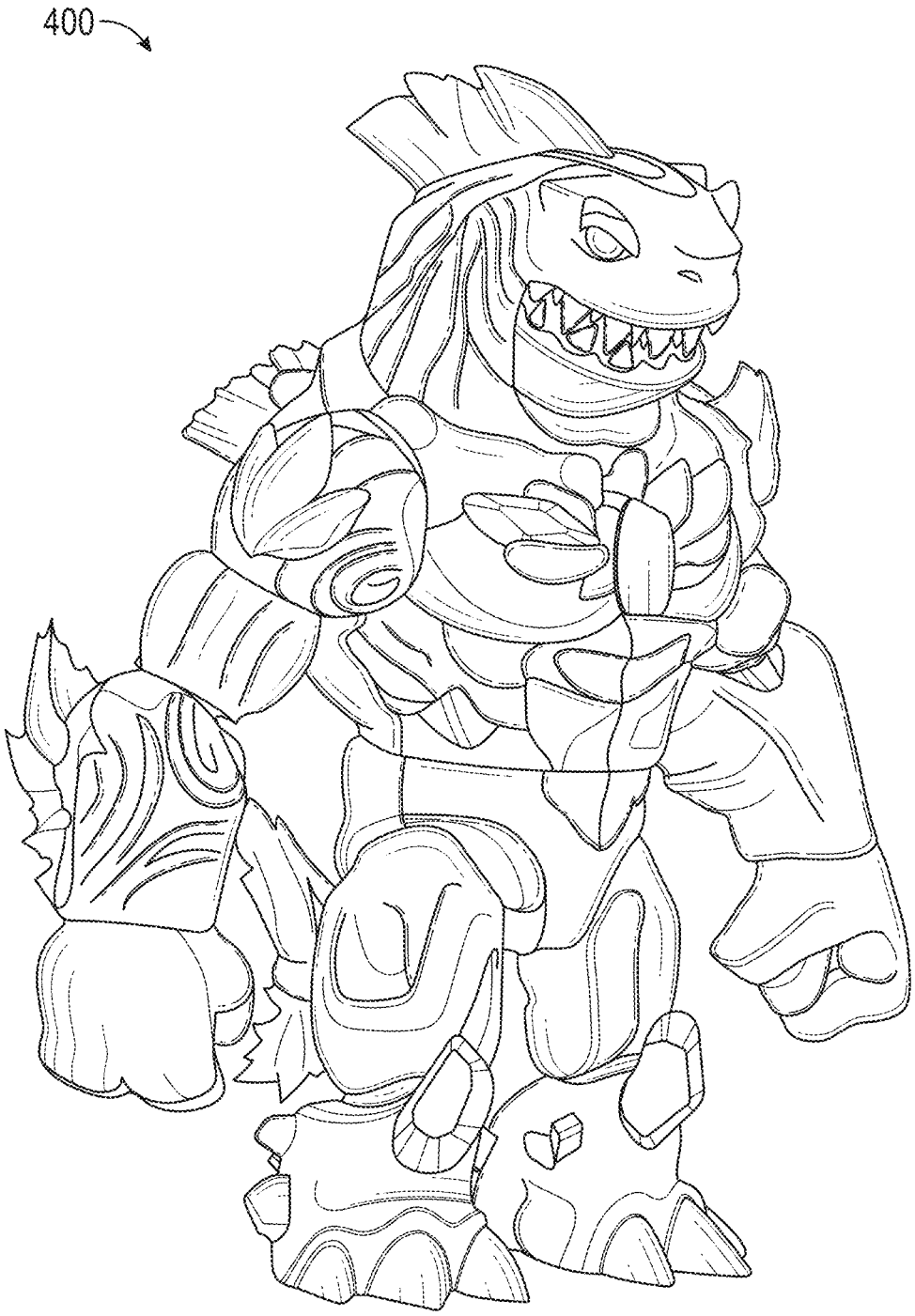
FIG. 28 is a perspective view of a figurine that can be employed with the toy system.

In FIG. 28 a perspective view of the figurine 400 is shown. In some embodiments, when the user finishes the controlled process and pulls down the release handle 330 to drain the opaque fluid 240 from the flask 200, the flask wall becomes clear and the figurine 400 residing in the internal space 270 is revealed. The user feels that he/she has created a creature.

Figure 29A:
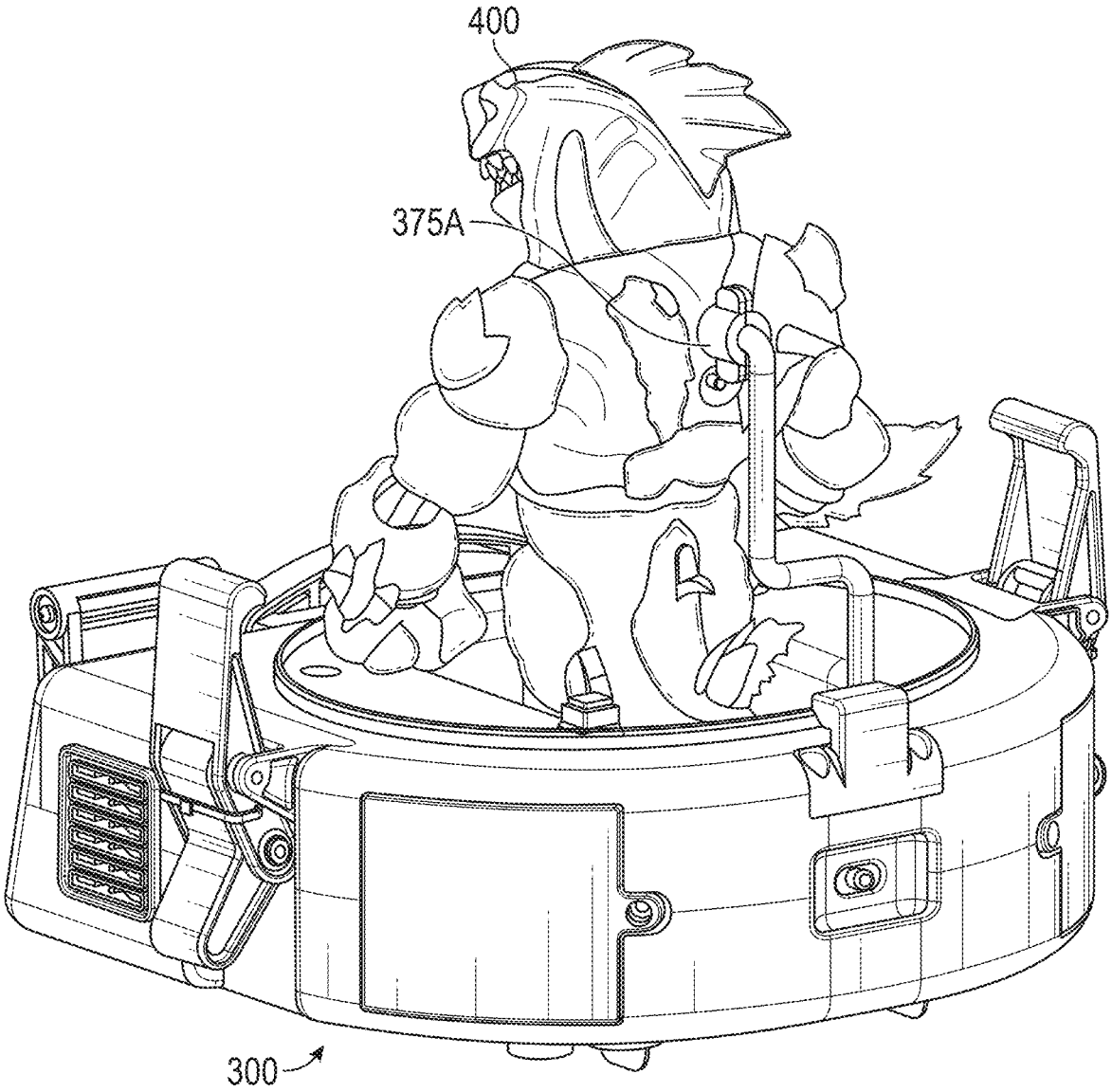
FIG. 29A is a perspective view showing the figurine of FIG. 28 residing in the base of FIG. 12A.
Figure 29B:
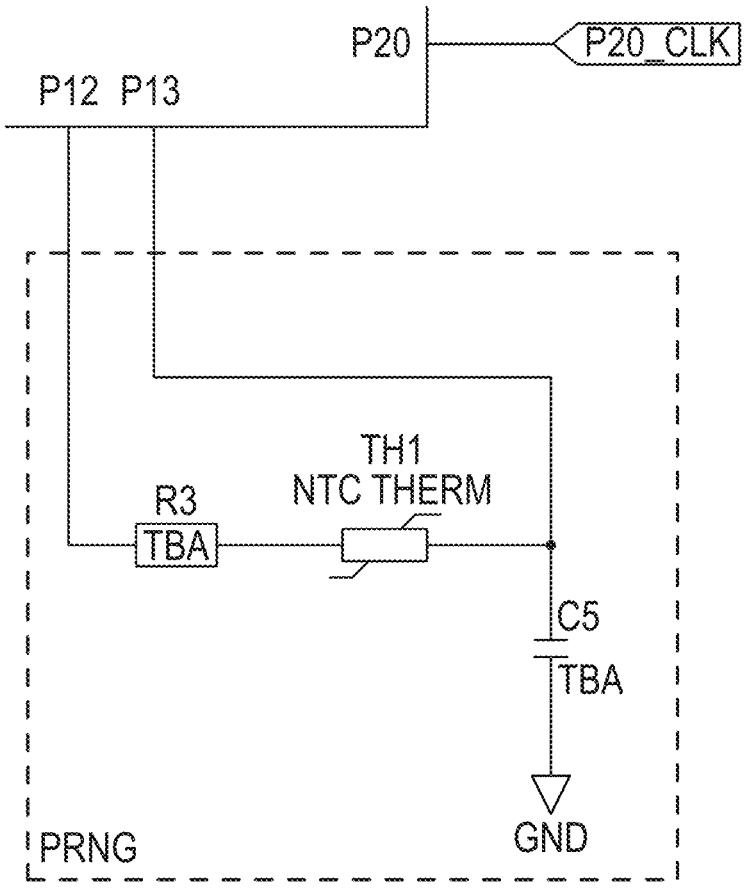
FIG. 29B is a schematic electrical circuit implemented in the figurine of FIG. 28.

Referring to FIG. 29A, when the opaque fluid is drained from the flask 200 and the flask 200 is removed from the base 300, the figurine 400 is shown to be standing in the cavity 395 on the base 300 and connected to the umbilical cord 375A (or 375B). In some embodiments, when the umbilical cord 375A, 375B is removed from the figurine 400, the figurine 400 is woken up with an attitude, preferably randomly landing on one of a plurality of the pre-determined modes. In some embodiments, the random selection is performed by the PCB on the figurine 400 by employing the circuit shown. FIG. 29B illustrates a schematic of an electrical circuit for performing the attitude selection and movements of the figurine 400.

Figure 30A:
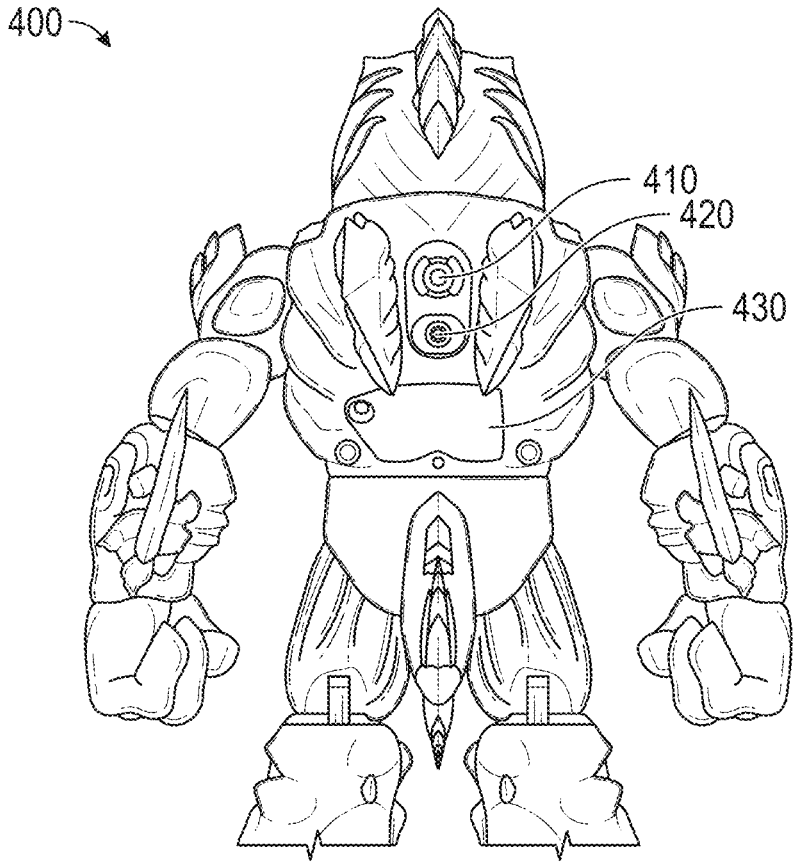
FIGS. 30A-30C illustrate views showing features on the backside of the figurine of FIG. 28.
Figure 30B:
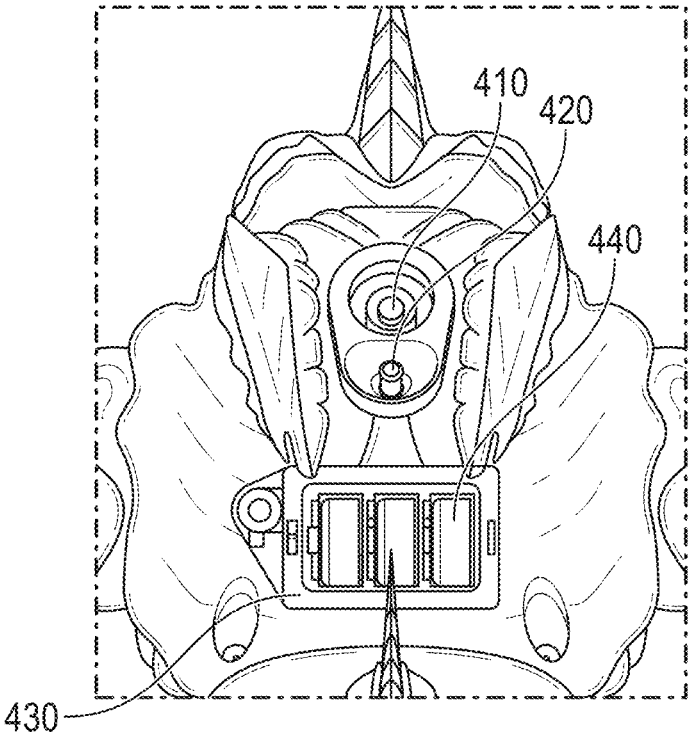
Figure 30C:
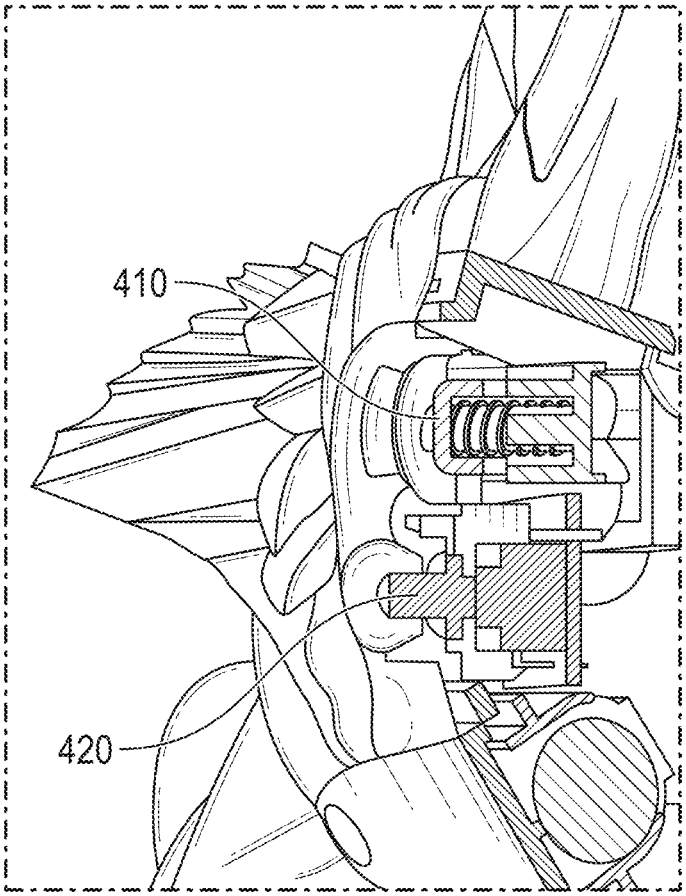
Figure 31A:
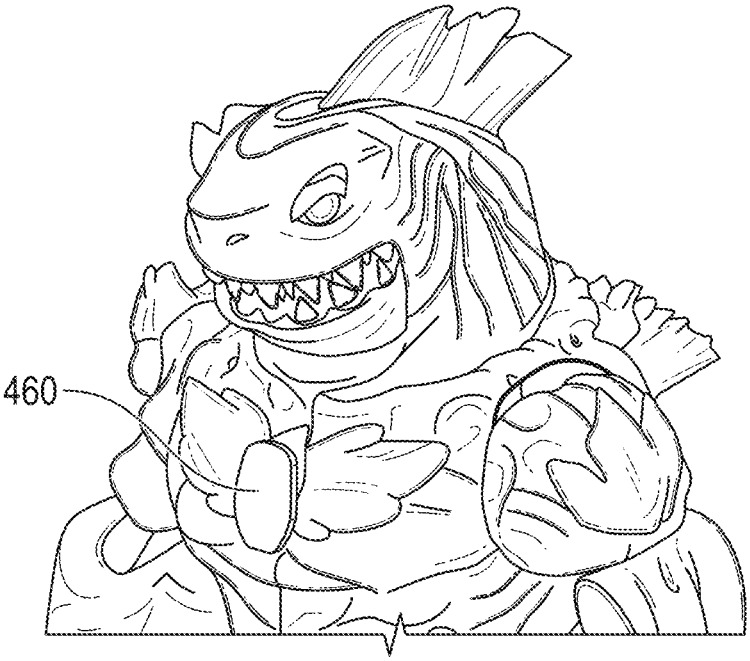
FIGS. 31A-31D illustrate views showing features on the frontside of the figurine of FIG. 28.
Figure 31B:
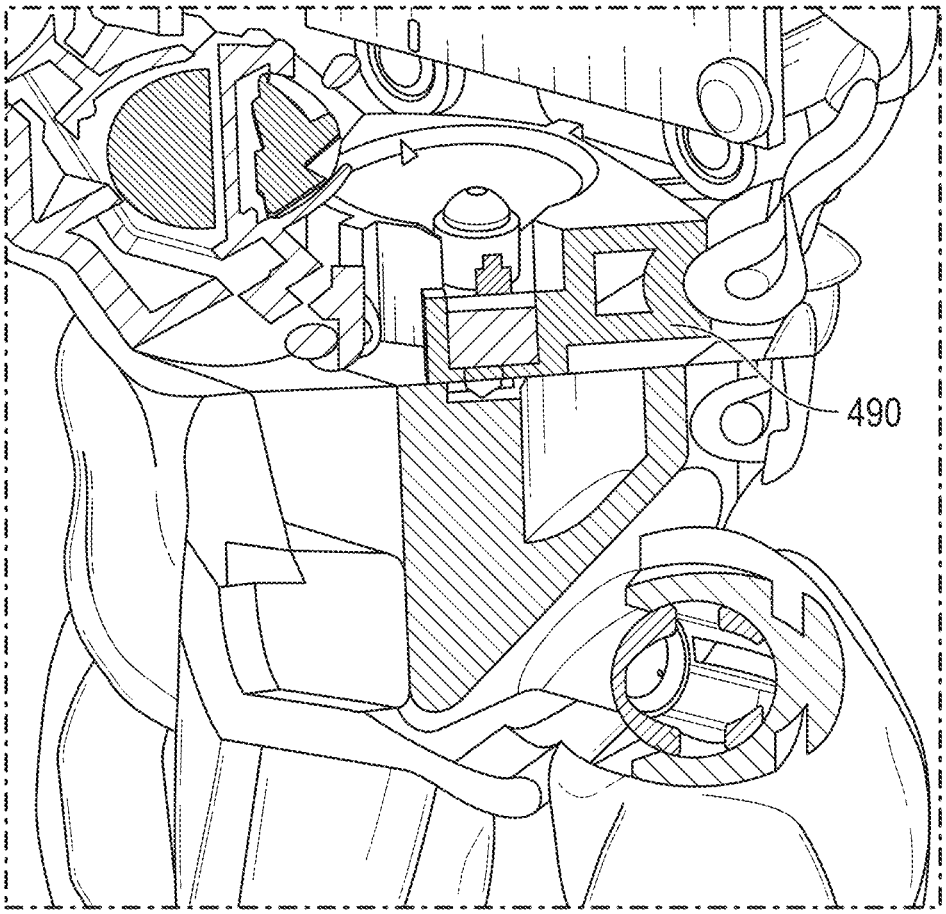
Figure 31C:
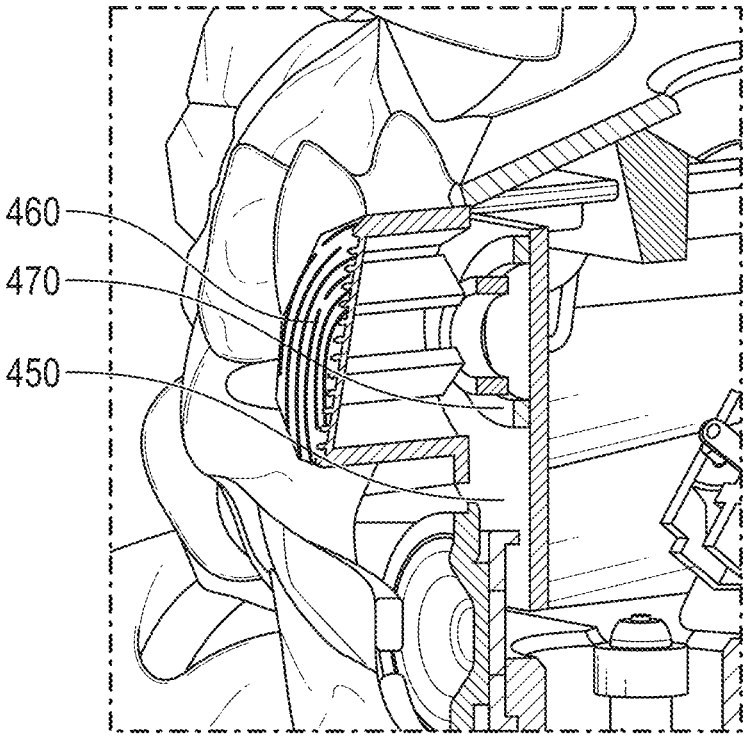
Figure 31D:
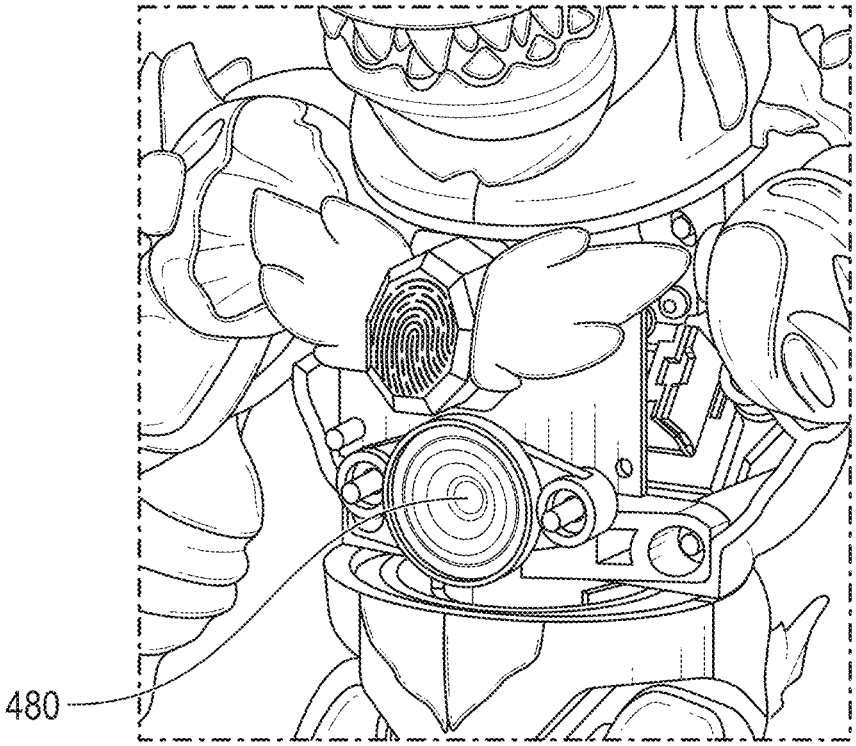

As shown in FIGS. 30A-30C, in some embodiments, the figurine 400 has a creature body, e.g., a shark. In some embodiments, the figurine 400 is powered by 3 button cell batteries 440 loaded in a figurine battery chamber 430 located on the back of the figurine 400. However, the battery chamber 430 can also be constructed to house different numbers or different types of battery. In some embodiments, an electrical connector 410 on the back of the figurine 400 is couple to a normally closed (NC) switch. In some embodiments, during shipping when the umbilical cord 375A, 375B is plugged into the connector 410, the umbilical cord 375A, 375B is pressed on the NC switch to set it to the off state. In some embodiments, a latching press on/off switch 420 on the back of the figurine 400 may be set to off during shipping when the umbilical cord 375A, 375B is connected to the figurine 400.

Figure 32:
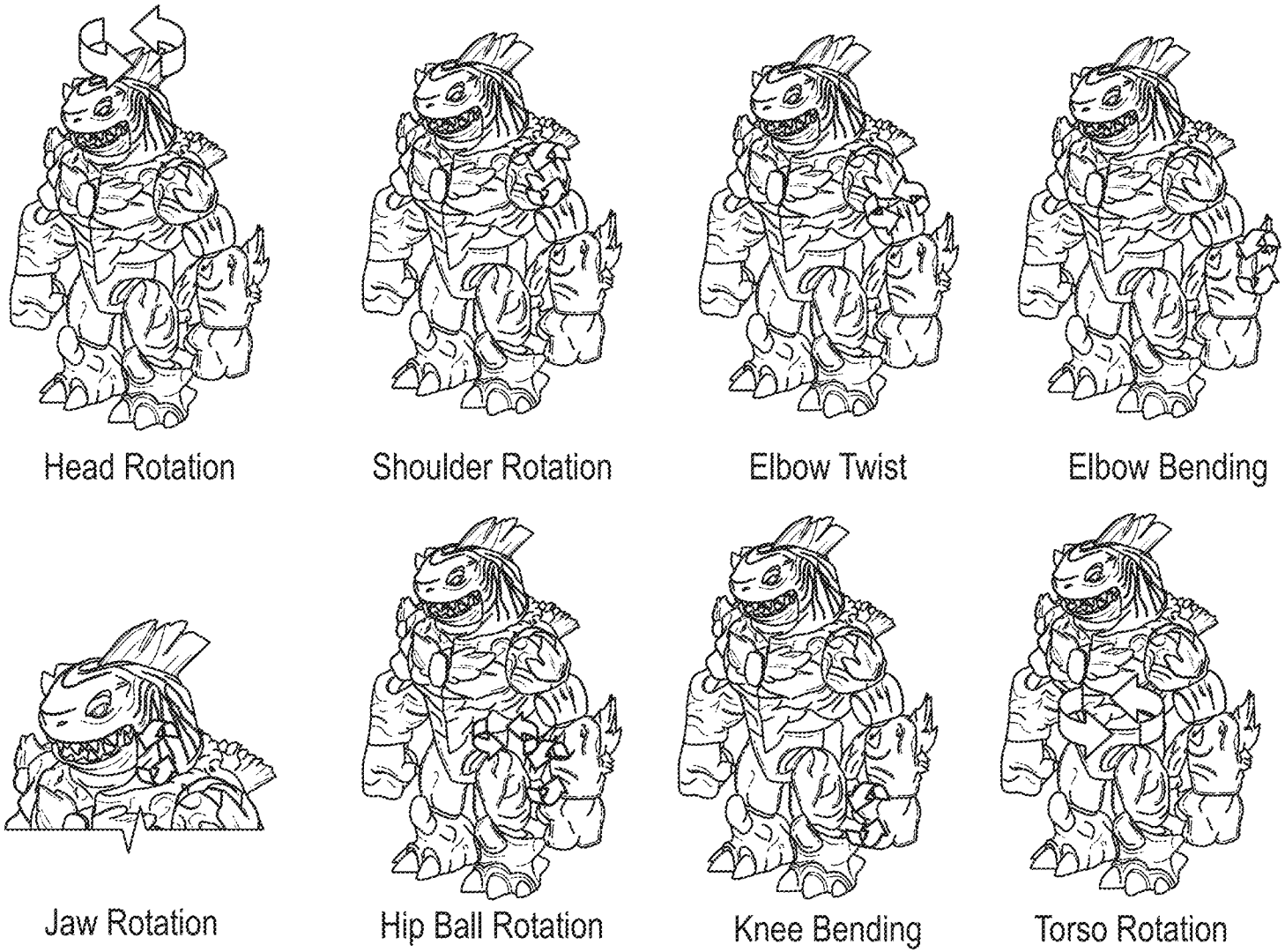
FIG. 32 illustrates views of the figurine of FIG. 28 performing different actions.

The front side of the figurine 400 is illustrated in FIGS. 31A-31D. In some embodiments, the figurine 400 employs a chest switch 460 and a waist switch 490 as manual input to cause the figurine to perform functions. In some embodiments, a speaker 480 makes sound and LEDs emit light during a performance of the figurine 400. In some embodiments, the performance of the figurine 400 can include one or more of the actions shown in FIG. 32, including head rotation, shoulder rotation, elbow twist, elbow bending, jaw rotation, hip ball rotation, knee bending, torso rotation, etc.

Figure 33:
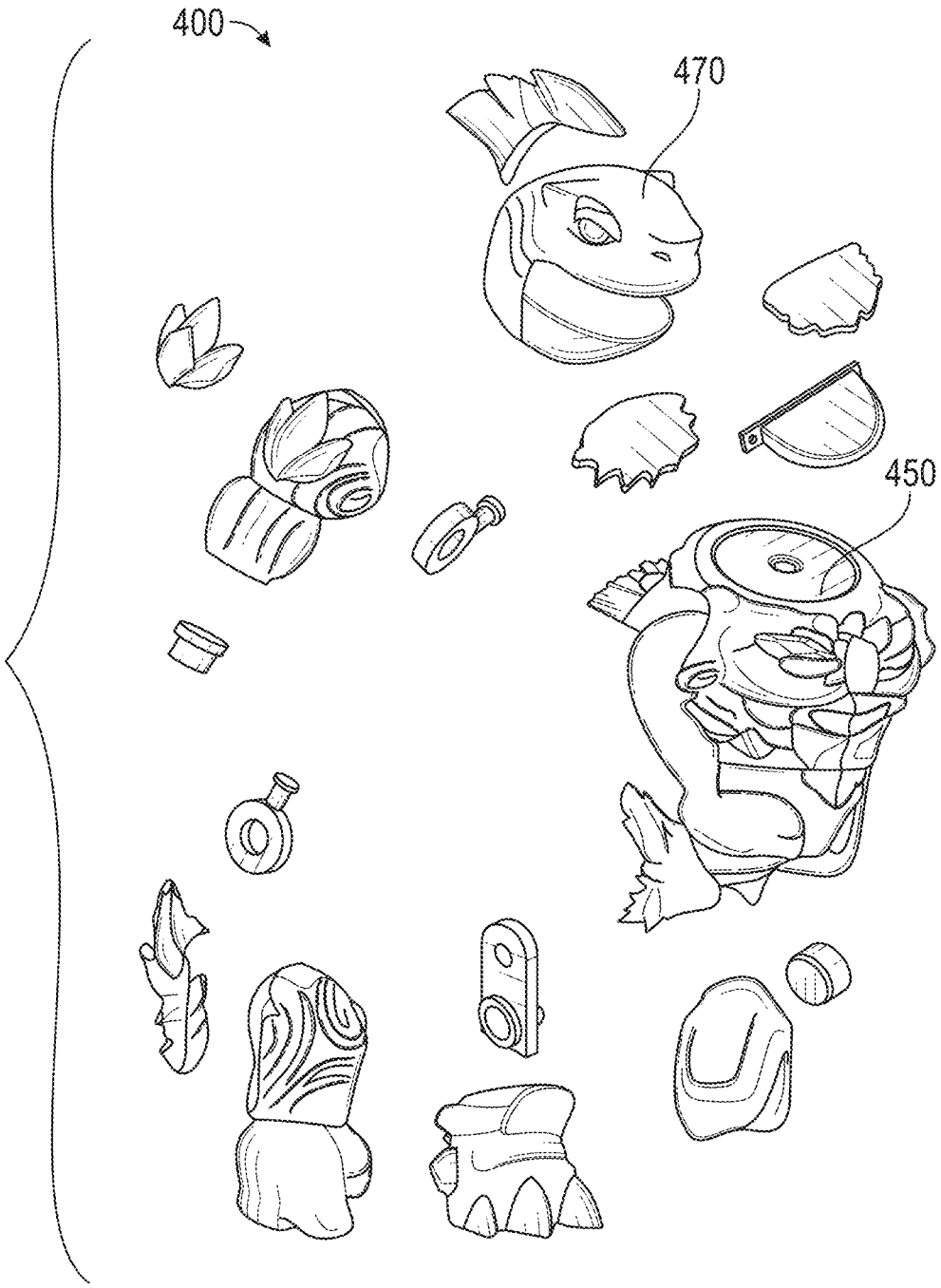
FIG. 33 is an exploded view of a portion of the figurine of FIG. 28.
Figure 34:
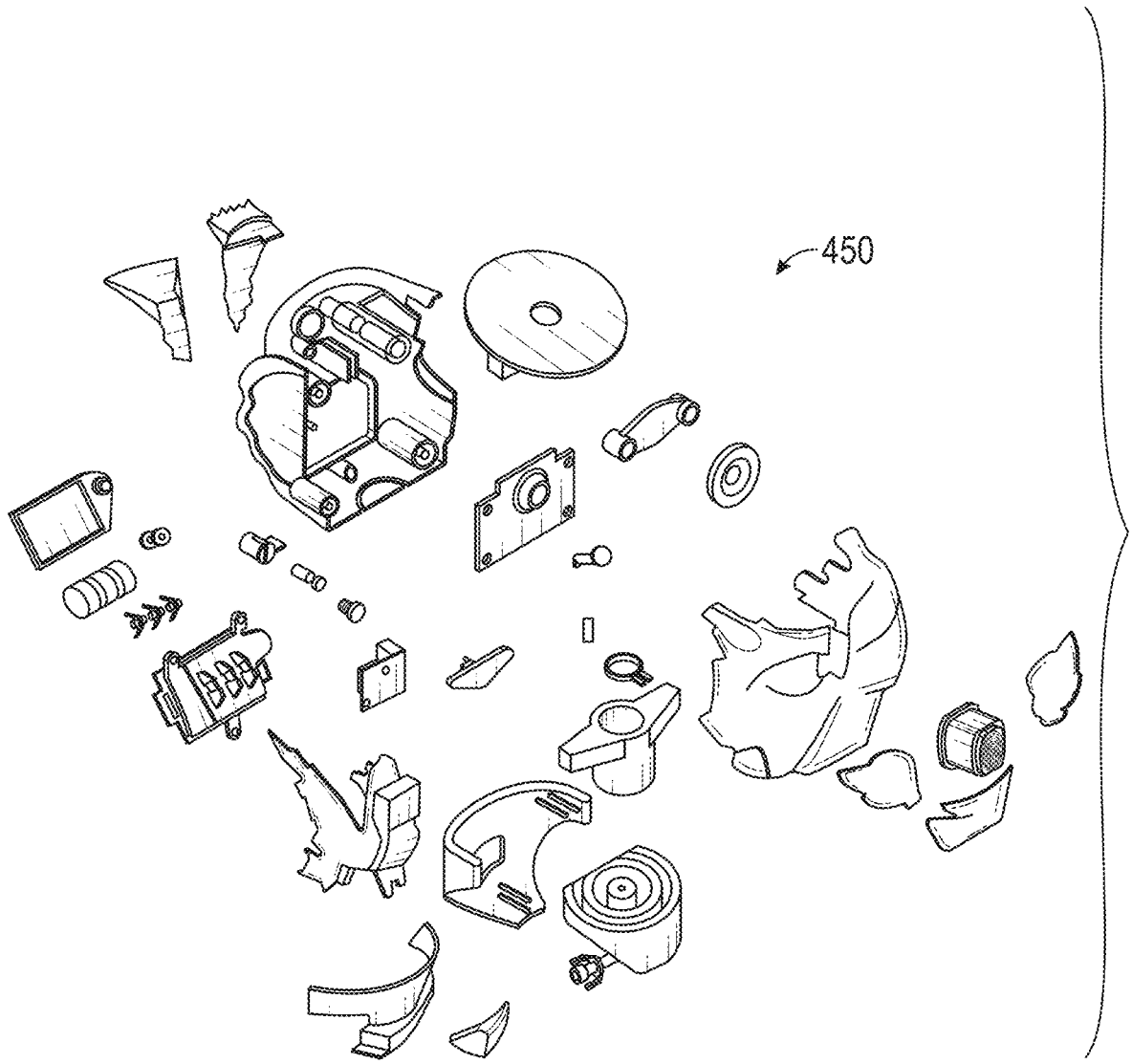
FIG. 34 is an exploded view of another portion of the figurine of FIG. 28.

In some embodiments, the components of the figurine 400 are shown in FIG. 33 as an exploded view. Among the components are a body assembly 450 and a figurine head 470. In some embodiments, the components of the body assembly 450 are shown in FIG. 34 as an exploded view. The components illustrated in FIGS. 43-34 can comprise molded (e.g., injection molded) plastics. The components can be assembled by fasteners (e.g., screws), adhesive, and/or welding.

Figure 35A:
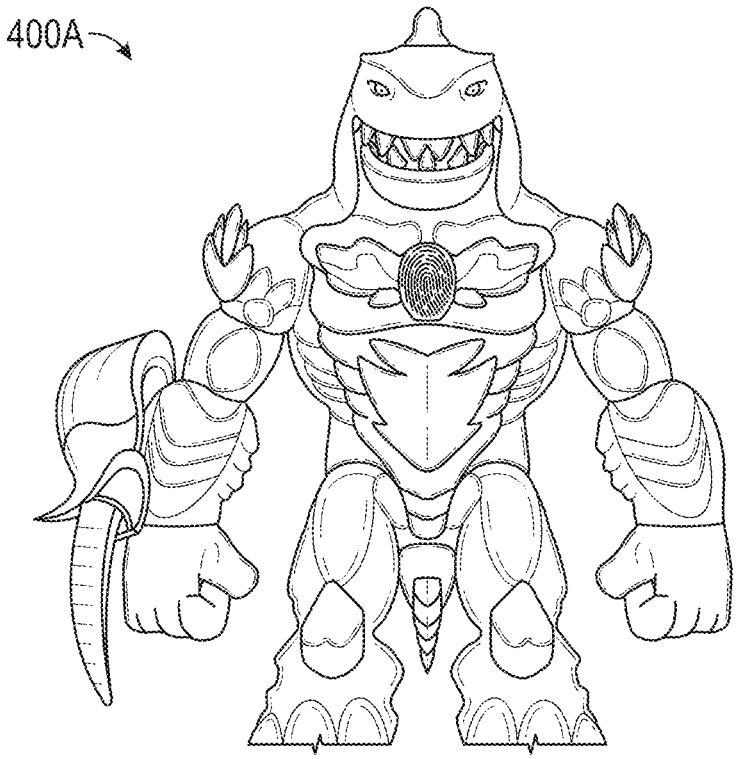
FIGS. 35A and 35B illustrate different optional features that can be added to a figurine.
Figure 35B:
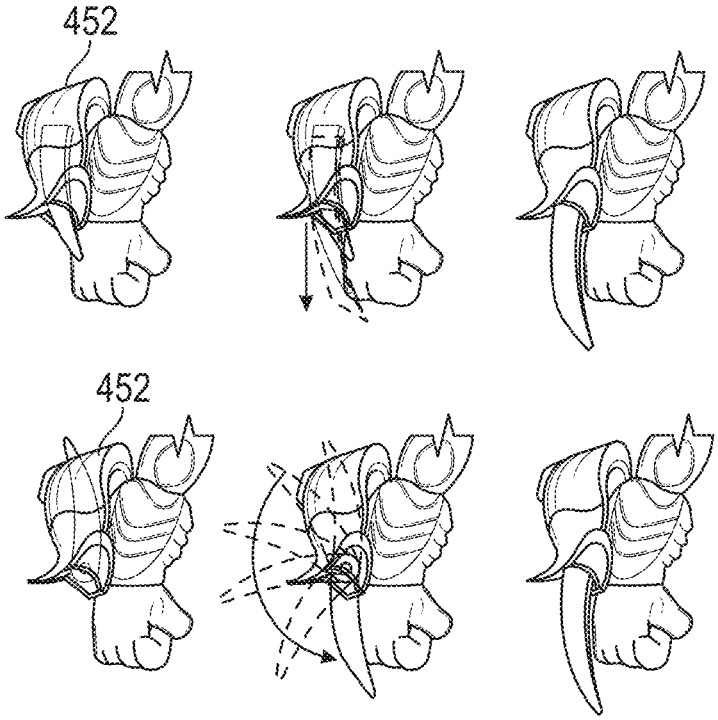
Figure 36A:
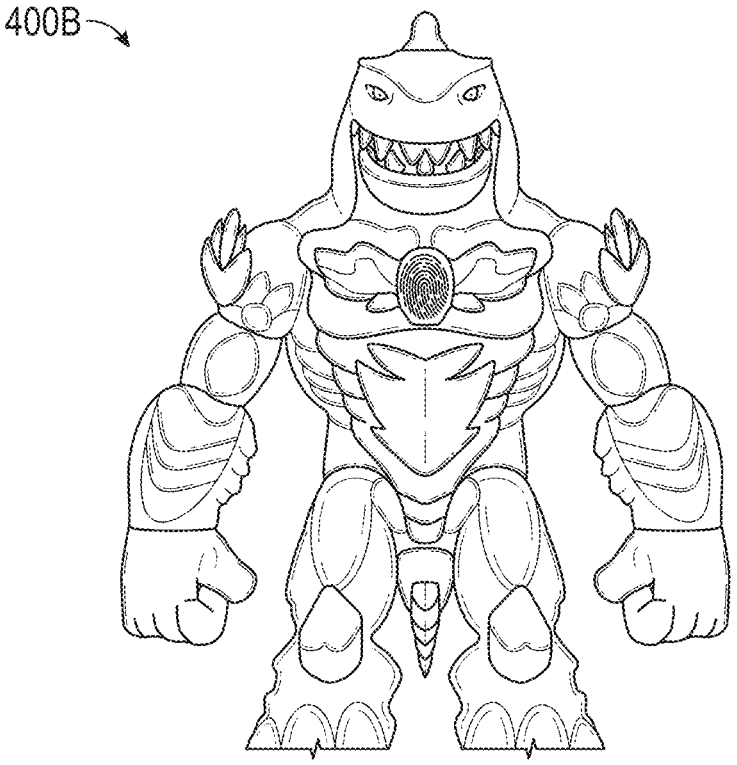
FIGS. 36A and 36B illustrate different head shapes of the figurine.
Figure 36B:
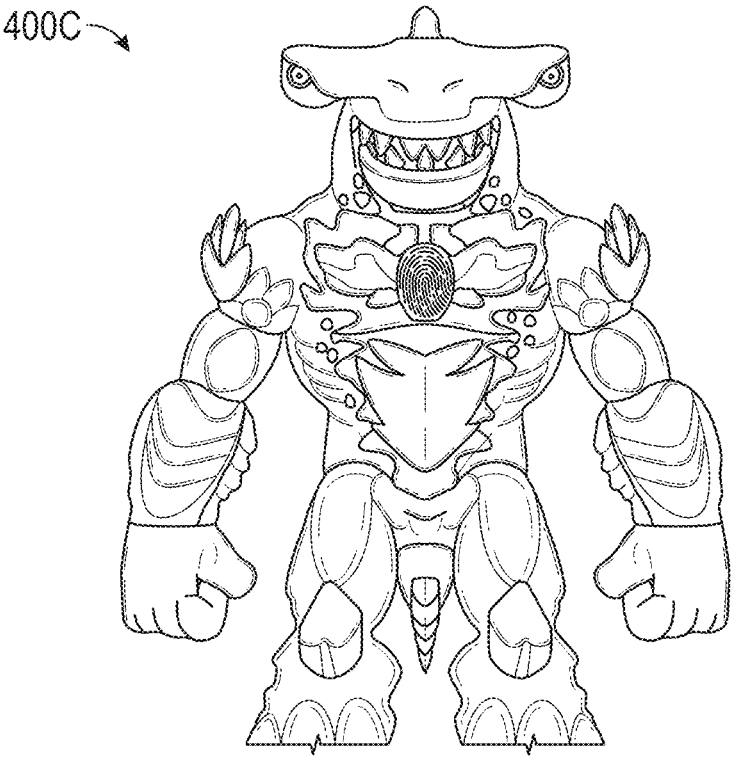

The figurine 400 can have different features and take different forms. In FIGS. 35A and 35B, a shark figurine 400A carries a defense device on his right arm with a knife loaded therein. FIG. 35B illustrates two knife loading embodiments. The top row shows that a knife can be extended out by pushing a button 452 located on top of the mechanism. The bottom row shows the knife swinging from the folded position to the loaded position. FIGS. 36A and 36B show two shark figurines 400A, 400B. The figurine 400A of FIG. 36A resembles a megalodon shark. The figurine 400B of FIG. 36B resembles a hammerhead sharp. The figurine can take other variations.

Figure 37:
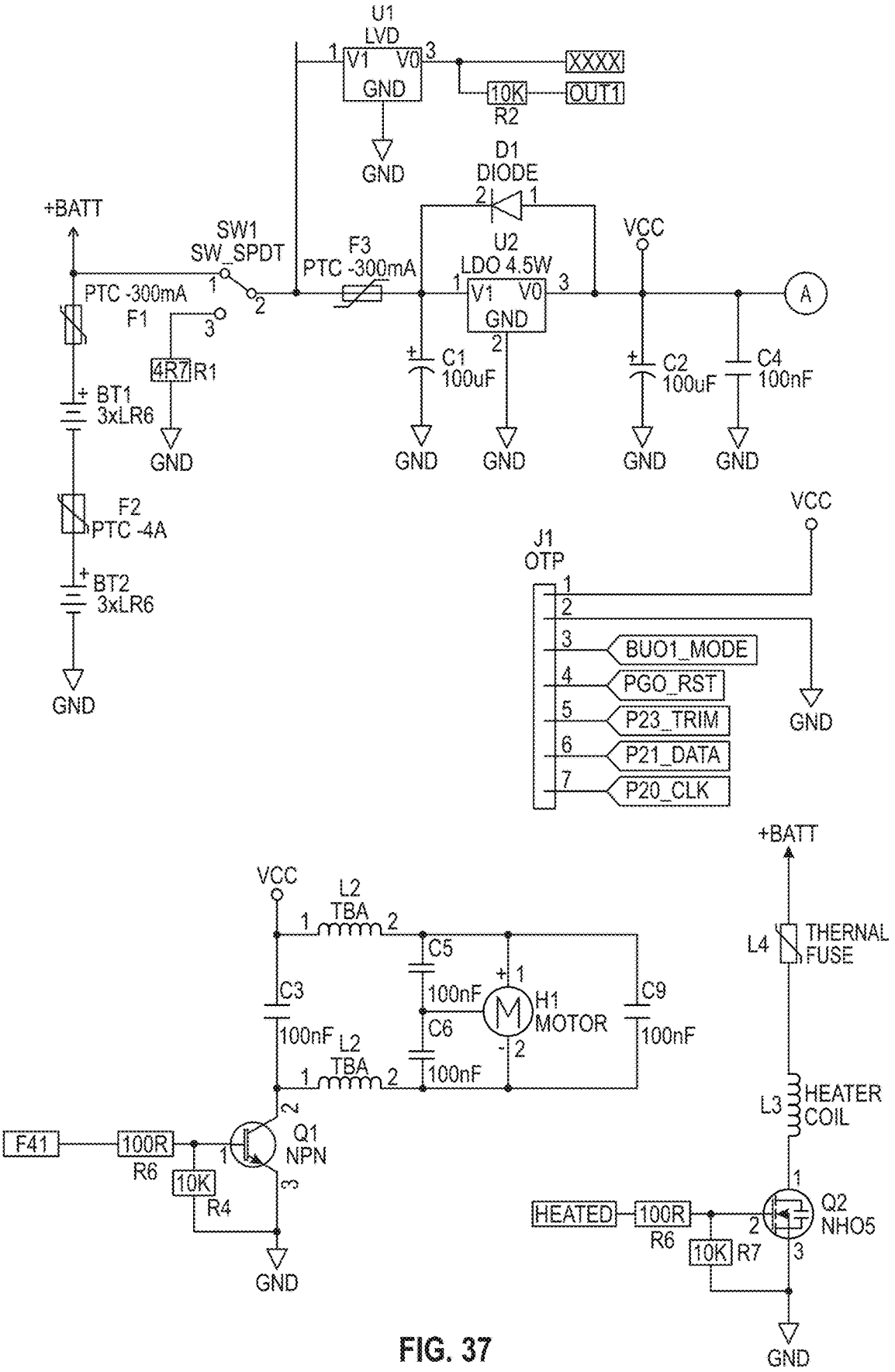
FIG. 37 shows schematics of electronics for the toy system of FIG. 1.
Figure 37:
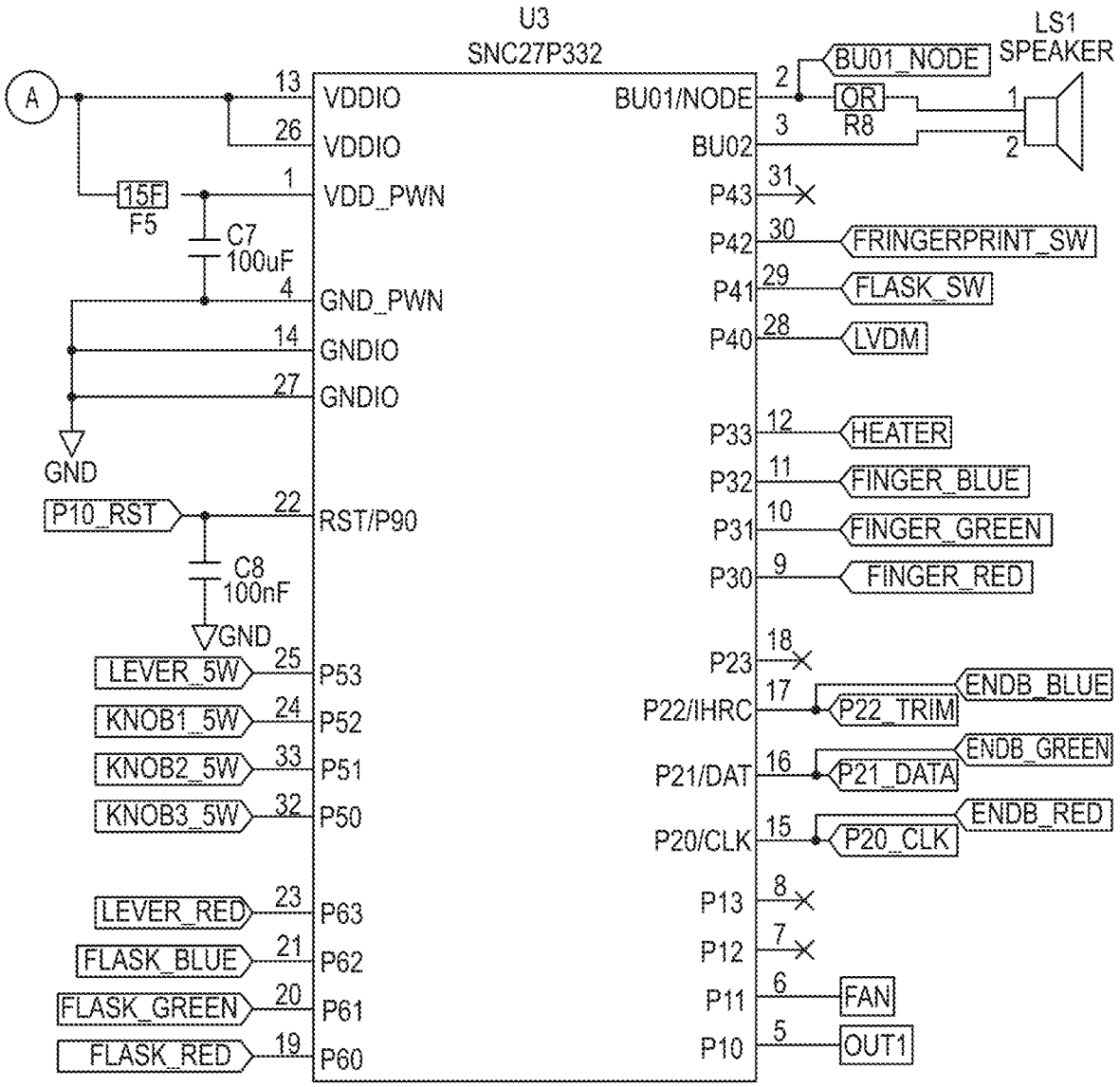
Figure 37:
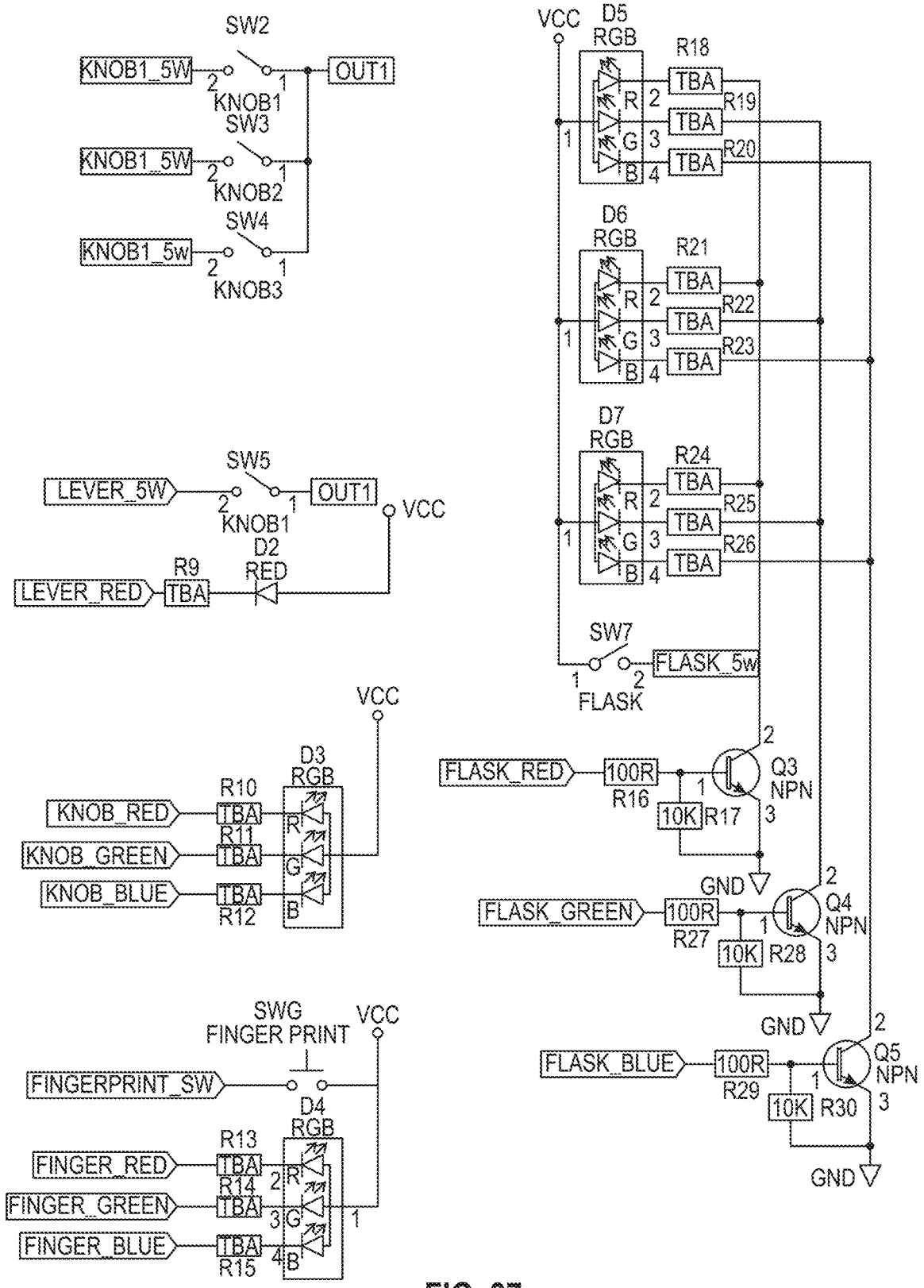
Figure 38:
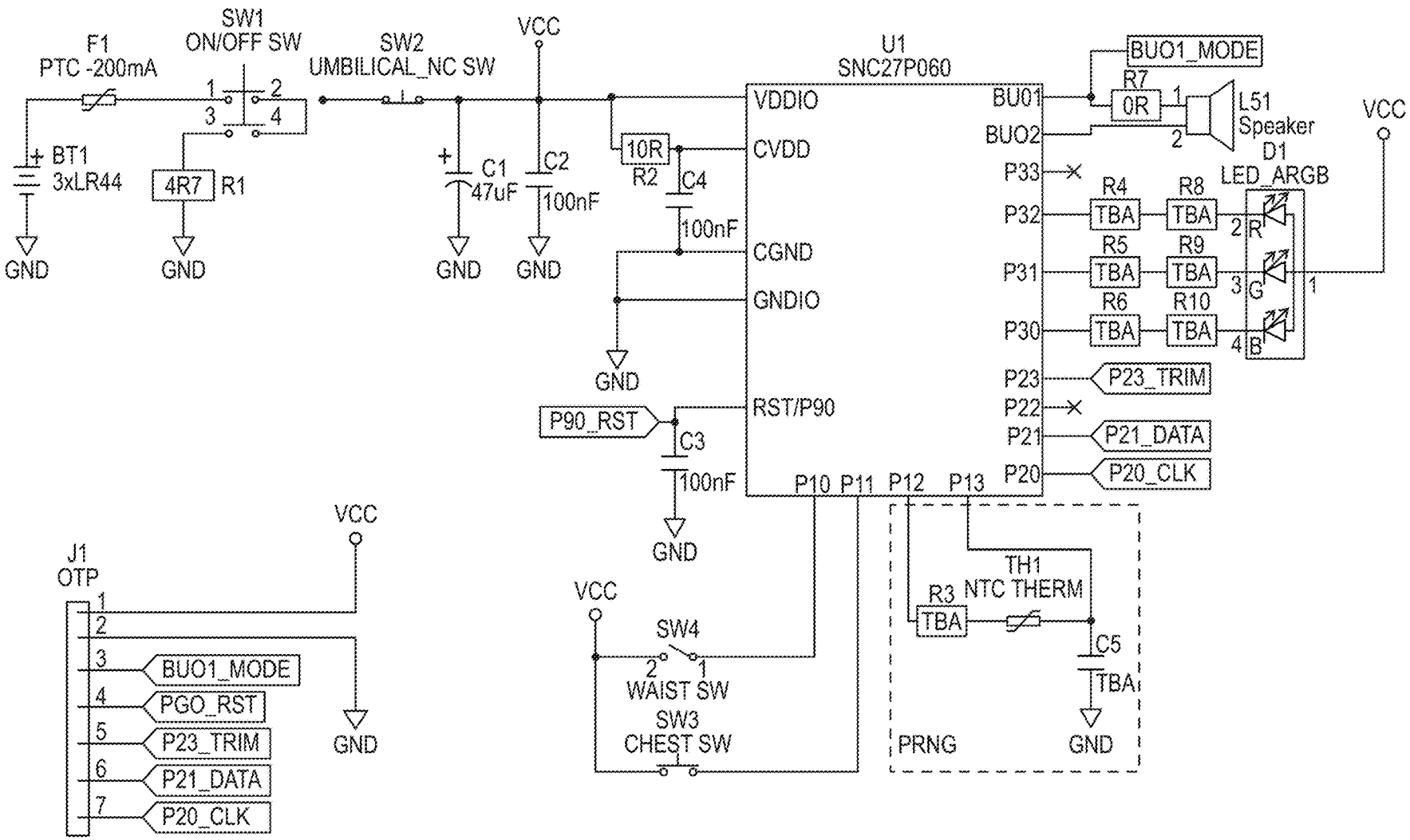
FIG. 38 shows more schematics of electronics for the figurine of FIG. 28.

FIG. 37 and FIG. 38 are schematics of electronics involved in the toy system 100 and the figurine 400, respectively.

Figure 39A:
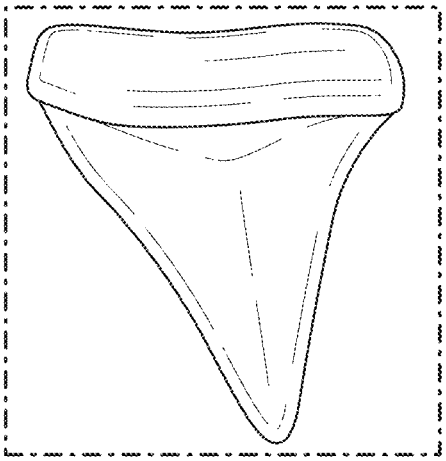
FIG. 39A-39E illustrates different types of ingredients to be added to the flask shown in FIG. 4 during a play.
Figure 39B:
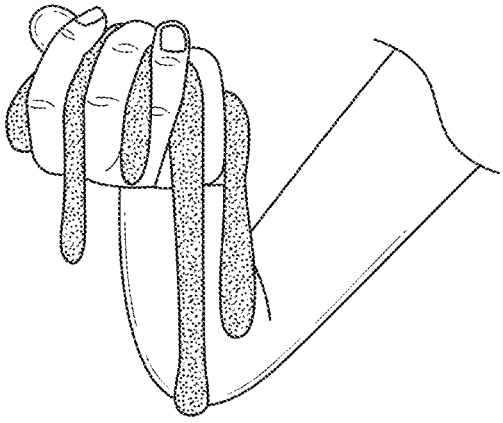
Figure 39C:
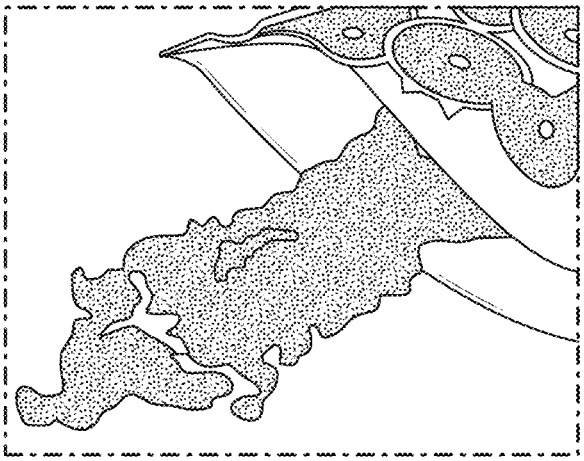
Figure 39C:
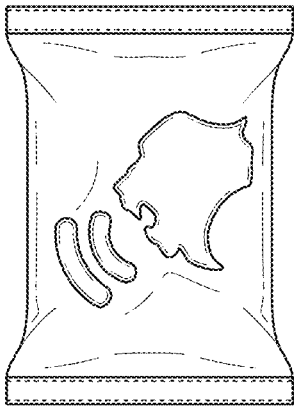
Figure 39D:
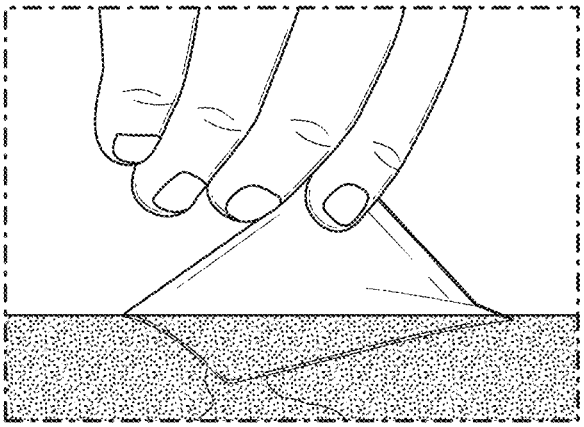
Figure 39E:
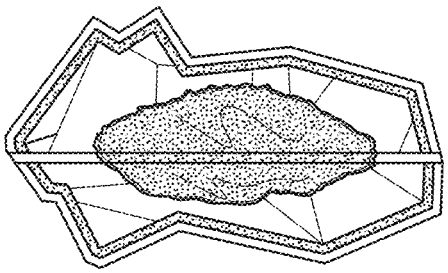

In some embodiments, during the process of playing the toy system 100, the user adds materials or ingredients to the flask 200 from the mouth of the chamber 280, as shown in FIG. 4. The ingredients give the user a realistic impression of actual involvement in creating the figurine 400. In some embodiments, the ingredients may cause certain phenomena to happen in the chamber 280 to signify figurine creation is occurring inside the flask 200. An example of five ingredients is shown in FIGS. 39A-39E. In some embodiments, a shark tooth (e.g., hard matter) is shown in FIG. 39A to signify that a figurine being created may be a shark. FIG. 39B shows a slime matter which may be related to a venom. FIG. 39C is packaged power matter, which when added to water may cause bubbling and popping. FIG. 39D is a dissolved paper, which may be related to the skin of the figurine being created. FIG. 39E is a package of crystal matter, which wen added to water may cause bubbling and color changes. Other embodiments can include different ingredients.

In some embodiments, when the user adds in the solid shark tooth, the user may realize that they will be creating a shark figurine. In some embodiments, when the user adds in the colorful slime matter, the user may imagine that the figurine create will be venomous. In some embodiments, the power matter may cause audible popping or cracking sounds that give the user an impression of strong activities inside the flask 200. In some embodiments, adding in the dissolvable paper relates to the appearance and color of the creature's skin. In some embodiments, when the crystal matter is added, the user may see bubbling and a color change that signifies the growing of the figurine 400 during creation process.

Figure 42:
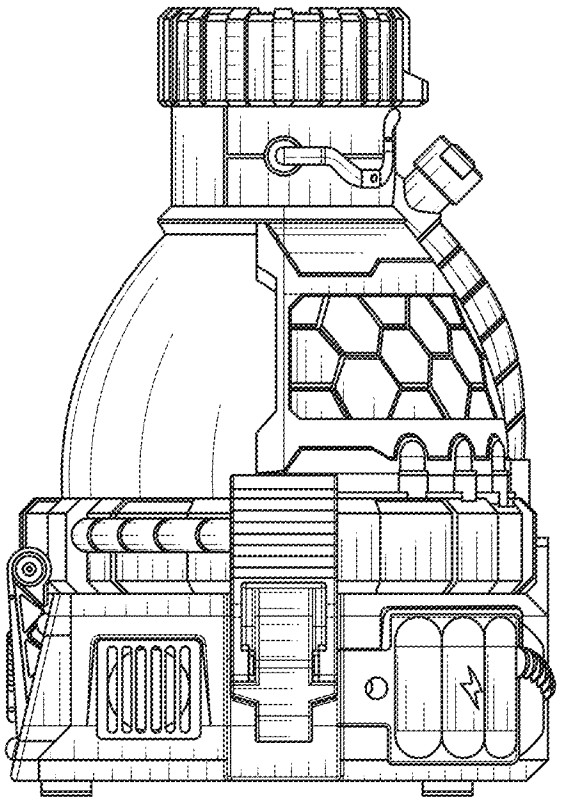
FIG. 42 is a right view of the toy system of FIG. 40.
Figure 41:
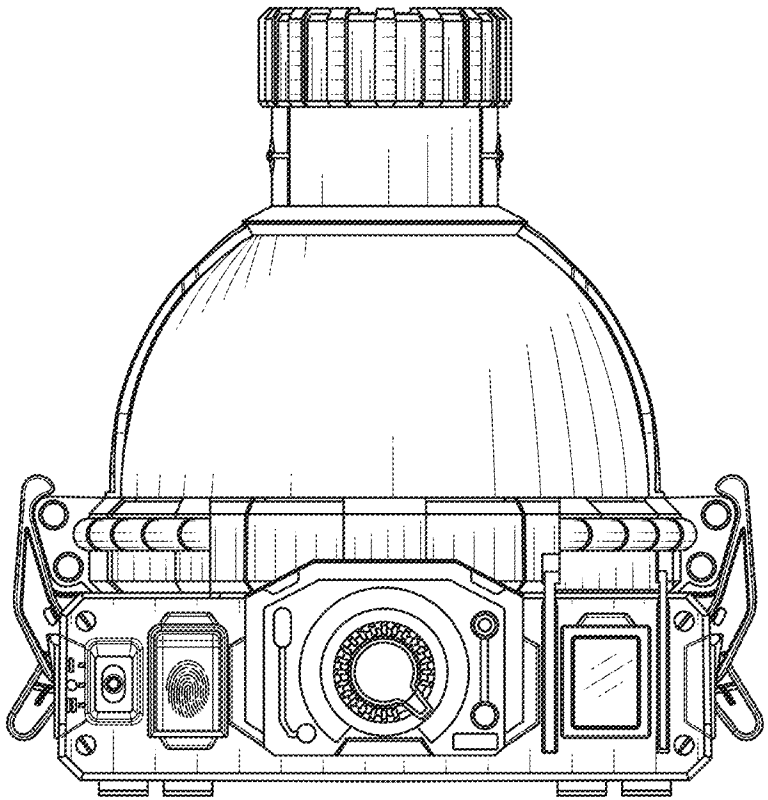
FIG. 41 is a front view of the toy system of FIG. 40.
Figure 44:
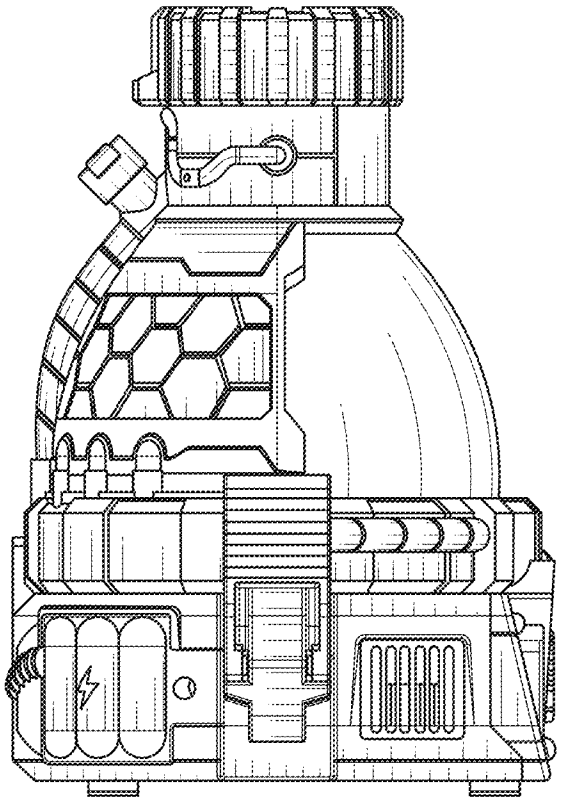
FIG. 44 is a left view of the toy system of FIG. 40.
Figure 43:
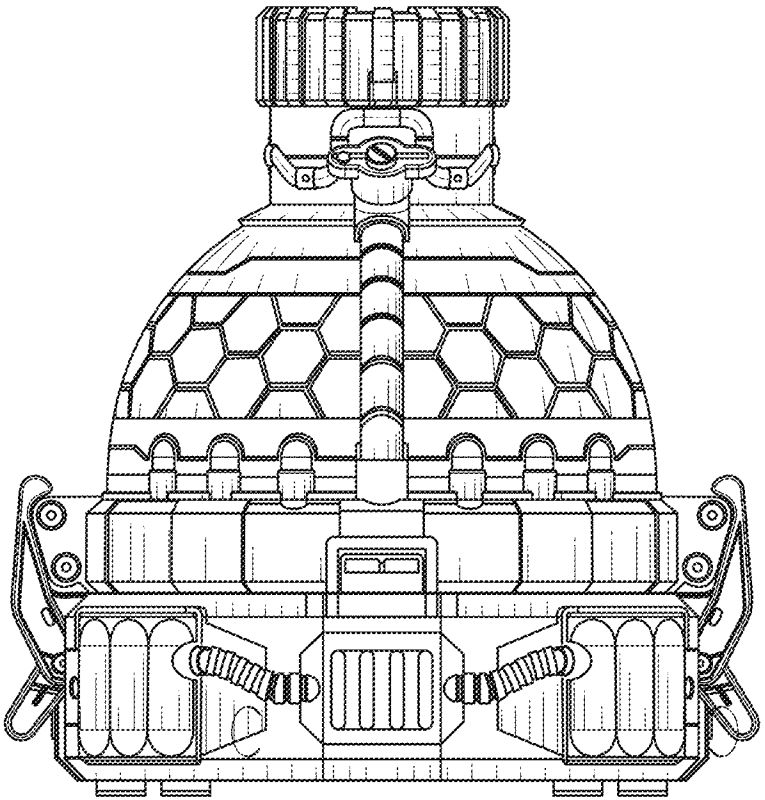
FIG. 43 is a back view of the toy system of FIG. 40.
Figure 45:
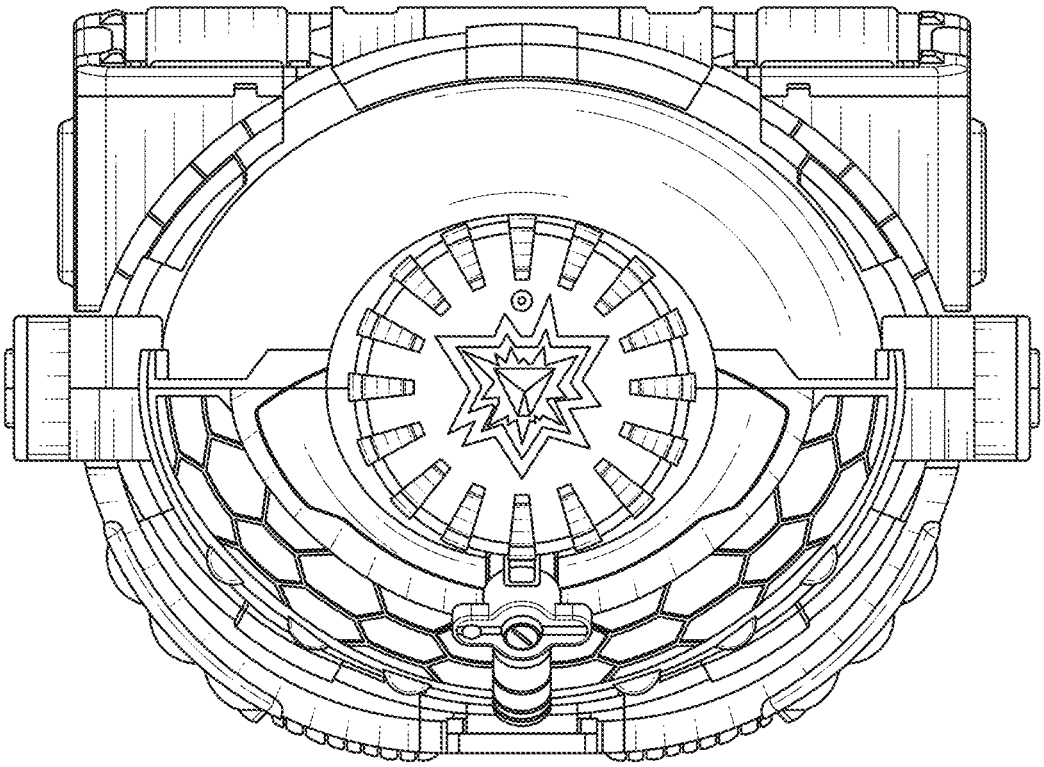
FIG. 45 is a top view of the toy system of FIG. 40.
Figure 46:
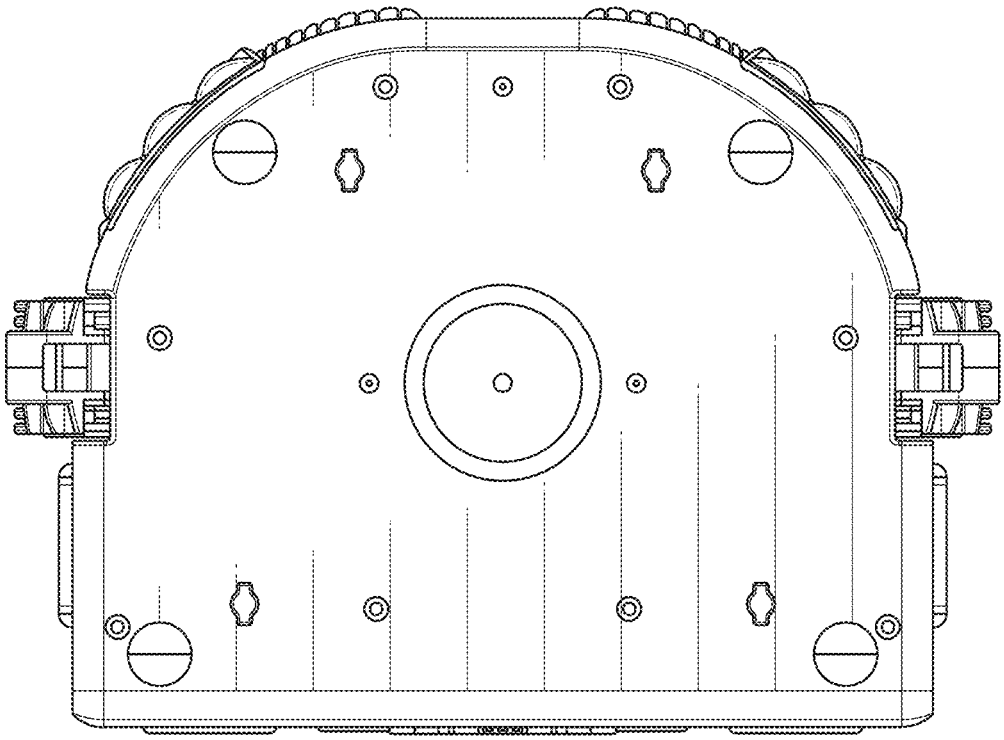
FIG. 46 is a bottom view of the toy system of FIG. 40.

Another embodiment of a toy system that is similar to the toy system 100 described above is shown in FIG. 40 through 46. FIG. 40 is a perspective view of the toy system. FIG. 41 is a front view of the toy system of FIG. 40. FIG. 42 is a right view of the toy system of FIG. 40. FIG. 43 is a back view of the toy system of FIG. 40. FIG. 44 is a left view of the toy system of FIG. 40. FIG. 45 is a top view of the toy system of FIG. 40. FIG. 46 is a bottom view of the toy system of FIG. 40. Although the toy system shown in FIGS. 40 through 46 has a different ornamental appearance than the toy system 100 shown above, the toy system of FIG. 40 has the same functional features for hiding and revealing a figurine held in its internal cavity.

In some embodiments, to play with the toy system 100 (or the toy system of FIGS. 40 through 46), the user may follow instructions provided in the package of the toy system 100, for example, as part of a user's manual. The instructions may include the following exemplary steps:

First switch the on/off switch 370 on the backside of base 300, as shown in FIG. 3, from the off position to the on position to turn on the system. Then scan fingerprint on the fingerprint reader 320 shown in FIG. 3. The fingerprint reader 320 will be illuminated to reveal a fingerprint image.

Turn the control knob to on. This will start the play.

Remove the flask lid 210 shown in FIG. 2.

Add the first ingredient, the hard matter, e.g., a shark tooth, in the chamber 280 through the open mouth, and watch it dissolving in the liquid and fizzing. Meanwhile smoke may start to come out of the smoke outlet 530 shown in FIG. 14. LED lights may intensify.

Turn the control knob clockwise for one stop position.

Add in the sticky slime to the chamber 280. More smoke may come out of the smoke outlet 530. LED lights may further intensify.

Turn the control knob clockwise for one more stop position.

Add the dissolving paper to the chamber 280 to determine the species skin and defense mechanism. Watch the paper dissolve in the fizzy liquid. More smoke may come out of the smoke outlet 530. LED lights may further intensify.

Turn the control knob clockwise for one more stop position.

Add the powder matter to the chamber 280 and listen to the crackling and popping sound in the fizzy liquid. More smoke may come out of the smoke outlet 530. LED lights may further intensify.

Turn the control knob clockwise for one more stop position.

Add the crystal matter in the chamber 280 and watch as liquid foams and grows.

Turn the control knob clockwise for one more stop position.

Quickly replace the lid 210 back onto the flask 200 to close the flask 200. Smoke from the smoke outlet 530 may continue.

Turn the control knob clockwise to the final stop position. The warming LED light 340 shown in FIG. 2 is on.

Pull down the release lever 330 shown in FIG. 2. The warning LED light 340 stops. The liquid in the flask 200 drains and the figurine 400 inside smoke filled vessel is revealed, as shown in FIG. 9.

Pull up latches 350, 360 and remove the flask 200 from the base 300. Disconnect the umbilical cord 375A, 375B in FIG. 29A or FIG. 29B from the figurine 400 to wake up the figurine 400. Remove the figurine 400 from the base 300. The play may involve pushing the button on the figurine's chest, twisting its waist, and/or articulating its body parts.

After a play, the toy system 100 can be reset to the original state before the next play. In some embodiments, this reset involves turning the flask 200 upside down to allow the opaque fluid 240 to drain back into the space 250. During the process, the liquid in the chamber 280 can be dumped out. In some embodiments, the valve 290A, 290B is closed. The chamber can be filled with water or the opaque fluid. The on/off switch 370 should be switched back to the off position. Before the new play, the figurine 400 can be placed back in the base 300, and the umbilical cord connected. Then the flask 200 is placed on the base 300 and the latches 350, 360 and engaged. Of course this is one exemplary method play. Other methods of play fall within the scope of this disclosure.

Terminology

Although certain embodiments and examples are disclosed herein, inventive subject matter extends beyond the examples in the specifically disclosed embodiments to other alternative embodiments and/or uses, and to modifications and equivalents thereof. Thus, the scope of the claims appended hereto is not limited by any of the particular embodiments described above. For example, in any method or process disclosed herein, the acts or operations of the method or process may be performed in any suitable sequence and are not necessarily limited to any particular disclosed sequence. Various operations may be described as multiple discrete operations in turn, in a manner that may be helpful in understanding certain embodiments; however, the order of description should not be construed to imply that these operations are order dependent. Additionally, the structures, systems, and/or devices described herein may be embodied as integrated components or as separate components. For purposes of comparing various embodiments, certain aspects and advantages of these embodiments are described. Not necessarily all such aspects or advantages are achieved by any particular embodiment. Thus, for example, various embodiments may be carried out in a manner that achieves or optimizes one advantage or group of advantages as taught herein without necessarily achieving other aspects or advantages as may also be taught or suggested herein.

Features, materials, characteristics, or groups described in conjunction with a particular aspect, embodiment, or example are to be understood to be applicable to any other aspect, embodiment or example described in this section or elsewhere in this specification unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The protection is not restricted to the details of any foregoing embodiments. The protection extends to any novel one, or any novel combination, of the features disclosed in this specification (including any accompanying claims, abstract and drawings), or to any novel one, or any novel combination, of the steps of any method or process so disclosed.

Furthermore, certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as a subcombination or variation of a subcombination.

Moreover, while operations may be depicted in the drawings or described in the specification in a particular order, such operations need not be performed in the particular order shown or in sequential order, or that all operations be performed, to achieve desirable results. Other operations that are not depicted or described can be incorporated in the example methods and processes. For example, one or more additional operations can be performed before, after, simultaneously, or between any of the described operations. Further, the operations may be rearranged or reordered in other implementations. Those skilled in the art will appreciate that in some embodiments, the actual steps taken in the processes illustrated and/or disclosed may differ from those shown in the figures. Depending on the embodiment, certain of the steps described above may be removed, others may be added. Furthermore, the features and attributes of the specific embodiments disclosed above may be combined in different ways to form additional embodiments, all of which fall within the scope of the present disclosure. Also, the separation of various system components in the implementations described above should not be understood as requiring such separation in all implementations, and it should be understood that the described components and systems can generally be integrated together in a single product or packaged into multiple products.

For purposes of this disclosure, certain aspects, advantages, and novel features are described herein. Not necessarily all such advantages may be achieved in accordance with any particular embodiment. Thus, for example, those skilled in the art will recognize that the disclosure may be embodied or carried out in a manner that achieves one advantage or a group of advantages as taught herein without necessarily achieving other advantages as may be taught or suggested herein.

For expository purposes, the term "horizontal" as used herein is defined as a plane parallel to the plane or surface of the floor or ground of the area in which the device being described is used or the method being described is performed, regardless of its orientation. The term "floor" floor can be interchanged with the term "ground." The term "vertical" refers to a direction perpendicular to the horizontal as just defined. Terms such as "above," "below," "bottom," "top," "side," "higher," "lower," "upper," "over," and "under," are defined with respect to the horizontal plane.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more embodiments or that one or more embodiments necessarily include logic for deciding, with or without other input or prompting, whether these features, elements and/or steps are included or are to be performed in any particular embodiment. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately", "about", "generally," and "substantially" may refer to an amount that is within less than 10% of, within less than 5% of, within less than 1% of, within less than 0.1% of, and within less than 0.01% of the stated amount. As another example, in certain embodiments, the terms "generally parallel" and "substantially parallel" refer to a value, amount, or characteristic that departs from exactly parallel by less than or equal to 15 degrees, 10 degrees, 5 degrees, 3 degrees, 1 degree, 0.1 degree, or otherwise.

What is claimed is:

1. A toy system comprising:

a container having an inner wall, an outer wall, and an internal space, the internal space being defined at least in part by the inner wall and being sized and shaped to receive a figurine, the inner wall and the outer wall being spaced apart to define a space therebetween, the space being configured to hold a fluid;

a base configured to be coupled to the container and in flow communication with the space; and a valve configured to allow the fluid to drain from the space and into the base; and a figurine disposed in the internal space, the figurine being accessible when the container is separated from the base.

2. The toy system of claim 1, wherein at last a portion of the figurine is disposed in a cavity formed in the base.

3. The toy system of claim 1, wherein the base comprises an umbilical cord configured to couple to the figurine.

4. The toy system of claim 1, wherein the container is sized and shaped as a flask, and the base is removable coupled to the container.

5. The toy system of claim 1, wherein the base comprises a tank, the tank being configured to hold the fluid when the fluid is drained from the space.

6. The toy system of claim 1, further comprising a release handle configured to actuate the valve.

7. The toy system of claim 6, further comprising a control knob configured to be rotated by a user.

8. The toy system of claim 7, wherein the release handle is prevented from actuating the valve if the control knob is not rotated.

9. The toy system of claim 1, further comprising a fingerprint reader configured to sense contact from the user.

10. The toy system of claim 1, further comprising a smoke generator configured to generate smoke in the internal space.

11. The toy system of claim 10, further comprising a smoke tube in flow communication with the internal space, the smoke tube being configured to allow smoke from the internal space to exit the toy system.

12. A toy system comprising:

a container having a double wall forming a gap therebetween, the gap being configured to hold a fluid;

a base having a top surface configured to support the container; and a valve configured to allow the fluid to selectively drain from the gap and into the base, wherein the container and the top surface of the base define an internal space sized and shaped to receive a toy, and wherein the toy is accessible when the container is separated from the base.

13. The toy system of claim 12, wherein the valve is configured to be manually opened by a user.

14. The toy system of claim 12, wherein the valve is biased to a closed position.

15. The toy system of claim 12, wherein a first level of the fluid in the gap obfuscates viewing of the toy through the double wall and a second level of the fluid in the gap allows viewing of the toy through the double wall, the first level being higher than the second level.

16. The toy system of claim 12, wherein the fluid drains from the gap to the base due to gravity.

17. The toy system of claim 12, wherein the fluid is opaque.

18. The toy system of claim 12, wherein the container comprises a chamber disposed above the internal space, the chamber being configured to receive a second fluid and one or more ingredients.

19. The toy system of claim 12, further comprising a smoke generator configured to generate smoke in the internal space.

20. A method of revealing a figurine disposed inside a container to a user, the container having a double wall forming a space therebetween, the space being configured to receive an opaque fluid, the container and a support base form an internal space sized and shaped to receive the figurine, the method comprising:

draining the opaque fluid from the space in the double wall and into the support base, the support base being configured to hold the fluid; and decoupling the container from the support base to access the figurine.

21. The method of claim 20, further comprising:

actuating a fingerprint scanner; and rotating a control knob to one or more positions.

22. The method of claim 20, further comprising adding one or more ingredients to a chamber disposed above the internal space.

23. The method of claim 22, wherein the one or more ingredients comprise at least one a shark tooth, paper, a fluid, crystal, and a powder.

24. The method of claim 20, further comprising creating smoke in the internal space.

25. The method of claim 20, further comprising emitting sounds and/or blinking lights.

26. The method of claim 20, further comprising pulling a release handle to begin draining the opaque fluid from the space in the double wall and into the support base.

27. The method of claim 26, wherein pulling the release handle actuates a valve to an open position.

28. The method of claim 20, further comprising turning the container and the support base upside down to cause the opaque fluid to flow back into the space in the double wall.

29. The method of claim 28, further comprising closing a valve to prevent flow of the opaque liquid back into the support base when the container and the support base are turned right side up.

* * * * *